US008025070B2

(12) United States Patent
Griffith

(10) Patent No.: US 8,025,070 B2
(45) Date of Patent: Sep. 27, 2011

(54) APPARATUS FOR TREATING A SURFACE BOUNDING A SPACE WITHIN WHICH A BULK SUPPLY OF FLOWABLE MATERIAL CAN BE CONTAINED

(76) Inventor: Nick Griffith, Rancho Palos Verdes, CA (US)

( * ) Notice: Subject to any disclaimer, the term of this patent is extended or adjusted under 35 U.S.C. 154(b) by 993 days.

(21) Appl. No.: 11/973,083

(22) Filed: Oct. 5, 2007

(65) Prior Publication Data

US 2008/0257246 A1 Oct. 23, 2008

Related U.S. Application Data

(63) Continuation-in-part of application No. 11/214,405, filed on Aug. 29, 2005, now Pat. No. 7,279,051.

(51) Int. Cl.
*B08B 7/00* (2006.01)
*B65D 88/68* (2006.01)

(52) U.S. Cl. ..... 134/172; 134/167 R; 134/168 R; 134/179; 239/229; 114/222

(58) Field of Classification Search ..... 134/172
See application file for complete search history.

(56) References Cited

U.S. PATENT DOCUMENTS

| | | | | |
|---|---|---|---|---|
| 2,104,062 | A | 1/1938 | Temple | |
| 2,827,651 | A | 3/1958 | Rizk | |
| 2,934,779 | A | 5/1960 | Wollner | |
| 3,074,098 | A | 1/1963 | Downing | |
| 3,088,429 | A | 5/1963 | Johannessen | |
| 3,600,224 | A * | 8/1971 | Stilwell | 134/6 |
| 3,638,600 | A | 2/1972 | Mondrey | |
| 3,682,265 | A | 8/1972 | Hiraoka et al. | |
| 3,897,605 | A | 8/1975 | Dickinson | |
| 3,900,968 | A | 8/1975 | Shigyo | |
| 3,984,944 | A | 10/1976 | Maasberg et al. | |
| 4,146,406 | A | 3/1979 | Sampsell | |
| 4,505,001 | A | 3/1985 | Fasolino | |
| 4,718,142 | A | 1/1988 | Wahlers | |
| 4,792,363 | A | 12/1988 | Franklin, Jr. et al. | |
| 5,063,758 | A | 11/1991 | Keller et al. | |
| 5,074,337 | A | 12/1991 | Shaw et al. | |

(Continued)

FOREIGN PATENT DOCUMENTS

EP 0279660 A2 * 8/1988

(Continued)

*Primary Examiner* — Michael Barr
*Assistant Examiner* — Jason Riggleman
(74) *Attorney, Agent, or Firm* — Wood, Phillips, Katz, Clark & Mortimer

(57) ABSTRACT

An apparatus for treating a surface bounding a space within which a bulk supply of flowable material can be contained. The apparatus has an elongate support with a proximal region and a distal region. At least one flexible tube is provided at the distal region of the elongate support through which a fluid from a pressurized supply can be directed. The at least one flexible tube is movable continuously in a whipping action to thereby cause a force to be applied to a surface at or adjacent to which the flexible tube is located to thereby at least one of: a) apply a fluid; and b) separate matter adhered, to a surface at or adjacent to which the flexible tube is located. The apparatus further has a moving assembly for the elongate support. The moving assembly is operable to controllably reposition and/or reconfigure the elongate support, thereby to controllably place the at least one flexible tube at different selected locations with respect to a surface to be treated by the apparatus.

23 Claims, 39 Drawing Sheets

U.S. PATENT DOCUMENTS

| | | | | |
|---|---|---|---|---|
| 5,107,568 | A | 4/1992 | Wade | |
| 5,109,567 | A | 5/1992 | Harrison | |
| 5,125,126 | A | 6/1992 | Bonnant | |
| 5,347,677 | A | 9/1994 | Prentice | |
| 6,165,283 | A * | 12/2000 | Dahlin et al. | 134/21 |
| 6,260,232 | B1 | 7/2001 | Nelson et al. | |
| 6,564,815 | B2 | 5/2003 | McQuire | |
| 2004/0089216 | A1 | 5/2004 | Vanrompay | |

FOREIGN PATENT DOCUMENTS

| | | |
|---|---|---|
| GB | 467264 | 6/1937 |
| WO | WO87/02015 | 5/1987 |

* cited by examiner

FIG. 20
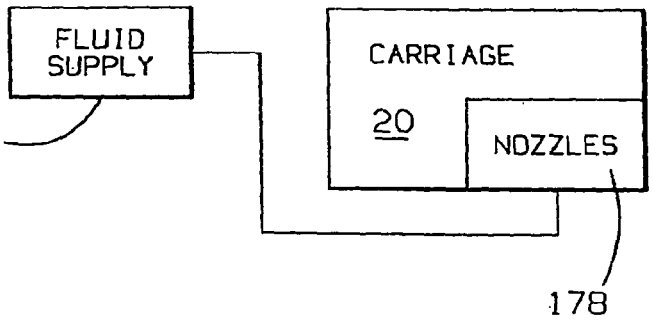
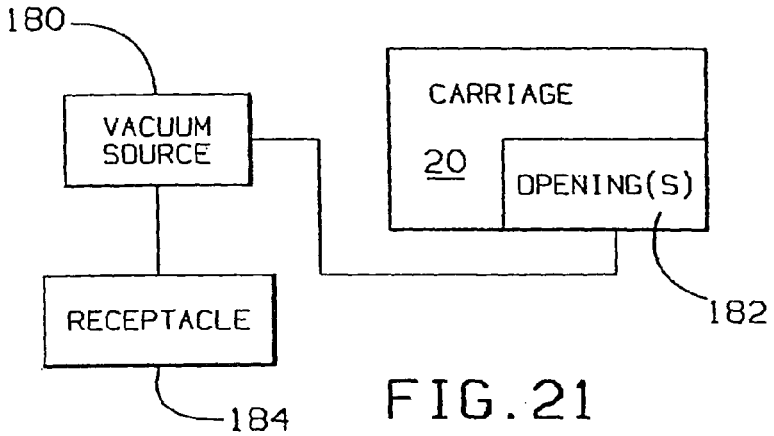
FIG. 21
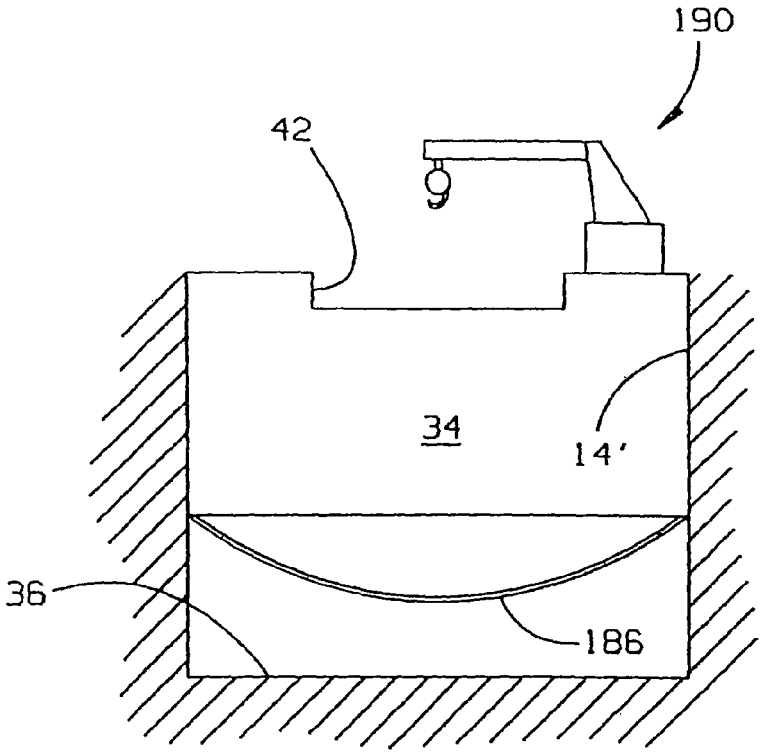
FIG. 22

FIG. 28
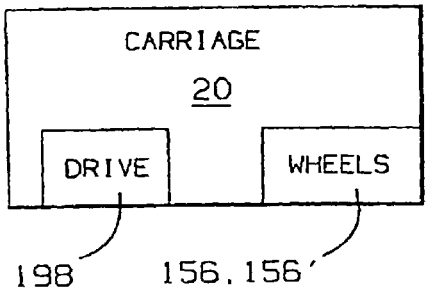
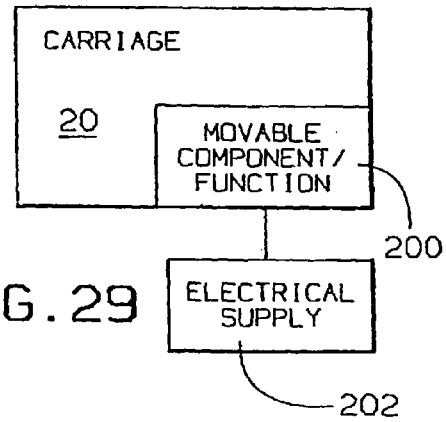
FIG. 29
FIG. 30
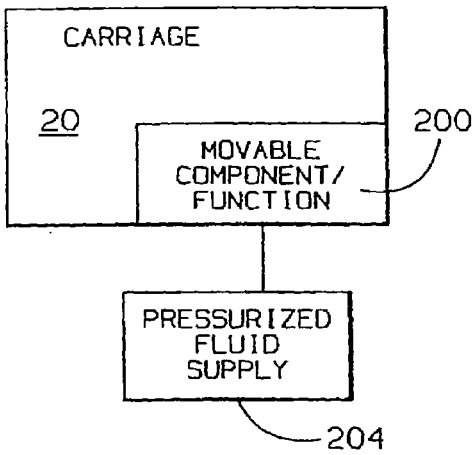
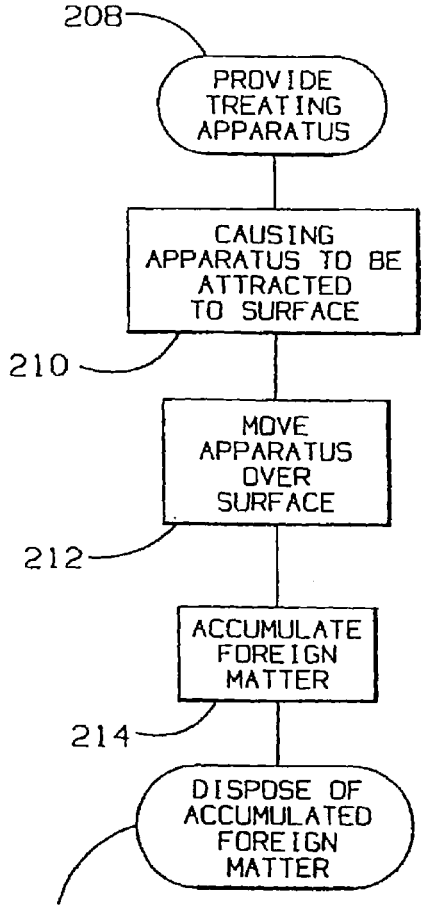
FIG. 31
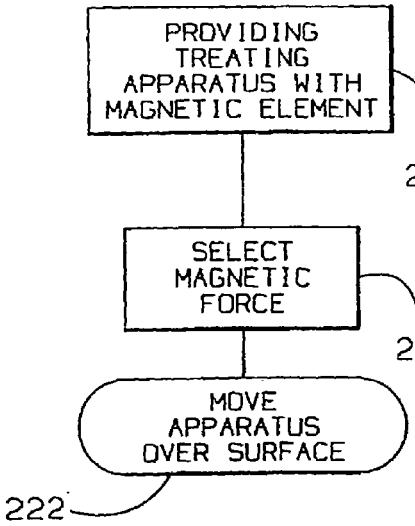
FIG. 32

FIG. 78
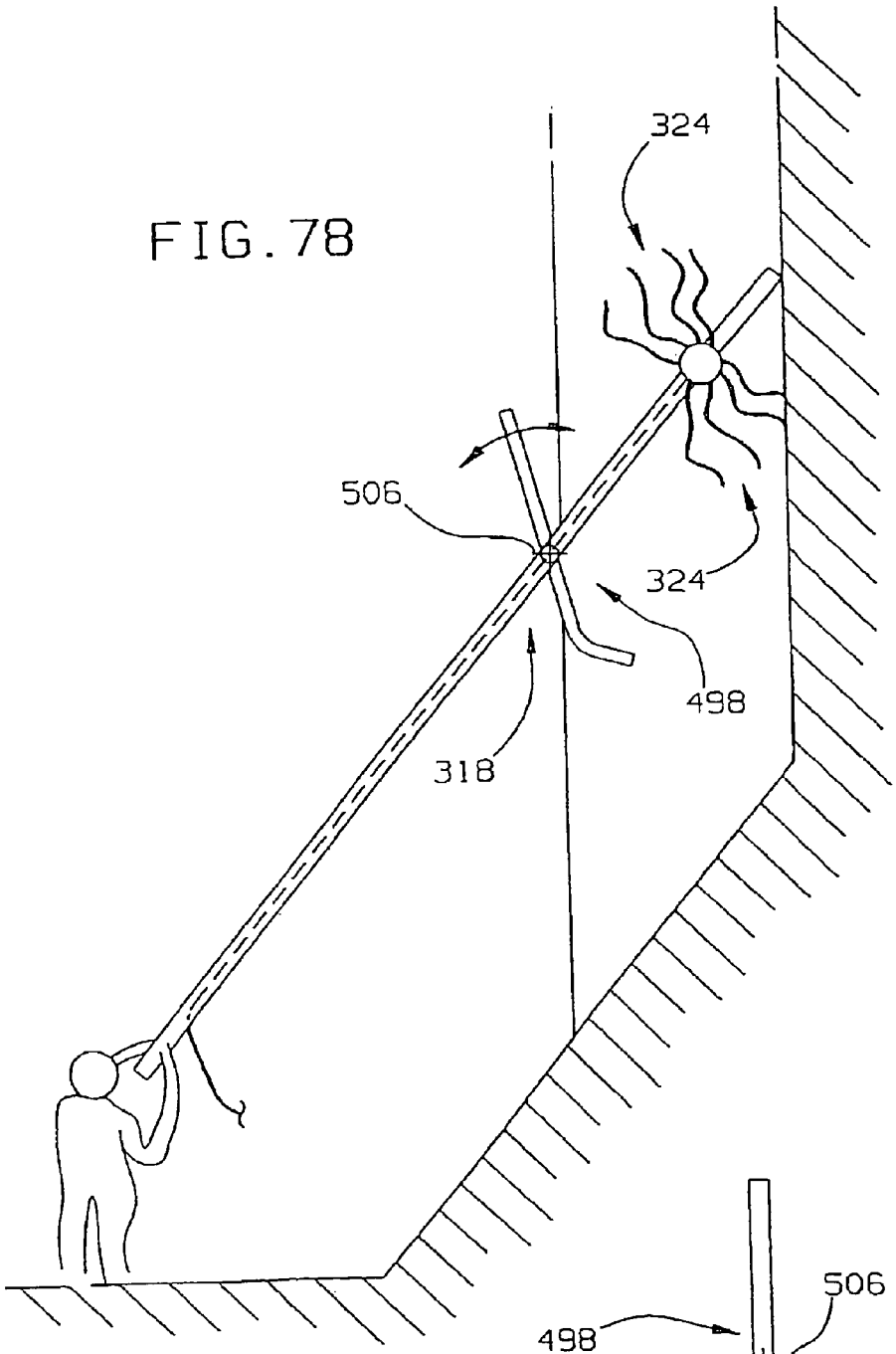
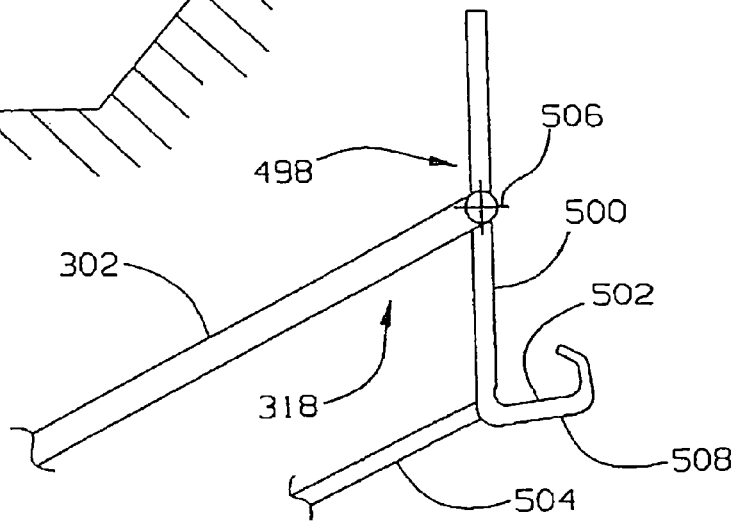
FIG. 79

APPARATUS FOR TREATING A SURFACE BOUNDING A SPACE WITHIN WHICH A BULK SUPPLY OF FLOWABLE MATERIAL CAN BE CONTAINED

CROSS-REFERENCE

This application is a continuation-in-part of my application Ser. No. 11/214,405, filed Aug. 29, 2005, now U.S. Pat. No. 7,279,051 entitled "Method for Separating Matter From An Exposed Surface".

BACKGROUND OF THE INVENTION

1. Field of the Invention

This invention relates to environments wherein there are exposed surfaces bounding a space within which a bulk supply of flowable material can be contained and, more particularly, to an apparatus for at least one of: a) applying a fluid; and b) separating matter adhered, to the surface.

2. Background Art

Cargo ships, especially dry-bulk cargo and liquid-bulk cargo ships, are used to transport a wide range of products and materials on waterways worldwide. In one known dry-bulk cargo ship construction, multiple cargo holds are formed in the ship's hull to accept bulk quantities of particulate material. Each cargo hold is bounded by a metallic wall structure and has an overhead access for loading and unloading of the materials. A typical cargo hold may have length and width dimensions on the order of 100 feet, a height on the order of 60 feet, and in excess of 220,000 square feet of exposed, interior, surface area.

A description of the transportation of powdered cement in a dry bulk cargo ship will be provided hereinbelow to demonstrate some of the problems that have plagued this industry. In a typical operation, a cargo hold will be filled with the cement at a load port. At the destination port, the cement is discharged. Loading and discharge of the cement is carried out using any of a number of different, well-known techniques and equipment. These techniques are designed to remove the majority, but not all, of the bulk cargo. The balance of the residual cargo, as well as residues of previous cargo, other debris, loose rust, scale, loose paint and other potential contaminants such as stains, must also be removed prior to loading another cargo at the same or a different load port.

In the event that the hold is refilled with cement, the preparation of the hold for reloading may be minimal. However, if the next cargo is different, all interior surfaces of the hold, including the walls of the hold, may have to be thoroughly cleaned so as to not contaminate the new product with the cement residue that adheres to the walls, overhead and other structures, fittings within the hold, and hatch covers.

The shipping industry is highly competitive. Consequently, efficiency becomes a primary focus of those in this industry. A ship in port is doing nothing more for its owner/operator/charterer than generating expenses. Any crew that is not participating in the cleaning process is being paid for down time. Docking, fuel, and other fees accrue on a daily basis. Charter times are usually calculated in six minute intervals. Thus, it is clearly in the interest of the owner/operator to quickly, safely and efficiently clean the cargo holds and refill the same to allow transportation of materials and generation of income after the ship is certified clean and placed "on hire". Unfortunately, an emphasis on efficiency may cause a compromise in safety in the cleaning operations. Even on an expedited schedule, however, the preparation of five to nine separate cargo holds may take as long as 3-5 days, or longer.

Many of the above problems are inherent to cargo ship holds by reason of their significant expanse. However, other exposed surfaces in those environments in which discrete, flowable/pourable matter is stored and/or conveyed present a particular problem to those that are required to treat them, either by reason of separating matter therefrom or applying a surface preparation product thereto.

There are a number of exposed surfaces, both flat and contoured, that exist in cargo holds, on hatch covers, and in other environments, that require special measures to separate adhered matter. The matter may be foreign matter that becomes adhered to a surface by reason of contact with that surface, such as in the event of a separately stored material that contacts the surface. Alternatively, the matter may have been generated from the surface itself, be it by rust, corrosion, loose paint, interaction with a component, or infliction of some damage to the surface. Regardless of the origin of the matter, it is often present in such a manner that it is either a) adhered with a significant tenacity to the surface or b) located at a contour, scar, indentation, or obstruction such that is not readily accessible to be directly contacted and dislodged, as by a brush or scraper, or impacted by a pressurized supply of gas, liquid, or solid.

These conditions may be present in ship cargo holds and other environments, such as silos, storage tanks, barns, bulk rail hopper cars, storage and transfer hoppers, etc. The surfaces thereof may be made from any of a number of different materials, such as metal, concrete, plastic, wood, etc. Further, these conditions are not peculiar to environments in which materials are stored. As one example, material conveyors have surfaces, which support and transport matter and otherwise come into contact with the matter, that must be cleaned during use. For purposes of explanation herein, the number of field conditions which the present invention is adapted to address will be described with respect to the shipping industry, with it being understood that the application is not so limited and may be used in any environment wherein materials are in contact with surfaces in both static and dynamic states.

In a ship's cargo hold, a number of surface configurations are routinely encountered. In addition, each cargo hold may have its own unique configuration which impairs access and complicates the process of separating matter from exposed surfaces thereon.

Typical to ship holds are corners at which side walls, floors, and ceiling surfaces meet. Ladders and stairs for ingress and egress are also common to this environment. A crew cleaning a ship's cargo hold can also anticipate encountering ledges, hatches with various recessed contours, etc. It is also common in the shipping industry to bound cargo holds with corrugated panels and steel beams.

Heretofore, those cleaning ship cargo holds have had essentially two options. The first option is to use currently available equipment to access these hard-to-reach areas directly by the worker on a lift or ladder. This typically involves using lifts for higher surfaces to situate the worker in close proximity to the particular condition. While some such surfaces may be reasonably accessible, most surfaces are not, due in part to their height. At some locations, the matter to be separated, by reason of inaccessibility due to either height or some obstruction, may be accessed as by a blast of pressurized air, potentially at medium or high pressure, which causes light particles to become entrained in the surrounding area. This may create a health risk to the workers and also potentially obstructs vision.

It is also known to impact liquid against such surfaces either alone or in combination with gas augmentation. One such method utilizes a water cannon delivered by a hose. Another method utilizes a water cannon with pressure assist through medium pressure air. Alternatively, the liquid, which may be water, is impacted at high pressures.

It is further known to use shotguns to blast regions with pellets to break loose matter that is difficult to remove either by reason of the height at which it is located, or the tenacity with which it is adhered.

These latter processes are limited in the sense that they generally require an unobstructed path between the unit propelling the gas or liquid and the area to be impacted and thereby treated. Most shipping environments include contours, obstructions, indentations, etc., that preclude direct linear access.

Some structures also create other unique conditions that must be contended with by those cleaning surfaces in these environments. For example, at upwardly facing ledges and other transition areas, a significant accumulation of matter may occur. Breaking up a large accumulation of such matter typically is accomplished by directly accessing the accumulations, potentially at dangerously high locations. Alternatively, blasting such accumulations may aggravate the aforementioned problem of entraining the lighter particles, which creates health risks and obscures workers' vision within the hold.

Accordingly, a second option in the industry to avoid these time consuming efforts is to focus the cleaning operation on bulk recovery, without spending the time required to separate matter by accessing these surfaces. This practice may contribute to the deterioration of surfaces over time. The residue may also contaminate subsequently loaded materials. This latter option is almost inevitable in certain environments in which surface intricacies are such that it would be impractical for workers to directly access and/or break loose the matter at a number of different locations.

The cleaning process is not limited to separately adhered matter, but may also involve removing stain and rust and scale that is adhered with a tenacity sufficient that it is not easily broken loose, as by a brush passing thereagainst. Consequently, there is a need to take other measures to remove this type of potential contaminant. In a large volume space, in which there may be over 220,000 square feet of surface to treat, such a cleaning operation may represent an enormous amount of down time as crews maneuver and use equipment that requires that the ship be at rest in port.

Heretofore, individual workers have generally employed tools in the form of small brushes and scrapers. These tools may require a significant force application, depending upon surface conditions, and make surface contact over only a small area as they are used. Thus, treatment of the full expanse of a surface within a ship's hold is labor intensive and fatiguing when carried out with this conventional equipment. If the size of the tools is increased to increase surface contact area, the manipulation of the tools, either directly or through elongate poles, becomes more onerous and fatiguing. Even with smaller tools, worker fatigue is a significant problem, potentially in a relatively short time frame. To minimize down time, it becomes necessary to use large crews that require relief after fatigue sets in. It may not be practical, or even possible, to keep available the number of persons necessary to meet reasonable cleaning deadlines imposed by those with a financial stake in the shipping operations.

Another operation that is commonly undertaken is the application of a component preparatory to storage of a particular type of material. Ideally, an additive would be applied to each surface which the material contacts. This may be a labor intensive process, particularly in large spaces wherein workers have been required to be placed in close proximity to the surfaces to which the additive is applied. Conventional application techniques may be inadequate to apply the additive to surfaces that are intricate, in tight spaces, or not readily accessible.

The shipping industry has for the most part contended with the above problems, most notable which are significant down time, expensive cleaning processes, and potentially ineffective cleaning of ship cargo holds. The industry continues to be in need of improved methods and apparatus for cleaning foreign matter from, and treating, such surface areas.

SUMMARY OF THE INVENTION

One form of the invention is directed to an apparatus for treating a surface bounding a space within which a bulk supply of flowable material can be contained. The apparatus has an elongate support with a proximal region and a distal region. At least one flexible tube is provided at the distal region of the elongate support through which a fluid from a pressurized supply can be directed. The at least one flexible tube is movable continuously in a whipping action to thereby cause a force to be applied to a surface at or adjacent to which the flexible tube is located to thereby at least one of: a) apply a fluid; and b) separate matter adhered, to a surface at or adjacent to which the flexible tube is located. The apparatus further has a moving assembly for the elongate support. The moving assembly is operable to controllably reposition and/or reconfigure the elongate support, thereby to controllably place the at least one flexible tube at different selected locations with respect to a surface to be treated by the apparatus.

In one form, the moving assembly has a frame upon which the elongate support is mounted.

In one form, the frame has at least one wheel upon which the frame can be supported upon a subjacent surface and which can be rolled against the subjacent surface to facilitate repositioning of the frame and thereby the elongate support.

In one form, the frame has a plurality of wheels upon which the frame can be supported.

In one form, the moving assembly has a powered drive for selectively repositioning the frame, and thereby the elongate support, within a space within which the apparatus is located.

In one form, the elongate support has a length that can be changed thereby to change a position of the at least one flexible tube relative to the frame.

In one form, the elongate support has a lengthwise axis with an angular relationship with the frame and the angular relationship of the lengthwise axis with the frame can be changed.

In one form, at least a part of the elongate support can be turned about an axis relative to the frame.

In one form, the elongate support has a lengthwise axis and at least a part of the elongate support can be translated relative to the frame in a direction transversely to the lengthwise axis.

In one form, the frame has a support for at least one user.

In one form, the apparatus has a control system through which a user, supported on the frame, can cause the elongate support to be repositioned and/or reconfigured.

In one form, the apparatus has a powered drive for selectively moving the frame from within a space within which the apparatus resides. The apparatus has a control system through which a user, supported on the frame, can operate the powered drive.

The invention is further directed to the combination of the above apparatus and a floating vessel in which a bulk supply of flowable material can be stored and transported on a navigable body of water. The floating vessel has a cargo hold with a surface bounding a space within which the apparatus at least partially resides within the at least one flexible tube moving continuously in a whipping action to thereby cause a force to be applied to the surface.

In one form, the at least one flexible tube is movable continuously in a random whipping action as an incident of the fluid being directed through the at least one flexible tube.

In one form, the apparatus is provided in combination with a pressurized supply of fluid directed through the at least one flexible tube. The fluid is at least one of: a) a liquid; and b) a gas.

In one form, the at least one flexible tube consists of a plurality of flexible tubes at the distal region of the elongate support.

In one form, at least one part of the support is movable relative to another part of the support to controllably place the at least one flexible tube at different selected locations.

In one form, the at least one part of the support is pivotable relative to the another part of the support.

In one form, the frame is repositionable and/or reconfigurable to controllably place the at least one flexible tube at different selected locations.

In one form, the elongate support consists of a first elongate support and at least a part of the first elongate support is releasably joined to the frame through releasable connector parts on the first elongate support and frame. A second elongate support can be releasably joined to the frame in place of the first elongate support through the releasable connector part on the frame and a releasable connector part on the second elongate support.

In one form, the elongate support has a working portion with separate, spaced working sections, each of which has at least one flexible tube associated therewith. The flexible tubes at the separate, spaced working sections simultaneously are engageable at different locations on a surface to be treated.

The apparatus may reside partially outside of the space.

In another form, the invention is directed to an apparatus for treating a surface bounding a space within a bulk supply of flowable material can be contained. The apparatus has a support with a working portion with spaced working sections. At least one flexible tube is provided at each of the working sections through which a fluid from a pressurized supply can be directed. The at least one flexible tube on each of the working sections is movable continuously in a whipping action to thereby cause a force to be applied to a surface at or adjacent to which the flexible tube is located to thereby at least one of: a) apply a fluid; and b) separate matter adhered to a surface at or adjacent to which the flexible tube is located. The flexible tubes on each of the working sections are simultaneously engageable at different locations on a surface to be treated. The apparatus further includes a moving assembly for the elongate support. The moving assembly is operable to controllably reposition and/or reconfigure the elongate support, thereby to controllably place the at least one flexible tube on each of the working sections at different selected locations with respect to a surface to be treated by the apparatus.

The apparatus may be provided in combination with a floating vessel in which a bulk supply of flowable material can be stored and transported on a navigable body of water. The floating vessel has a cargo hold with a surface bounding a space within which the apparatus at least partially resides, with the at least one flexible tube moving continuously in a whipping action to thereby cause a force to be applied to the surface.

BRIEF DESCRIPTION OF THE DRAWINGS

FIG. 20 is a schematic representation of a carriage, according to the present invention, including at least one nozzle for directing pressurized fluid, which may be a liquid or gas, from a supply to against a surface being treated;

FIG. 21 is a schematic representation of a carriage, according to the present invention, and including at least one opening in communication with a vacuum source to develop suction at the opening and a receptacle for accumulating foreign material drawn through the opening(s);

FIG. 22 is a schematic representation of a cargo hold with a flexible collecting element therein;

FIG. 28 is a schematic representation of a carriage, according to the present invention, including at least one wheel that is driven so that the carriage is self-propelled;

FIG. 29 is a schematic representation of the inventive carriage having a movable component/function that is operated electrically;

FIG. 30 is a schematic representation, corresponding to that in FIG. 29, wherein the movable component/function is operated hydraulically or pneumatically;

FIG. 31 is a flow diagram representation of one method of treating a surface, according to the present invention;

FIG. 32 is a flow diagram representation of another method of treating a surface, according to the present invention;

FIG. 78 is a view as in FIG. 75 wherein a shield assembly is provided to control escape of fluid from the shell frame compartment;

FIG. 79 is an enlarged, fragmentary, side elevation view of the shield assembly of the distal end of the elongate support in which treating fluid is allowed to accumulate and controllably discharge;

DETAILED DESCRIPTION OF THE DRAWINGS

Figure 1:
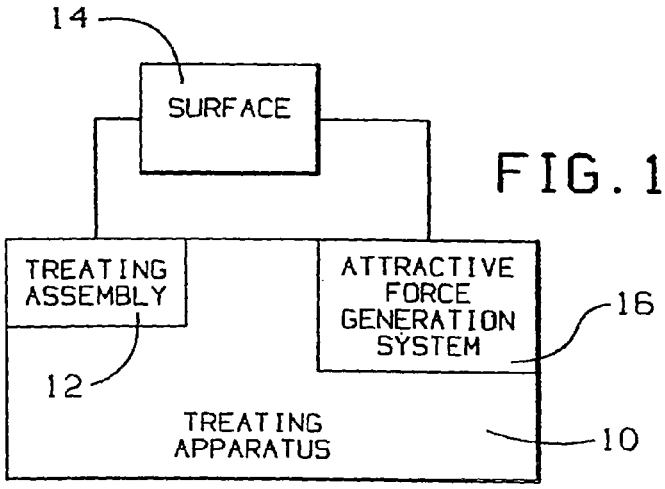
FIG. 1 is a schematic representation of one form of treating apparatus, according to the present invention, in relationship to a surface, to which the treating apparatus is attracted, and which surface is treated with a treating assembly on the inventive apparatus.

In FIG. 1, a treating apparatus, according to the present invention, is shown at 10. The treating apparatus 10 has a treating assembly 12 that is designed to perform a treating function with respect to a surface 14. The nature of the treating operation is not critical to the present invention. Virtually any treatment process, from cleaning to reconfiguration, is contemplated. FIG. 1 is shown in schematic form to encompass all types of surface treating operations.

According to the invention, the treating apparatus 10 is attracted to the surface 14 with a force tending to maintain the apparatus 10 against the surface 14, yet allow the apparatus 10 to move over the surface 14 to treat a desired area thereof. This force is generated through what is schematically shown as an attractive force generation system 16, which may take any of myriad different forms. As just one example, the attractive force generation system 16 may use vacuum to generate a suction force between the treating apparatus 10 and the surface 14. Alternatively, magnetic attraction can be utilized for surfaces 14 that are ferrous in nature. Again, this system 16 is shown generically in FIG. 1 to encompass virtually any type of structure that attracts the apparatus 10 to the surface 14, while allowing the apparatus 10 to move therealong to effect treatment of a prescribed area.

Figure 2:
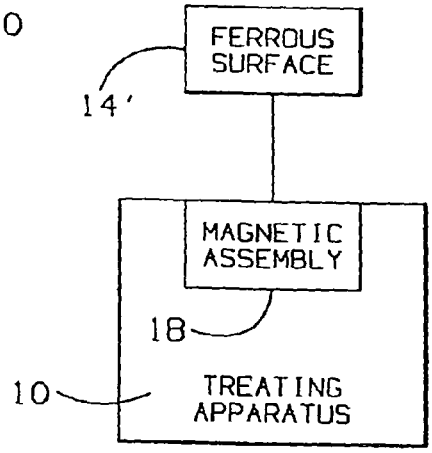
FIG. 2 is a schematic representation of the inventive treating apparatus in relationship to a ferrous surface to which the treating apparatus is attracted through a magnetic assembly.

As shown in FIG. 2, one preferred form of attractive force generation system incorporates a magnetic assembly 18, which is attracted to a surface 14' that is ferrous in nature.

Figure 3:
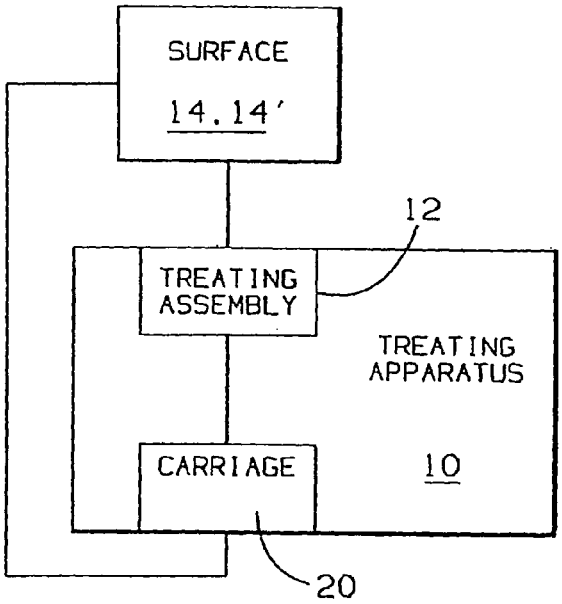
FIG. 3 is a schematic representation of the inventive treating apparatus with the treating assembly attached to the carriage that acts against a ferrous or non-ferrous surface to be treated.

In one preferred generic configuration for the apparatus 10, as shown in FIG. 3, the carriage 20 acts directly against the surface 14, 14'. The treating assembly 12 is mounted operably upon the carriage 20 to act against the surface 14, 14'.

Figure 4:
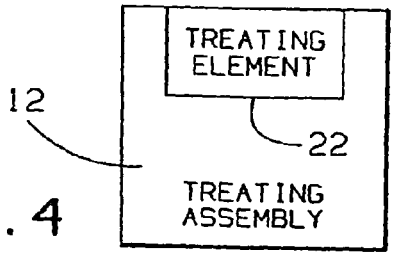
FIG. 4 is a schematic representation of the treating assembly in FIG. 3 and including a treating element that directly contacts a surface to be treated.

As shown in FIG. 4, the treating assembly 12 can incorporate any of a virtually limitless number of different treating elements, shown generically at 22.

What is common to the designs shown in FIGS. 1-4 is that the treating apparatus 10 has an overall configuration to be movable against a surface and controllably reoriented through the application of a maneuvering force upon the apparatus 10 by a user from a location spaced from the carriage 20. Ideally, the treating apparatus 10 is of such a construction that it can be easily lifted by a user, placed against the surface 14, 14', and moved and reoriented without excessive exertion on the part of the user.

The designs in FIGS. 1-4 are shown schematically to incorporate virtually a limitless number of different designs that use the inventive concept(s) described herein. Various, specific designs, and methods of using the apparatus 10, will now be described, with it to be understood that the specific examples are intended to be representative, but not limiting, in nature.

Figure 5:
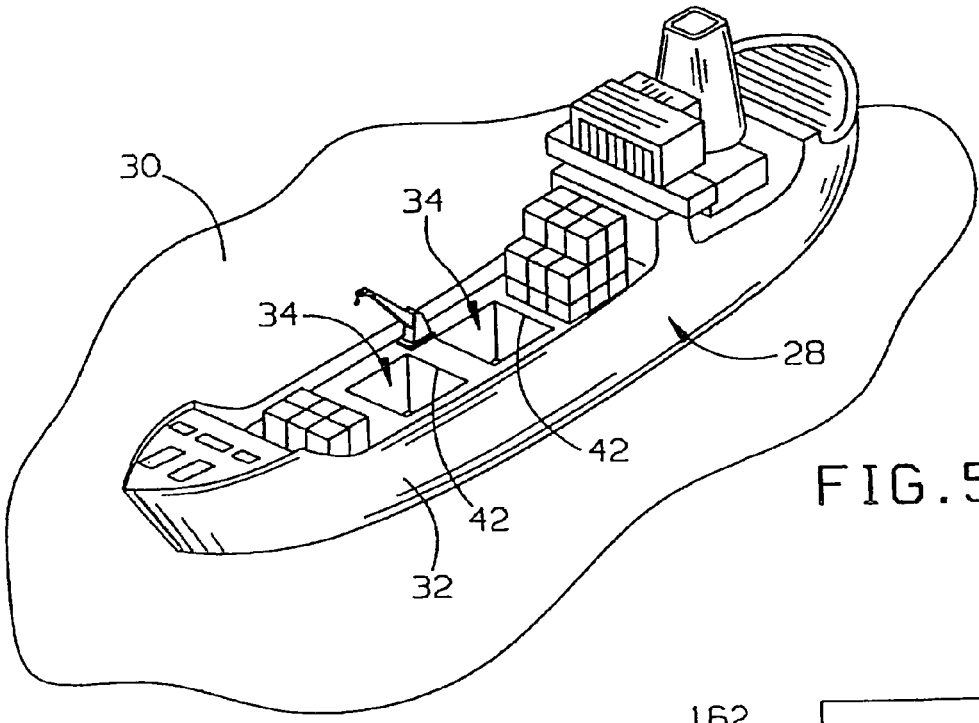
FIG. 5 is a perspective view of a cargo ship having a cargo hold which can be treated using the inventive apparatus and by a method according to the present invention.
Figure 6:
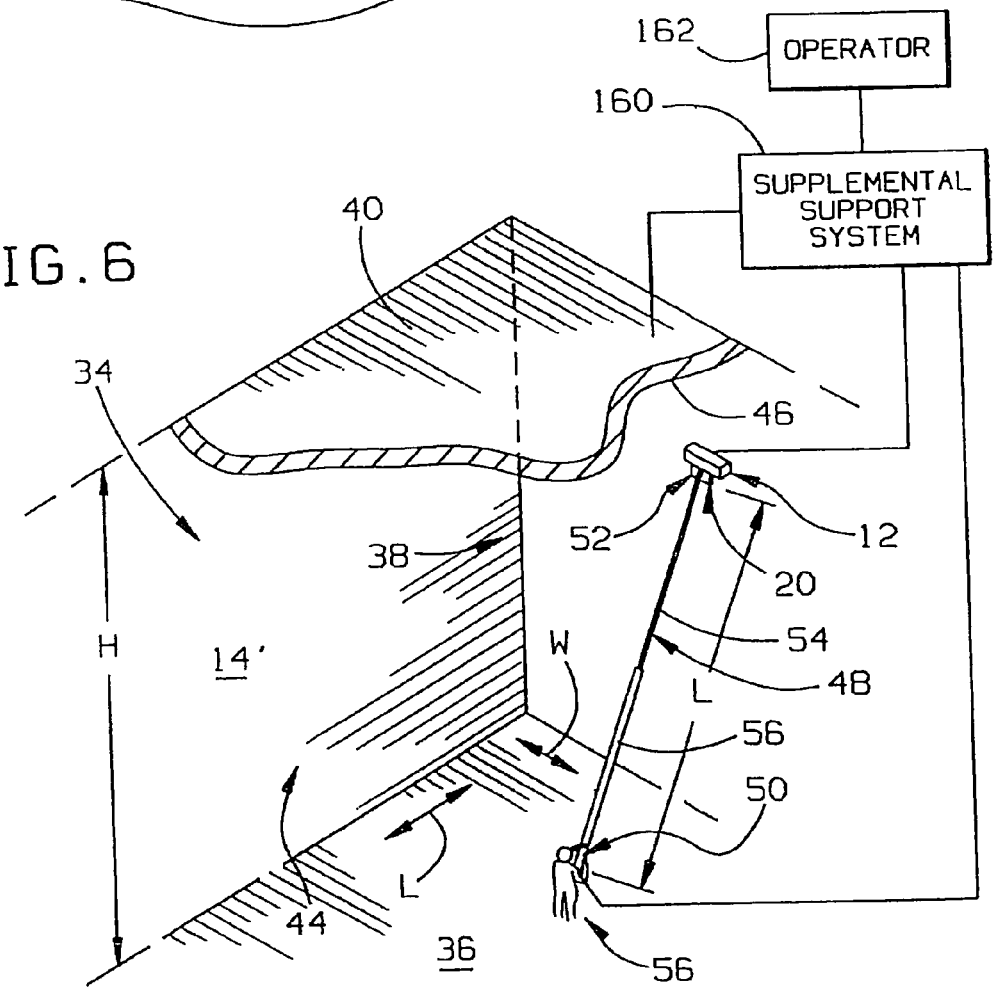
FIG. 6 is an enlarged, fragmentary, perspective view of one of the holds on the cargo ship in FIG. 5 and with one form of the inventive apparatus being maneuvered by a user to treat a surface bounding a storage space defined by the cargo hold.

More specifically, as shown in FIGS. 5 and 6, the treating apparatus 10 has particular utility in the shipping and bulk cargo (dry-bulk and liquid-bulk) industry. As noted in the Background portion herein, treating/cleaning of holds in cargo ships is a particularly vexatious problem, for which the present invention is particularly suited. In FIG. 5, a cargo ship is shown at 28 and is of the type useable on any navigable body of water 30. The ship 28 has a hull 32 within which cargo holds 34 are formed. In this particular design, two such cargo holds 34 are shown. In a more typical ship construction that is currently used, more than two, and commonly five, cargo holds 34 are incorporated. However, the number and configuration of the cargo holds 34 is not critical to the present invention.

In FIG. 6, a portion of one of the holds 34 is shown in relatively schematic form. The cargo hold 34 is bounded by a ferrous surface 14'. The ferrous surface 14' defines a floor 36, a peripheral wall structure 38, and a deck wall 40, through which openings 42 are formed. The openings 42 (FIG. 5) are in communication with a storage space 44 within the holds 34. Materials are introduced to, and withdrawn from, the holds 34 through the openings 42.

The hold 34 is shown in a simplified, schematic form. In actuality, there are a number of contours within the storage space 44 that make cleaning of the surface 14' difficult. Additionally, a staircase and other structure are typically constructed within the space 44 and define obstacles to cleaning.

As noted in the Background portion herein, the cargo hold 34 may have length and width dimensions, designated by the double-headed arrows L, W, respectively, on the order of 100 feet. The height dimension H, between the floor 36 and ceiling 46, may be on the order of 60 feet.

In one form of the invention, shown in FIGS. 6-12, the apparatus 10 consists of the carriage 20, with the treating assembly 12 mounted operatively thereupon. The carriage 20 is connected to an elongate pole 48 through which the treating apparatus 10 is reoriented and moved to cover a desired areal region.

The pole 48 may have a fixed length L between a manipulating end 50 and a carriage mounting end 52. More preferably, the pole 48 is made with telescoping lengths 54, 56. While two such lengths 54, 56 are shown, any number of lengths can be utilized.

The nature of the pole components is not critical to the present invention. It is desirable that the pole 48 be light in weight to allow controlled manipulation thereof and the attached treating assembly 12 by a user at 58 from the floor 36 to access the entire surface 14', to include the portion thereof defining the entire peripheral wall structure 38 and the ceiling 46. The telescoping lengths 54, 56 may be made from a lightweight metal, plastic, composite, etc. At the same time, the pole 48 must have sufficient rigidity to allow controlled placement by the user 58 of the treating apparatus 10 and maneuvering thereof across the surface 14'.

The pole 48 may be straight, as shown, or shaped to access certain obstructed areas. As just one example, a "gooseneck" may be provided on the end of the pole 48.

In this embodiment, the carriage 20 has a frame 60 consisting of a base element 62, that is generally flat, with spaced flanges 64, 66 projecting substantially orthogonally therefrom.

The flanges 64, 66 support a pole mounting assembly at 68, consisting of a crosspiece 70 and a transverse portion defining a receptacle 72 for the carriage mounting end 52 of the pole 48. The crosspiece 70 has offset ends 74, 76 with stub shafts 78, 80 projecting oppositely away therefrom. The shafts 78, 80 have a like construction. The stub shaft 78 has a larger diameter portion 82 that is journalled for rotation in an opening 84 in the flange 66. The stub shaft 80 has a larger diameter portion 86 that is journalled for rotation in an opening 88 in the flange 64. The stub shafts 78, 80 have central axes 90, 92 that are coincident and about which the pole mounting assembly 68 is pivotable for movement relative to the frame 60. The stub shafts 78, 80 have smaller diameter portions 94, 96 that are threaded and define a support for the treating assembly 12, to allow the treating assembly 12 to pivot about the same axes 90, 92 relative to the frame 60.

The treating assembly 12 has a subframe 100, consisting of spaced end walls 102, 104 joined by a mounting wall 106. Triangularly-shaped mounting brackets 108, 110 are connected to the mounting wall 106 and are spaced so as to closely embrace the flanges 64, 66. The smaller diameter portions 94, 96 of the stub shafts 78, 80 project through the mounting brackets 108, 110, which are secured in place by nuts 112, 114. Through this arrangement, the subframe 100 is pivotable relative to the frame 60 about the same axes 90, 92.

In this embodiment, the treating element 22 is in the form of a rotary brush. The treating element 22 has a central shaft 116 which spans between the end walls 102, 104 and is journalled for rotation relative thereto around an axis 118, that is generally parallel to the axes 90, 92. Individual bristles 120 extend radially relative to the axis 118 regularly around the circumference of the shaft 116 and along the length thereof. The subframe 100 includes an integral shroud 122 with an opening 124 through which the bristles 120 are exposed.

A drive motor 126 is mounted to the mounting wall 106 on the subframe 100 through a bracket 128. A belt 130, extending in an endless path around the motor shaft 132 and central shaft 116 on the treating element 22, transmits the driving force of the motor to effect rotation of the treating element 22 around the axis 118.

The drive motor 126 is powered through a supply 134. The power supply 134 can be self-contained and mounted upon the carriage 20. Alternatively, as shown in dotted lines, a supply line 136 can be directed over and through the hold 48 to a remote location where a power supply 134 is located. For example, the power supply 134 may be a remote generator or a land supply accessed through a receptacle within the cargo hold 34 associated with the power supply 134.

The treating assembly 12 may have a fixed position relative to the carriage 20. More preferably, the treating assembly 12 is pivotable about the axes 90, 92 relative to the carriage 20 such that the treating element 22 is movable towards and away from the surface 14'. Preferably, a biasing assembly 138 acts between the carriage 20 and treating assembly 12 to normally bias the treating assembly 12 in the direction of the arrow 140 around the axes 90, 92. With the carriage 20 bearing against the surface 14', this biasing force urges the treating element 22 towards and against the surface 14'.

The nature of the biasing assembly 130 is not critical to the present invention. For example, the biasing assembly 138 may be defined by one or more tension or compression springs. Alternatively, a torsion spring may be utilized for this purpose. Alternatively, pneumatic cylinders might be utilized to exert a constant force and provide some flexibility in movement of the treating assembly 12 about the axes 90, 92, oppositely to the direction of the arrow 140.

In this embodiment, the carriage 20 is equipped with structure to allow it to be rolled against the surface 14' and also to be attracted thereto, as previously described. More specifically, spaced mounting blocks 142, 144 are fixed to the base 62 to support rotary wheels/shafts 146, 148, for rotation around parallel axes 150, 152. The wheels/shafts 146, 148 have the same construction. The exemplary wheel/shaft 146 has a core 154 around which axially spaced wheel elements 156 are formed. Each wheel element 156 defines a peripheral surface 158 for rolling against the surface 14'. Each wheel element 156 is made from, or incorporates, a magnetic material that is attracted to the ferrous surface 14'. The wheel/shaft 148 has corresponding wheel elements 156' with peripheral surfaces 158'.

The magnetic material is incorporated depending upon the overall weight and configuration of the treating apparatus 10, including the pole 48. That is, the size, strength, and location of the magnetic material can be appropriately selected so that the attractive force between the treating apparatus 10 and the surface 14' will urge the carriage 20 against the surface 14' during the treating of all regions of the surface 14' within the cargo hold 34.

In the absence of this attractive force, the maintenance of the carriage 20 in contact with the surface 14' is dependent upon the user's ability to generate an adequate applying force. This is particularly a problem with overhead surfaces, such as the ceiling/overhead 46, and also with the treating assembly 12 manipulated through the pole 48 to the upper regions of the cargo hold 44. For example, as shown in FIG. 6, in the absence of this attractive force, the pole 48 has a tendency to bow at extreme lengths such that the treating assembly 12 tends to move out of contact with the surface 14'. Selecting an appropriate magnetic attraction force overcomes this problem.

Even with the magnetic attraction, the treating assembly 12 may be difficult to manipulate through the pole 48 at extreme heights. To facilitate this manipulation, and additionally for purposes of added safety and avoiding user fatigue, a supplemental support system can be provided, as shown at 160. The supplemental support system 160 may be attached, as to the deck wall 40, and extends to the treating assembly 12 and/or the pole 48. The supplemental support system 160 may include flexible elements, such as cables, ropes, bungees, etc., and use pulleys, etc., to produce a vertical and/or horizontal locating force upon the treating apparatus 10. As one example, horizontal wires may be permanently or temporarily affixed to encircle the inner perimeter of the hold. These wires can be used to support the flexible elements. The supplemental support system 160 may be fixed, or may be reconfigurable, as through the operator, or through a remote operator 162, as shown in FIG. 6, during a cleaning operation.

The nature of the treating assembly 12 can vary considerably depending upon the particular treating procedure that is being carried out. For example, in the embodiment described above, the bristles 120 can be made with different configurations and from different materials. The bristles 120 may be made, for example, from plastic or metal. The bristles 120 may have the straight configuration shown, or may be made with a herringbone configuration, or otherwise.

Figure 13:
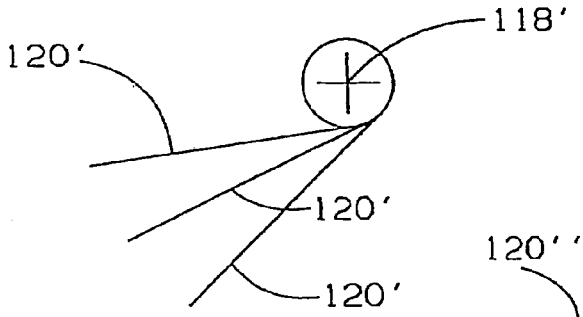
FIG. 13 is a schematic, side elevation view of a modified form of treating element for the inventive treating assembly.

Additionally, while the bristles 120 are shown to extend with their lengths radially aligned with the axis 118, by exposing like bristles 120' at an angle to the corresponding axis 118', shown in FIG. 13, the associated treating assembly 12 tends to advance itself by reason of the interaction between the bristles 120' and the surface 14' as the bristle support is rotated around its operating axis. This action thus assists the user in advancing the associated treating assembly 12 relative to the surface 14'. This facilitates treatment of the surface 14' and reduces user fatigue associated with operating the apparatus.

Figure 14:
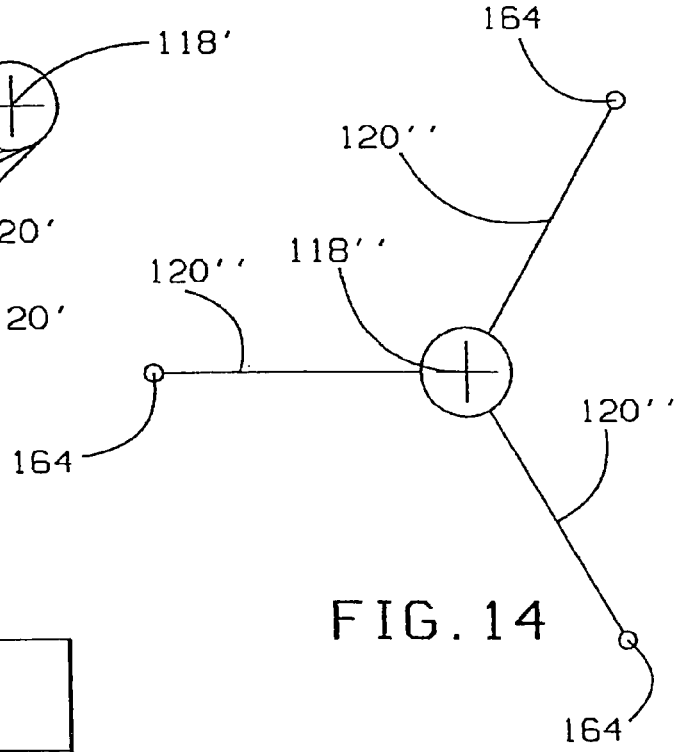
FIG. 14 is a view as in FIG. 13 of a further modified form of treating element.
Figure 15:
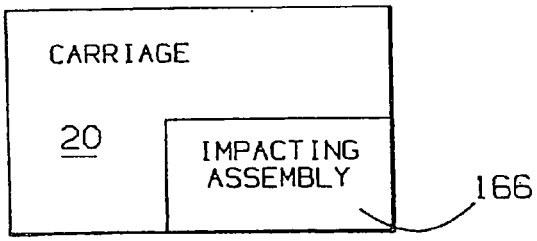
FIG. 15 is a schematic representation of the inventive carriage having a generic form of impacting assembly thereon of the type shown in FIG. 14.

As a further variation, as shown in FIG. 14, the bristles 120" may have discrete weights 164 at the ends thereof to cause a repetitive impacting of the surface 14', to produce a hammering action, thereby to break lose foreign material tending to adhere to the surface 14'. The structure in FIG. 14 represents one form of impacting assembly that can be utilized. In FIG. 15, a more generic disclosure of an impacting assembly is shown at 166 for attachment to the carriage 20, as to produce a hammering action. Structures, other than that shown in FIG. 14, are contemplated, so long as the structure is capable of producing a jarring impact that breaks loose foreign materials.

Figure 16:
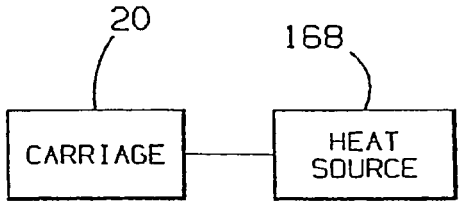
FIG. 16 is a schematic representation of the carriage, according to the present invention, and including a heat source.

To assist the treating operation, a heat source 168, shown in FIG. 16, can be provided on the carriage.

Figure 17:
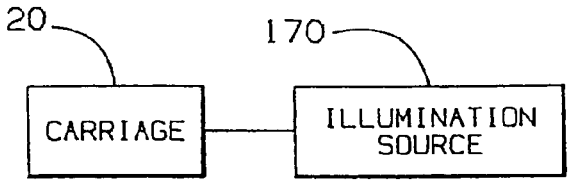
FIG. 17 is view as in FIG. 16 wherein the carriage includes an illumination source.

As a still further alternative, an illumination source 170, shown in FIG. 17, can be provided on the carriage.

Figure 18:
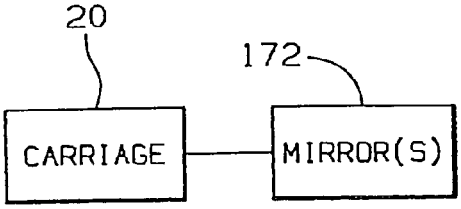
FIG. 18 is a view as in FIGS. 16 and 17 wherein the carriage includes at least one mirror.

As a further variation, as shown at FIG. 18, at least one mirror 172 can be provided on the carriage 20. The mirror(s) 172 facilitates observation by a user of a surface being treated either before or after treatment thereof.

Figure 19:
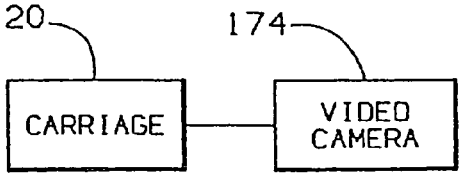
FIG. 19 is a view as in FIGS. 16-18 wherein the carriage includes a video camera.

As a still further variation, in FIG. 19, a video camera 174 is shown mounted to the carriage 20. The video camera 174 facilitates remote viewing of the treating location.

The invention contemplates that functions other than abrasion, as through a device with bristles, be accomplished using the inventive concepts. In FIG. 20, the carriage 20 is shown associated with a supply of pressurized fluid 176. The fluid supply 176 may be directly on the carriage 20 or, alternatively, may be provided at a remote location and communicated to the carriage, as through an appropriate conduit. The carriage 20 has at least one nozzle 178 through which the fluid is directed against the surface 14, 14'. The nature of the fluid in the supply 176 could vary significantly, and may be air, a solvent, steam, or other flowable material, potentially in particulate form. For example, a supply of sand that is used to blast the surface 14, 14' is considered to be a "fluid" for purposes herein.

As a still further alternative, as shown in FIG. 21, the carriage 20 may be associated with a vacuum source 180 that generates suction at an opening 182 on the carriage 20. The vacuum source 180 again may be directly on the carriage 20 or remote therefrom.

The various components, described above, may be used in any combination, as deemed appropriate. For example, the vacuum source 180 may be used on the carriage 20 in conjunction with a brush/bristled element and/or with the fluid supply 176 to thereby draw, through suction, foreign matter away from the surfaces 14, 14', as the bristles 120" are pivoted about the axis 118". When the bristles of a cleaning layer are "tilted" as they are, for example, in the commercially available 3M® Brushlon™ products, and then vibrated, the magnetic force urging the apparatus against the wall prevents the assembly from falling and the tilted brushes tend to move it in a direction against the direction of the tilt.

In FIG. 21, the vacuum source may also be associated with a receptacle 184, which allows accumulation of the foreign material that is collected, for appropriate disposal thereof.

Figure 23:
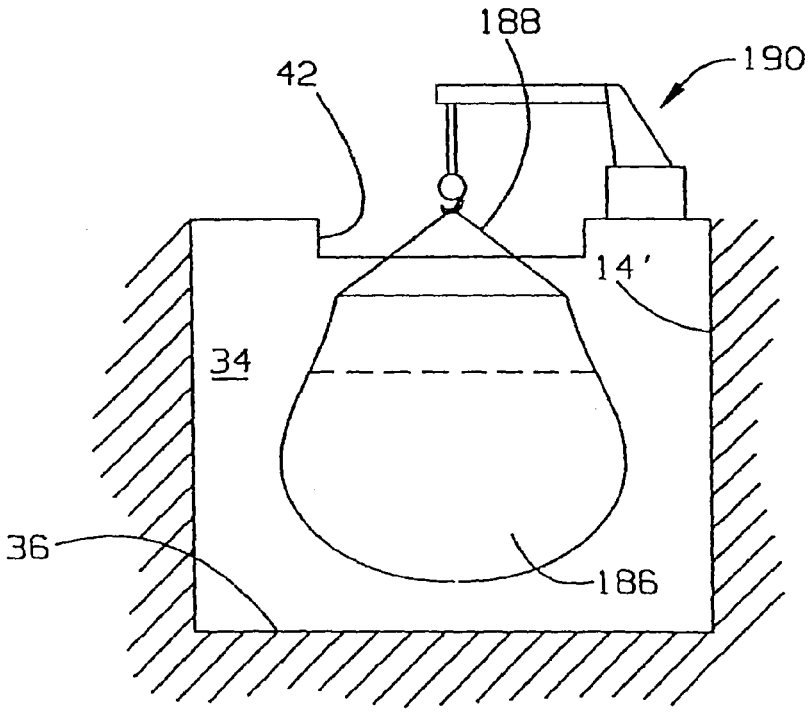
FIG. 23 is a view as in FIG. 22 wherein the collecting element, with foreign material accumulated therein, is being reconfigured and elevated towards an opening through a boom structure.
Figure 24:
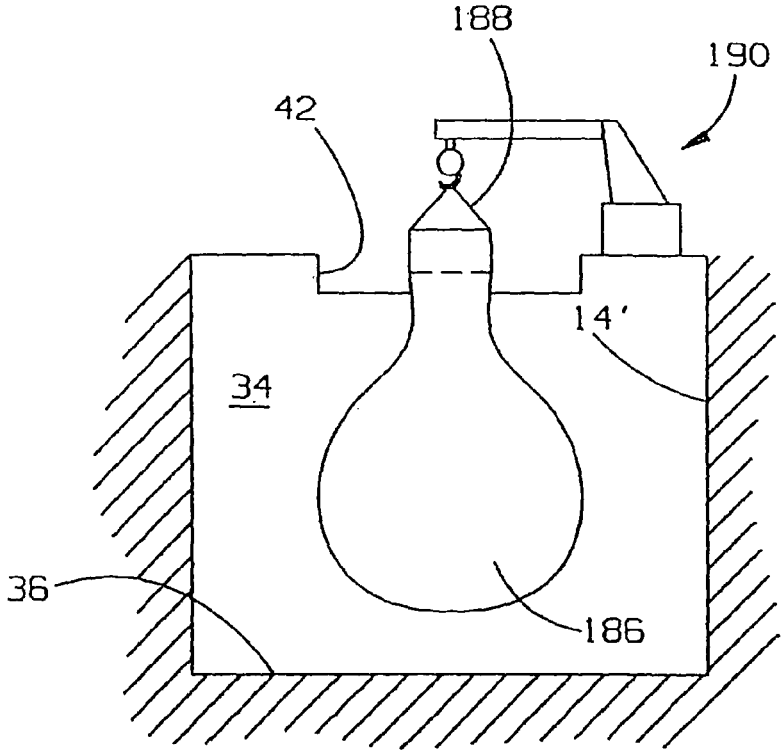
FIG. 24 is a view as in FIGS. 22 and 23 wherein the collecting element is further elevated and reconfigured to allow passage through the opening.

As an alternative to having a discrete receptacle 184, as shown in FIG. 21, a reconfigurable collection element 186 may be provided as shown in FIGS. 22-24. In FIG. 22, the collection element is shown as a reconfigurable, tarp-like structure that covers all or a portion of the floor 36 in the vicinity of where foreign material is broken loose from the surface 14'. As this occurs, the foreign material falls downwardly to against the collection element 186. At a certain point in the procedure, a draw cord 188 is lifted through a boom structure 190 outside of the cargo hold 34. Continued lifting causes the collection element 186 to be reconfigured under the weight of the collected foreign matter to the point that it can pass through the opening 42 for appropriate disposal.

Figure 25:
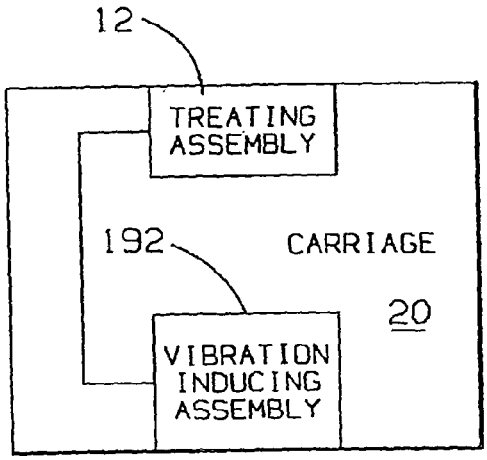
FIG. 25 is a schematic representation of a carriage, according to the present invention, including a vibration inducing assembly for part or all of the treating assembly.

Additional structure is contemplated for enhancing the ability of the treating apparatus 10 to break loose foreign material from the surfaces 14, 14'. As shown in FIG. 25, a vibration inducing assembly 192 may be provided on the carriage 20 to induce vibration to part or all of the treating assembly 12 on the carriage 20. This makes possible a scrubbing action, which adds another dimension to the movement of the treating assembly 12 relative to the surface 14, 14'.

Figure 26:
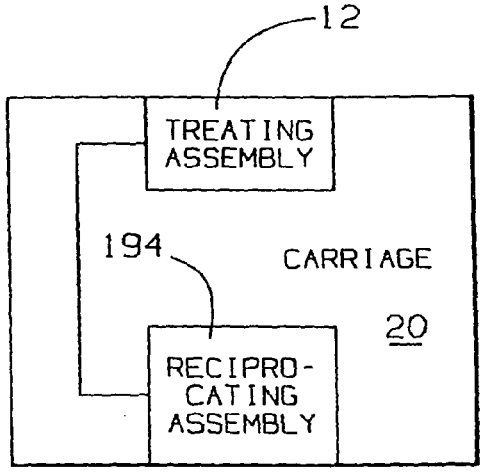
FIG. 26 is a view as in FIG. 25 wherein a reciprocating assembly is provided in place of the vibration inducing assembly.
Figure 27:
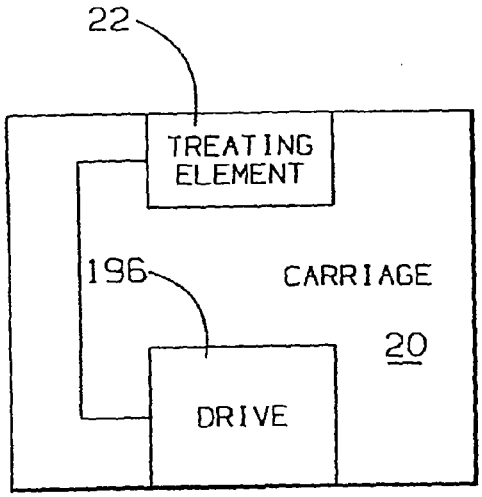
FIG. 27 is a schematic representation of a carriage, according to the present invention, including a treating element that is moved through a drive.

As shown in FIG. 26, as an alternative to the vibration inducing assembly 192, a reciprocating assembly can be provided, as shown at 194, to reciprocatively move at least a part of the treating assembly 12 to provide an additional surface treating capability. The reciprocating and vibration inducing assemblies 194, 192 can be used in conjunction with other treating structure on the carriage 20, such as the structure in FIG. 20, wherein nozzles 178 direct pressurized fluid against the surface 14, 14'. In short, the invention contemplates virtually any single or multiple dimensional movement of the treating element 22 on the carriage 20. This generic concept is shown schematically in FIG. 27, wherein a drive 196 is associated with the treating element 22 to effect single or multidimensional movement i.e. vibrational and translational movement, or otherwise.

To assist operation of the apparatus 10, and avoid user fatigue, the wheels 156, 156' on the carriage 20 may be driven, as through a drive 198, to make the apparatus 10 either full time, or selectively, self-propelled.

As shown in FIG. 29, it is contemplated that any movable component/function associated with the carriage 20, shown generically at 200, could be operated electrically through an appropriate supply 202, that may be self-contained or otherwise designed. Alternatively, as shown in FIG. 30, the same function can be accomplished pneumatically or hydraulically using a pressurized fluid supply 204.

A method of using the above-described apparatus will now be described with respect to a flow diagram, shown in FIG. 31. As shown at block 208, the treating apparatus is provided. The treating apparatus has a carriage with a treating assembly on the carriage. As shown at block 210, the apparatus is caused to be attracted to the surface to be treated. This may be accomplished magnetically, in the event of a ferrous surface, or otherwise, as by suction, in the event that the surface to be treated is non-ferrous in nature. As shown at block 212, the apparatus is moved over a surface, to effect treatment thereof, through manual orientation of the apparatus through application of a maneuvering force by a user from a location spaced from the carriage, that allows controlled movement of the apparatus over the surface. The step of causing the apparatus to be attracted to the surface may involve initially placing the apparatus against the surface using an elongate pole. Alternatively, a pole can be connected after the apparatus is placed against the surface. As shown at block 214, any foreign matter removed from the surface 14, 14' can be accumulated and disposed of appropriately, as shown in block 216. The accumulation may be carried out, as by using a receptacle 184, as shown in FIG. 21, utilizing the collecting element 186, as shown in FIGS. 22-24, or otherwise.

The invention also contemplates that the attractive force, as effected through a magnetic element, may be varied, as shown in the flow diagram of FIG. 32. The treating apparatus is provided with a magnetic element, as shown at block 218. With an apparatus as shown in FIGS. 7-12, wheels/shafts 146, 148 may be provided with different configurations, as by using a different number of magnetic wheel elements 156, 156', and/or by using magnetic elements having different strengths. Depending upon the application, and the weight of the apparatus, an appropriate magnetic force is selected, as shown at block 220. After installation of the appropriate wheel/shaft, the apparatus is moved over a surface to be treated, as shown at block 222.

Figure 33:
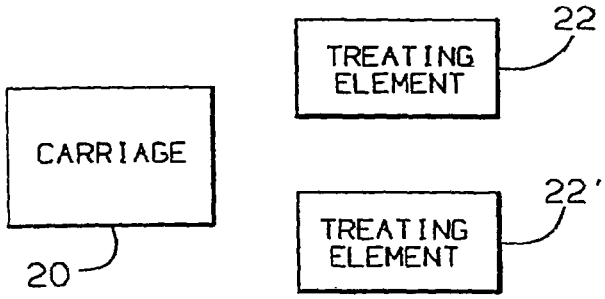
FIG. 33 is a schematic representation of a kit, according to the present invention, including a carriage with interchangeable treating elements.

As shown in FIG. 33, kits can be provided, including treating elements 22, 22' having different configurations. Treating elements 22, 22' can be interchangeably mounted into an operative position on the carriage.

Figure 34:
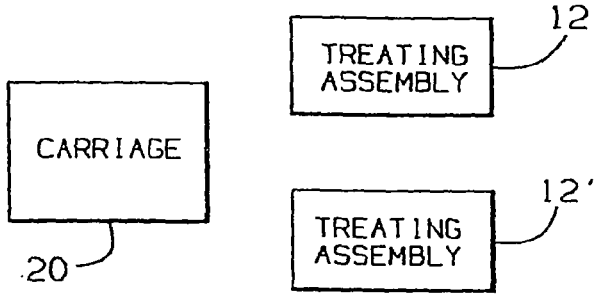
FIG. 34 is a view as in FIG. 33, wherein interchangeable treating assemblies are provided.

Alternatively, as shown in FIG. 34, a kit can be provided wherein entire treating assemblies 12, 12' are interchangeably mounted on the carriage 20, depending upon the particular job application or configuration of a surface being treated.

Figure 35:
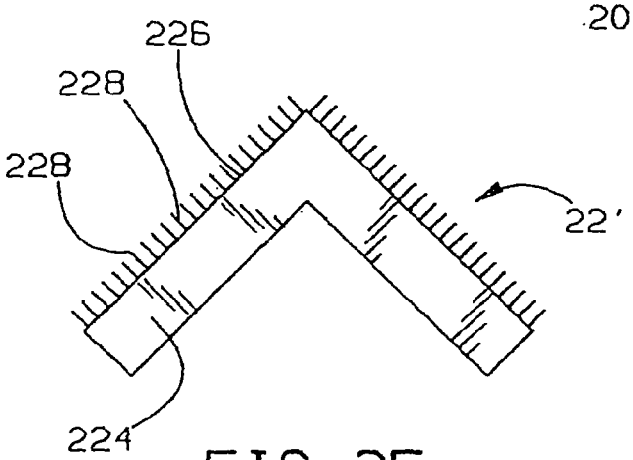
FIG. 35 is a plan view of a treating element, according to the present invention, for accessing a surface at the juncture of two transverse surfaces.

As an example, as shown in FIG. 35, a treating element 22' is shown as having a base 224 with a V-shaped surface 226 with bristles 228 thereon to facilitate cleaning a juncture of transverse surfaces, such as at an inside corner. Myriad other treating element configurations are contemplated by the invention for treating contoured surfaces or surfaces that may be difficult to access.

Figure 36:
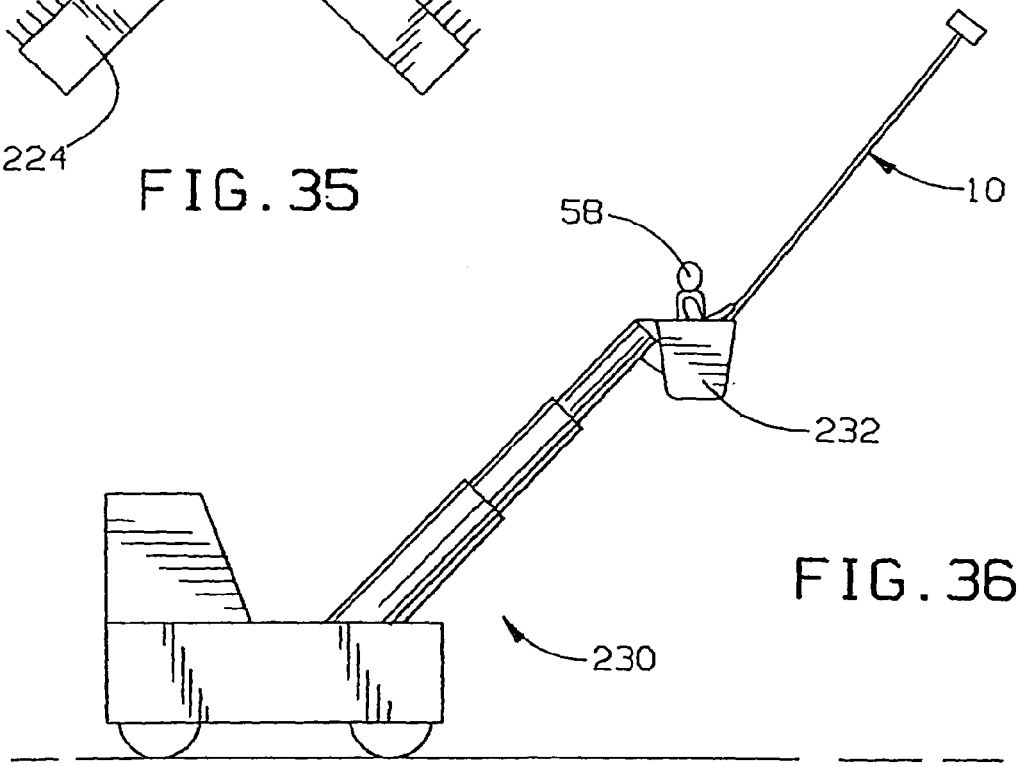
FIG. 36 is a schematic, side elevation view of a user operating the inventive apparatus from a bucket on a human lift device.

Access may also be facilitated by using a human lift device, as shown in FIG. 36 at 230. The lift device 230 has a bucket 232 within which the user 58 can be situated to operate the apparatus 10 from an elevated position.

Figure 37:
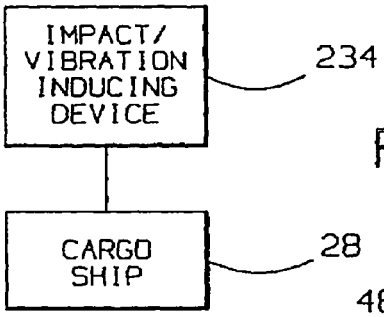
FIG. 37 is a schematic representation of an impact/vibration inducing device for acting against a part of a cargo ship preparatory to treating a surface thereon, according to the present invention.

The invention also contemplates that an additional step may be carried out preparatory to using the apparatus 10, as described above. As shown in FIG. 37, an impact/vibration inducing device 234 may be used and placed against the cargo ship 28 strategically, as at an external location on the hull, or internally of the cargo hold 34. This action provides a preliminary breaking up of the foreign material adhered to the surface 14', after which the aforementioned cleaning steps may be carried out.

Figure 38:
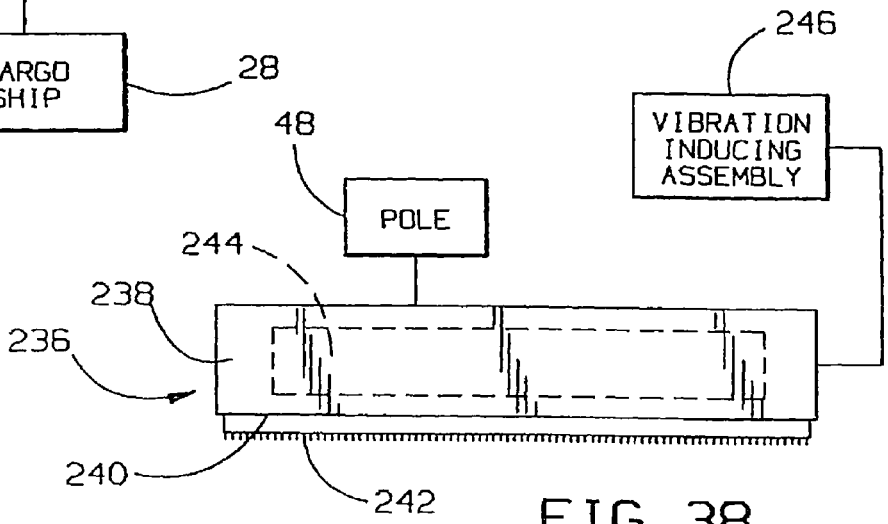
FIG. 38 is an elevation view of a pad, according to the present invention, through which a surface can be treated, and which includes a core element/carriage that is magnetically attracted to a ferrous surface, wherein a magnetic element is embedded in the core element.

As shown in FIG. 38, the invention also contemplates that, as an alternative to using a bristled treating element, a pad, as shown at 236, may be utilized. The pad 236 consists of a core element 238, that is preferably made from a non-ferrous material. At least one exposed surface 240 of the core element 238 has a surface treating layer 242 applied thereto. At least one magnetic element 244 is provided on the core element 238. In this construction, the magnetic element 244 is embedded in the core element 238. The surface treating layer 242 can be provided on any or all exposed surfaces on the core element 238.

In one form, the surface treating layer 242 is at least one of a) sandpaper; b) an absorbent pad; c) a bristled layer; d) a layer of a hook component of a hook and loop fastener system; e) a non-skid layer; f) a squeegee) and g) an absorbent pad. In operation, the surface with the surface treating layer 242 is then applied to the surface 14' to be treated. The pad 236 may be manipulated through the aforementioned pole 48.

To enhance treatment, a vibration-inducing assembly 246 may be provided to vibrate the core element 238. This produces a scrubbing action.

Figure 39:
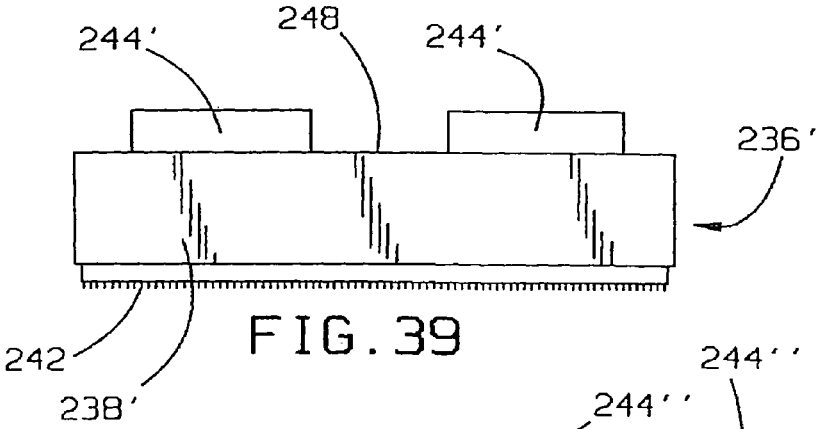
FIG. 39 is a view as in FIG. 38 wherein magnetic elements are mounted to an exposed surface of the core element/carriage.

In FIG. 39, a modified form of pad is shown at 236' with a core element 238' having magnetic elements 244' attached on an external surface 240 thereon. A surface treating layer 242 is applied to at least one surface of the core element 238'.

In all embodiments, the distance between the magnetic elements and ferrous surface can be changed/selected to controllably vary the attractive force to that surface.

Figure 40:
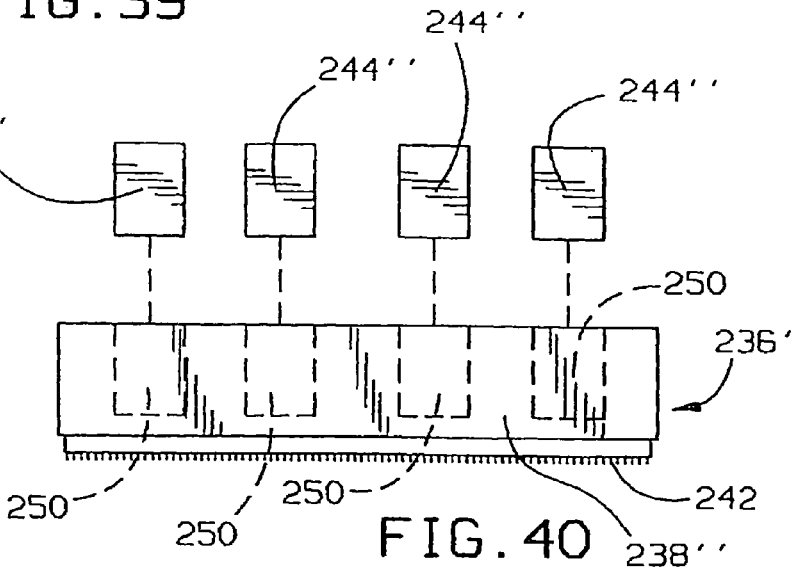
FIG. 40 is a view as in FIGS. 38 and 39 in combination with magnetic elements that can be selectively placed in receptacles to select a desired magnetic attractive force.

In FIG. 40, a further modified form of pad is shown at 236" with a core element 238" having a series of receptacles 250 into which magnetic elements 244" can be placed. The magnetic elements 244" can be placed in one or all of the receptacles 250 to select the desired attractive force between the pad 236" and the surface 14'. A surface treating layer 242 is provided on the core element 238".

It should be understood that the use of a pad can be practical to treat a non-ferrous material. Attraction can be generated between the pad and surface 14, as by the use of suction.

Figure 41:
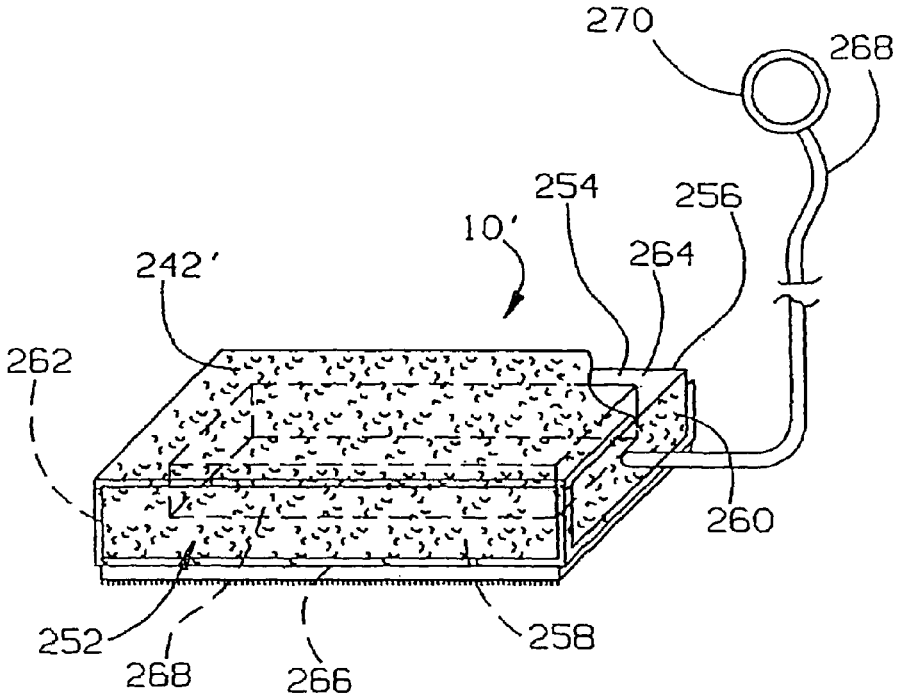
FIG. 41 is a modified form of treating apparatus, according to the present invention, in the form of a pad with an associated magnetic element for attracting the pad to a ferrous material and including a flexible cord for maneuvering the pad.

In FIG. 41, a further modified form of treating apparatus, according to the present invention, is shown at 10'. The apparatus 10' consists of a pad 252 with a core element 254, made preferably from a non-ferrous material, and having a series of flat sides. In this embodiment, the core element 254 has a squared block shape with six, flat, exposed surfaces 256, 258, 260, 262, 264, 266. On each of the exposed surfaces 256-266, a surface treating layer 242' is applied, corresponding to the surface treating layer 242.

A magnetic element 268 is embedded in the core element 254 and has a strength, configuration, and location within the core element 254, so as to support the weight of the core element 254 against a ferrous surface.

With the pad 252, the user can place any of the surfaces 256-266 against a ferrous surface, to be attracted thereto. Through a flexible cord 268, the user can draw the pad 252 over the surface to effect treatment thereof. A fitting, such as a ring 270 can be provided to facilitate maneuvering of the pad 252, by drawing the same through the flexible cord 268.

For purposes of consistency in the claims, the core elements 238,238', 238", 254 will be considered a "carriage". The "carriage" is maneuvered by the user in all embodiments to effect treating of a surface 14, 14'.

Figure 42:
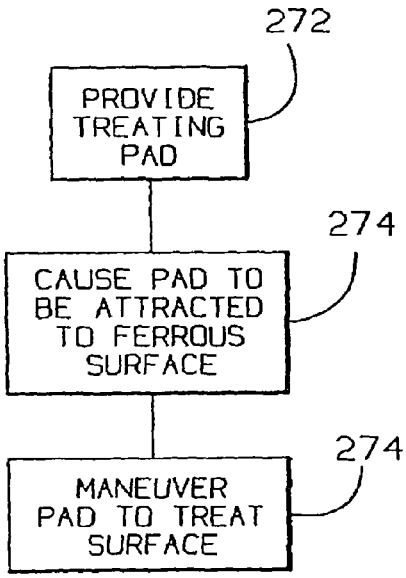
FIG. 42 is a flow diagram representation of another method of treating a surface, according to the invention, using the pad in FIG. 41.

Using the pad 252, a treating process can be carried out, as shown in flow diagram form in FIG. 42. As shown at block 272, a pad is provided. As shown at block 274, the pad is caused to be attracted to a ferrous surface by either placing the pad against such a surface or by propelling the same towards the surface, wherein it becomes magnetically attracted thereto. As shown at block 274, the pad is then maneuvered to treat the surface.

With this embodiment, the pad 252 can be made to be sufficiently light in weight that it can be propelled/thrust at a surface, such as a high ceiling or difficult to reach location. The user can then simply maneuver the pad 252 through the flexible core 268 to effect the desired treatment of the surface 14'.

Figure 7:
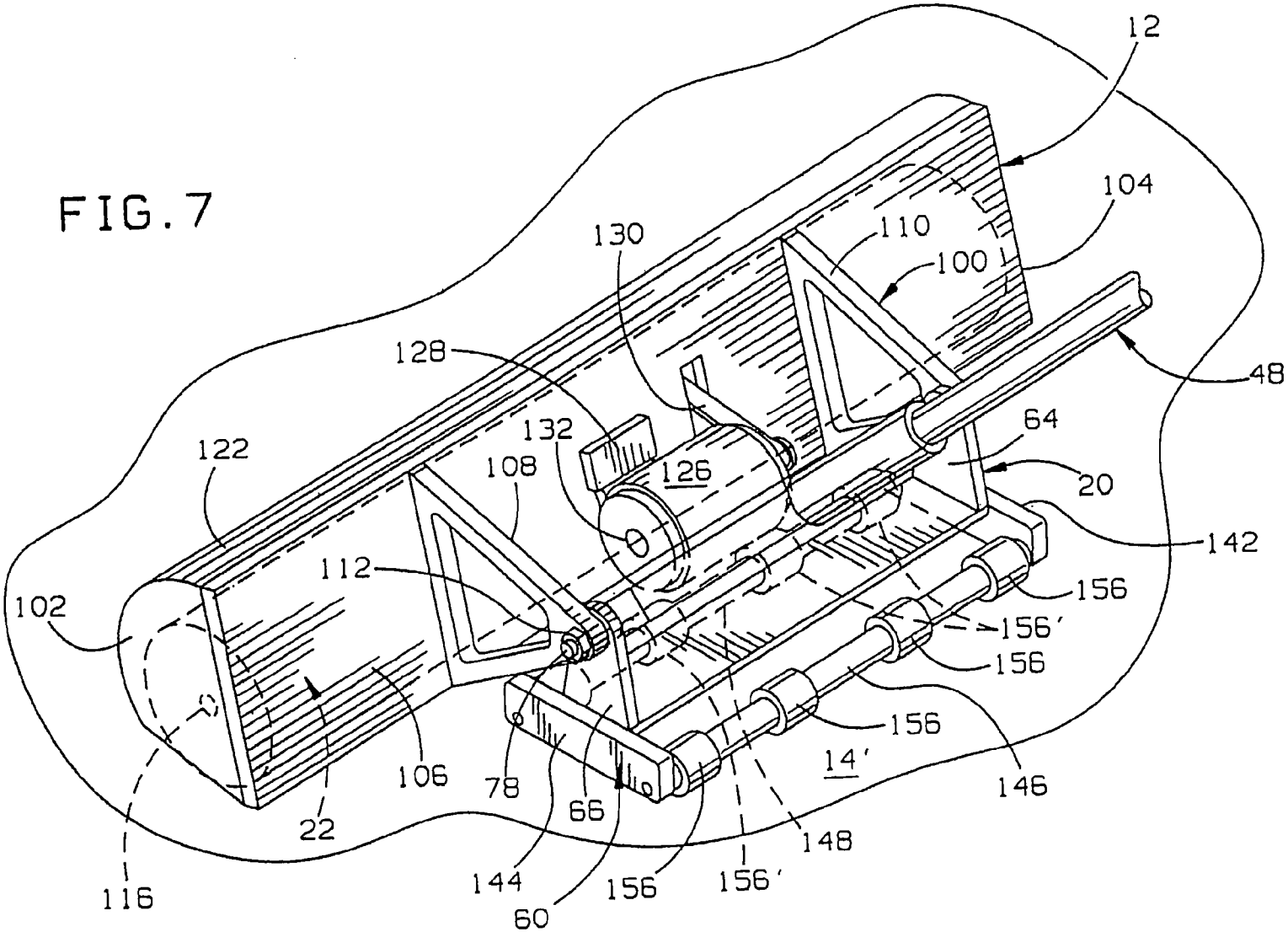
FIG. 7 is an enlarged, fragmentary, perspective view of the inventive apparatus shown in FIG. 6.
Figure 8:
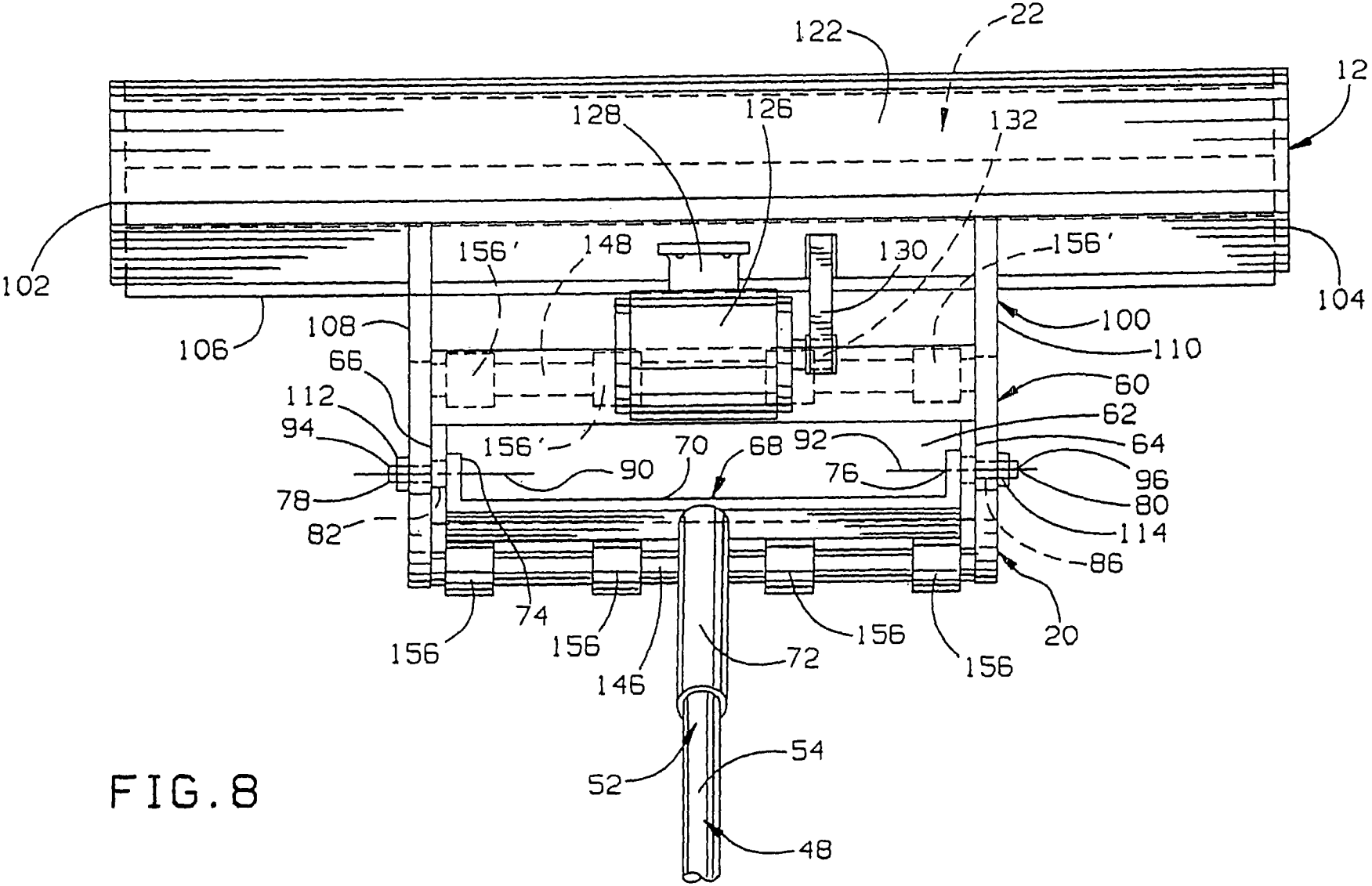
FIG. 8 is an enlarged, front elevation view of the inventive apparatus in FIG. 7.
Figure 9:
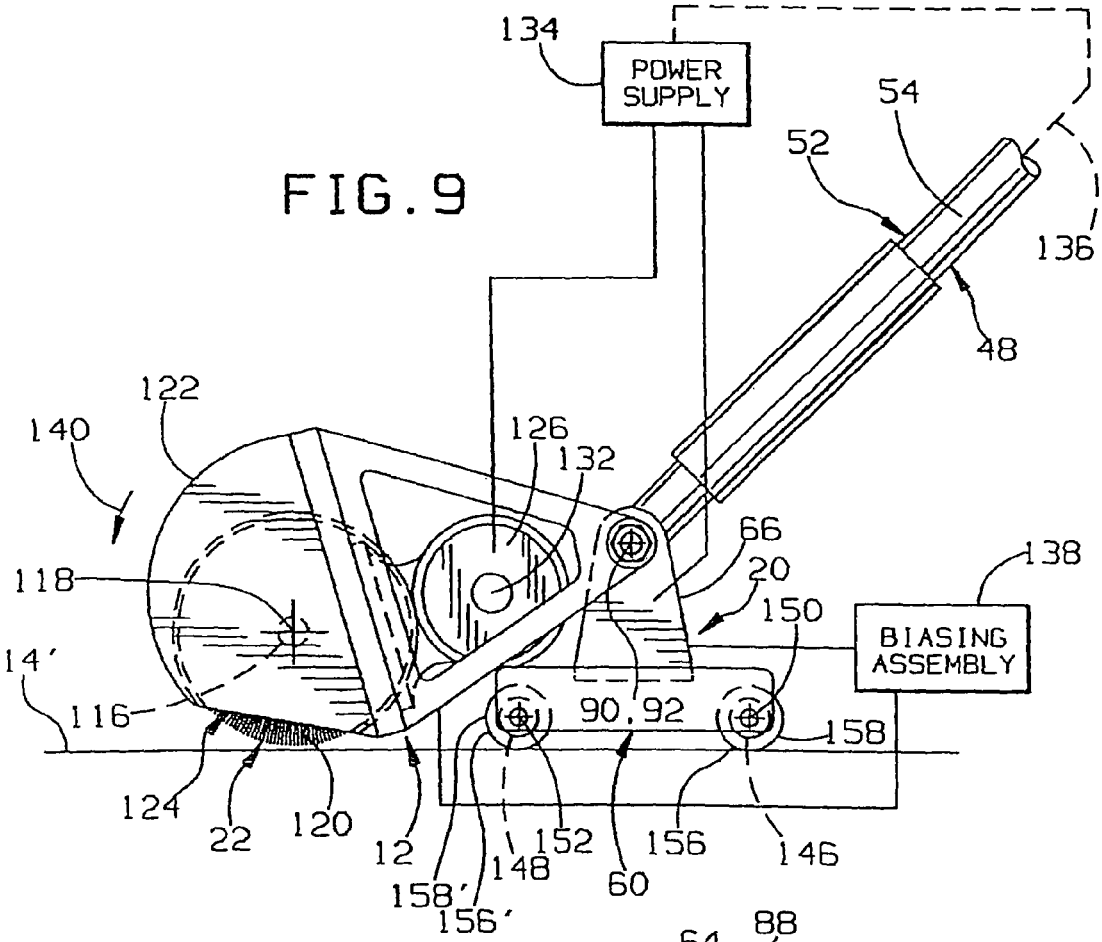
FIG. 9 is an enlarged, side elevation view of the inventive apparatus in FIGS. 7 and 8 in relationship to a surface being treated.
Figure 10:
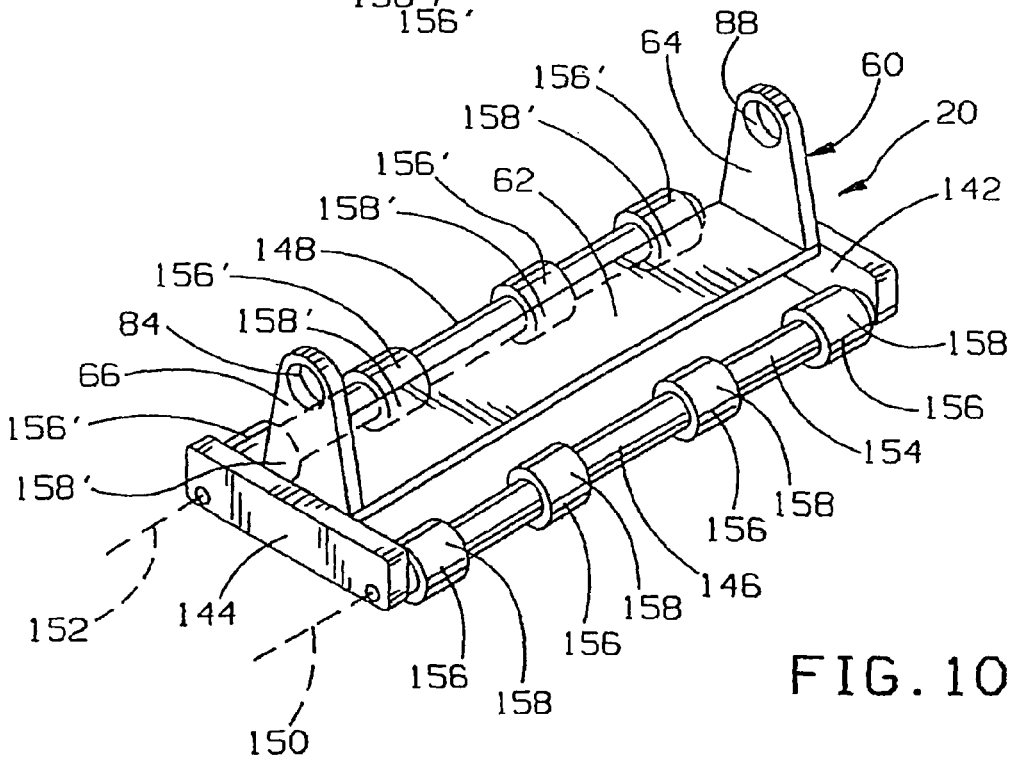
FIG. 10 is an enlarged, perspective view of the carriage on the inventive apparatus in FIGS. 7-9.
Figure 11:
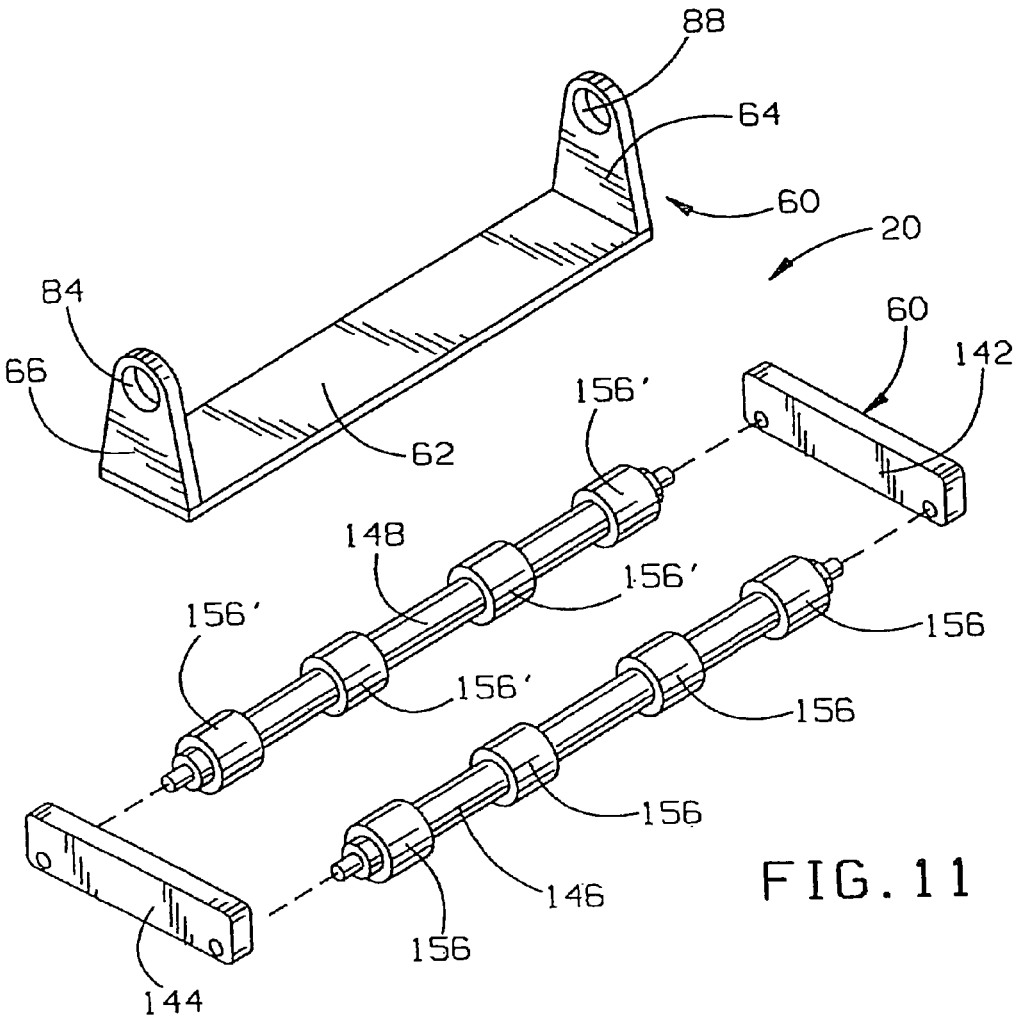
FIG. 11 is an enlarged, exploded, perspective view of the carriage in FIG. 10.
Figure 12:
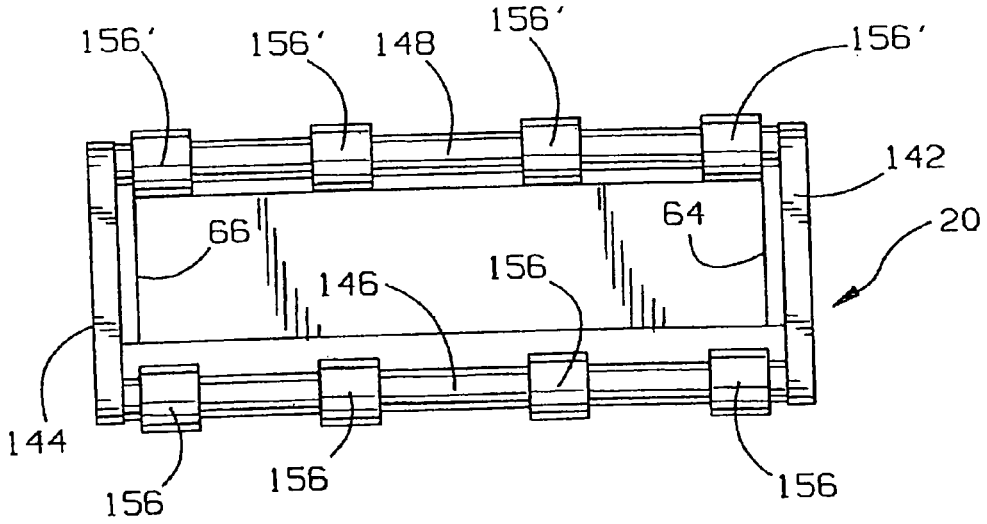
FIG. 12 is a front elevation view of the carriage in FIGS. 10 and 11.
Figure 43:
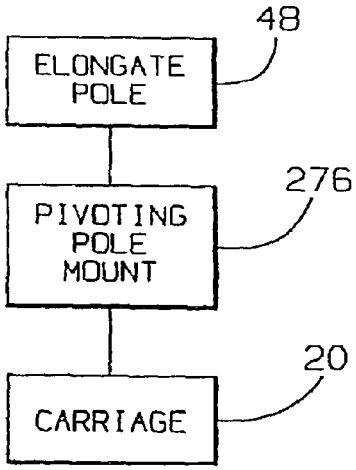
FIG. 43 is a schematic representation of a modified form of apparatus, according to the present invention, including a pivot connection between an elongate operating pole and carriage.

A still further variation, according to the present invention, is shown in FIG. 43. In FIG. 43, an elongate pole 48 is shown attached to the carriage 20 through a pivoting pole mount 276, that allows at least two degrees of movement of the pole 48 relative to the carriage 20. As seen in FIG. 7, the pole 48 is mounted to the carriage 20 for movement relative thereto about a single pivot axis. By adding another dimension of movement, the treating assembly 12 on the carriage 20 is allowed to conform more readily to surfaces when applied from potentially awkward angles. In one preferred form, the pivoting pole mount permits universal pivoting of the mounting end 52 of the pole 48 relative to the carriage 20.

Figure 44:
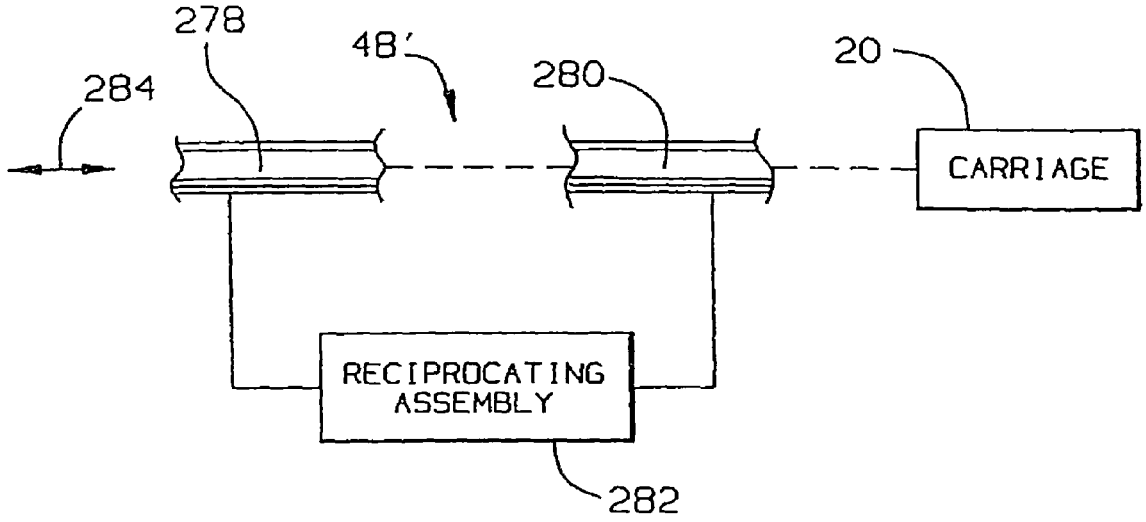
FIG. 44 is a fragmentary, schematic representation of a further modified form of elongate pole, according to the invention, which is connected to a carriage with a reciprocating assembly associated therewith to impart a reciprocating action to the carriage.

In FIG. 44, a modified form of elongate pole 48' is shown and includes separate sections 278, 280, which are movable, each relative to the other. Through a reciprocating assembly 282, the section 278 is moved reciprocatingly in the line of the double-headed arrow 284 relative to the section 280. This produces a repeating force against the carriage 20 to which the section 280 is connected. Alternatively, the reciprocating assembly 282 may act between the elongate pole 48 and a mount upon the carriage 20. The structures in FIGS. 43 and 44 may be used on any of the embodiments described above.

Figure 45:
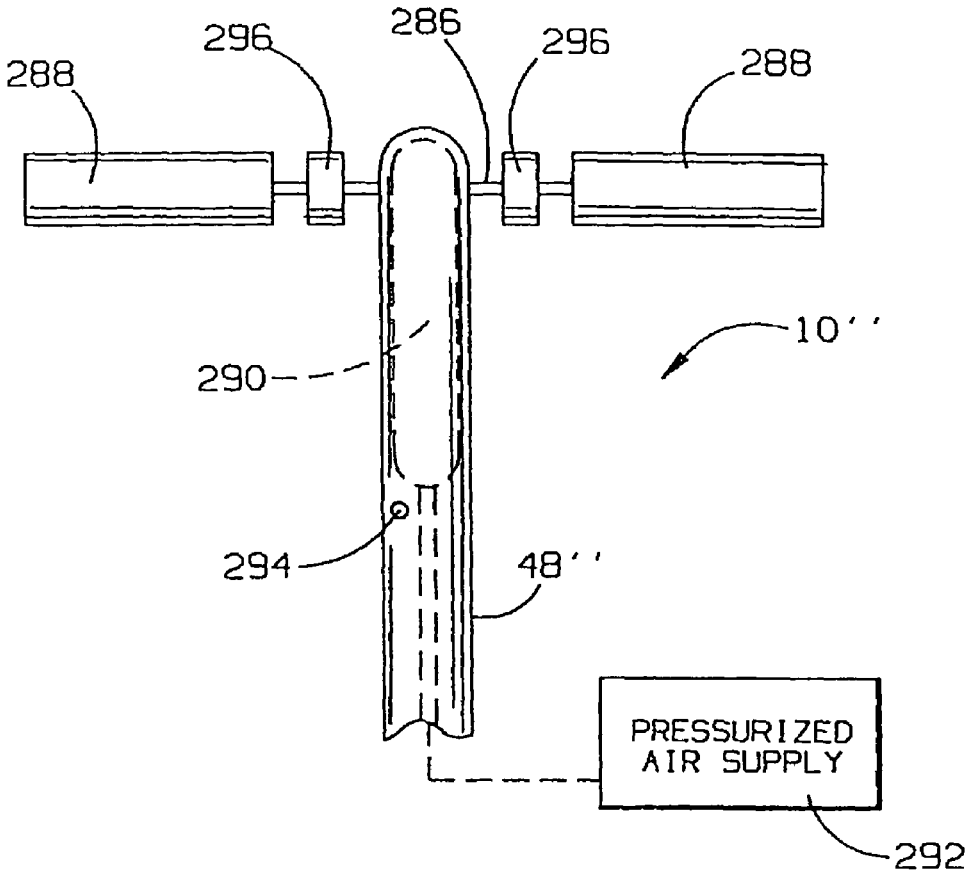
FIG. 45 is a fragmentary, elevation view of a further modified form of treating apparatus, according to the present invention, including rotary treating elements that are operated pneumatically.

In FIG. 45, a modified form of treating apparatus is shown at 10". The apparatus 10" has an elongate pole 48" with a shaft 286 extending substantially orthogonally to the length of the pole 48". Separate treating elements 288, of like construction, are attached to the shaft 286, where it projects oppositely from the connection to the pole 48". The treating elements 288 may have bristles, abrasive material, etc. The shaft 286 is rotated by an air motor 290, which is driven through air from a pressurized supply 292. An air outlet 294 is provided in the pole 48".

Magnetic wheels 296 are provided on opposite sides of the pole 48". The wheels 296 are preferably made from a magnetic material or incorporate magnets to produce an attractive force with respect to a ferrous surface.

As noted previously, many of the mechanisms and components are shown schematically in the attached figures. That is because, using the inventive concept, the form of the apparatus and components may vary significantly to achieve an optimal design. The depicted structures that are shown in detail are intended only to be exemplary in nature.

During the transition from bulk cement powder to another bulk cargo, the process of cleaning usually takes place in two stages: dry cleaning and wet cleaning. Lifts, or ladders, are commonly used during the dry cleaning. The tools and methods of this invention have the potential to significantly improve the speed, efficacy and safety of both processes, and may often entirely eliminate the need for the dry cleaning phase, typically conducted at anchor after initial discharge of cargo. Instead, dry cleaning may be carried out after the cargo is unloaded and while the ship is en route to the next port.

Potentially, the invention can be practiced in such a manner that a liquid can be used to simultaneously break loose foreign matter and effect rinsing of the exposed surfaces, thereby eliminating the separate dry cleaning process. Also, the surfaces may be cleaned to a higher standard than currently possible during wet cleaning. This could translate into increased revenues for cargoes requiring higher standards for cleanliness.

The inventive structure and method potentially extend the ability of relatively unskilled workers to further prepare the holds for subsequent cargo by giving them the tools they need to remove not only residual cargo, but also loose paint, rust, scale, and other potential contaminants from areas, previously inaccessible, except by using manlifts or ladders, which cannot be used with the ship under way. Further, they potentially provide crews with an alternative method of stain removal, which has previously been accomplished with the use of acids and other dangerous and polluting chemicals, and a much improved method of protective chemical application.

Figure 46:
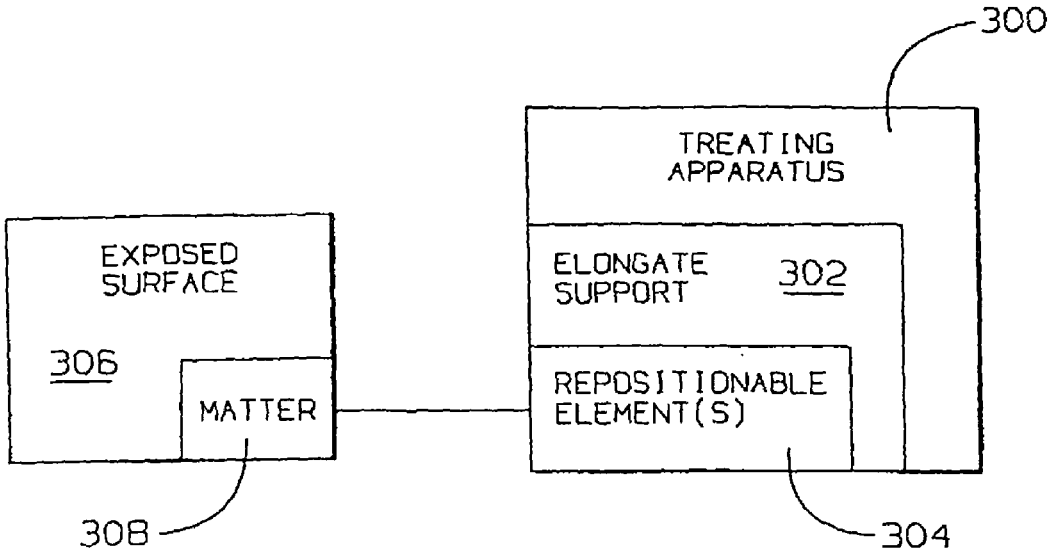
FIG. 46 is a schematic representation of one form of treating apparatus, according to the present invention, and consisting of an elongate support having at least one repositionable element thereon which interacts with matter on an exposed surface to separate and potentially control movement thereof after separation.

In FIG. 46, another form of treating apparatus, according to the present invention, is shown at 300. The treating apparatus 300 has an elongate support 302 with a proximal region, that is engageable by a user, and a distal region. At least one repositionable element 304 is provided at the distal region of the elongate support 302. More preferably, a plurality of said elements 304 are provided. The repositionable element 304 is designed to at least one of: a) repeatedly contact an exposed surface 306 at which the repositionable element 304 is situated; and b) discharge pressurized fluid from a source at least one of i) against the exposed surface 306 and ii) in a manner to control movement of matter 308 separated at the exposed surface 306 at which the repositionable element 304 is situated, as an incident of pressurized fluid from a supply being directed through the repositionable element 304.

The repositionable element 304 may take virtually a limitless number of different forms and may be moved likewise through virtually a limitless number of different mechanisms. As one example, the repositionable element 304 may be in the form of a tube or conduit through which a fluid can pass under pressure as an incident of which movement is imparted to the repositionable element 304, as in a random or repetitive manner. As a further alternative, the repositionable element 304 could be designed so as not to communicate pressurized fluid, whereby the desired movement can be imparted by another mechanism, such as one that randomly moves or reciprocates the repositionable element 34 to produce a whipping action. As one example, a hinge mechanism may be incorporated to facilitate controlled bending. Fluid might alternatively be directed against the repositionable element 304 externally thereof to produce the desired action.

The nature of the exposed surface 306 is likewise not critical to the present invention. The exposed surface 306 can be virtually any surface upon which matter 308 is adhered and from which the matter 308 is to be separated. The invention is particularly adapted to environments in which discrete matter, such as particulate in pourable form, is handled. For example, in a cargo ship hold, peripheral, top, and bottom walls bound a space within which such matter is stored, as described above. All of the surfaces, which may be flat or contoured as with corrugations, their transition locations, together with additional structures therein, such as shelves, ladders, stairs, hatch covers, angle iron protecting surfaces, etc. are prone to having the matter 308 adhered thereto.

Among the other environments in which exposed surfaces 306 are encountered, and from which matter must be separated, are storage containers, including those that are stationary and those that are mobile, with the latter commonly moved through a wheeled vehicle. These storage containers may be over-the-road hopper trucks rail cars, silos, dry or liquid tanks, boilers such as in power plants, etc. Another exemplary environment is in the conveyor area, wherein conveying surfaces bear such matter 308 for transportation between first and second locations. Aside from the actual conveying surfaces, spillover causes contact by matter with associated structure used to support and advance such conveying surfaces. The inventive structure and method are contemplated for use in these environments, and others.

Further, the nature of the matter 308 to be separated is not limited. The matter 308 may adhere by reason of being placed against the exposed surface 306. Alternatively, the matter 308 may be generated by reason of rust, corrosion, or chemical interaction. The matter 308 may be generated through impact or may otherwise result from damage inflicted upon the exposed surface 306.

Figure 47:
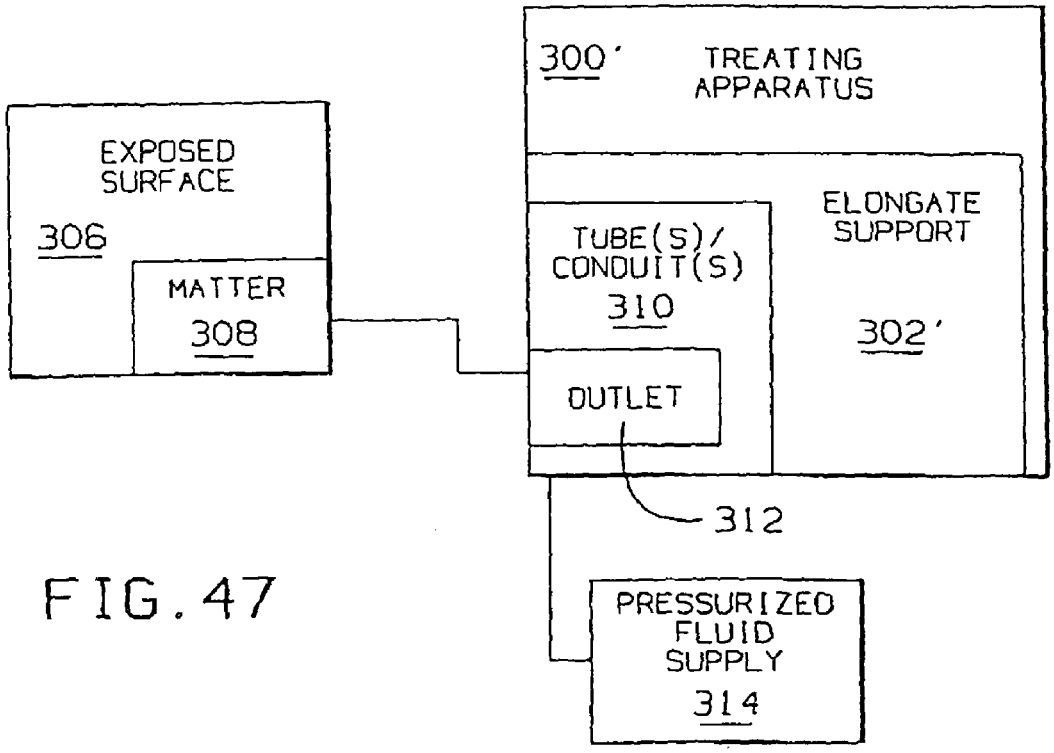
FIG. 47 is a schematic representation of another form of treating apparatus, according to the present invention, in which tubes/conduits are provided on an elongate support to route pressurized fluid to direct matter separated from an exposed surface in a controlled fashion.

In another form of the invention, as seen in FIG. 47, a treating apparatus 300' is provided having at least one associated tube/conduit 310 with an outlet 312. Preferably, a plurality of tubes/conduits 310 is employed. Fluid from a pressurized supply 314 is directed through the tube/conduit 310 and discharged at the outlet 312 to thereby control movement of the matter 308 separated from the exposed surface 306 by either the fluid from the outlet 312 or by a mechanism independent of the tube/conduit 310. This controlled movement of separated matter is commonly referred to in this industry as "blooming", which is a combination of brooming/sweeping and blowing. The tube/conduit 310 is carried on an elongate support 302' that can be strategically located at selected locations with respect to the exposed surface 306. The outlet 312 can have a fixed orientation relative to the elongate support 302' or may be capable of being reoriented relative thereto to facilitate the blooming process.

The nature of the fluid used with the apparatus 300, 300' may vary considerably. The fluid may be in liquid or gaseous form. Air might be used to break loose and controllably direct separated matter 308. Water and other fluids may be used for this purpose. Liquids or gases with a chemical component may be used to facilitate cleaning. In another form, a liquid or gas may be used as a preparing medium that is adhered to the exposed surface 306 preparatory to placing thereagainst a supply of material to be stored/conveyed. The invention also contemplates that pressurized liquid and gas may be combined. For example, aerated water under pressure may be used.

Details of specific forms of the treating apparatus 300, 300' will now be described with respect to FIGS. 48-79 In FIGS. 48 and 49, the treating apparatus 300 is shown with the elongate support 302 in the form of a pole having a length that may be in the range of several feet to fifty feet, or more. The elongate support 302 has a proximal region at 316 and a distal region at 318. The proximal region 316 is engageable by a user 320, as through an appropriate handle 322, which may be defined simply by a graspable part on the periphery of the elongate support/pole 302, or by some more intricate structure.

At the distal region 318, a surface treating assembly is provided, as shown at 324. The surface treating assembly 324 consists of a plurality of the repositionable elements 304*a*, 304*b*, 304*c*, 304*d*, 304*e*. The number of the repositionable elements can vary from as few as one to greater than the five shown.

As noted above, the repositionable elements 304*a*-304*e* may be solid and tubular. The repositionable elements 304*a*-304*e* can be rigid or flexible. For purposes of illustration herein, in the embodiments described hereinbelow, the repositionable elements, including those identified as 304*a*-304*e*, will be described as flexible, elongate tubes/conduits.

The repositionable elements 304*a*-304*e* are mounted upon a support/manifold 326 to be in fluid communication with a chamber 328 bounded thereby. The chamber 328 is in turn in fluid communication with the pressurized fluid supply 314 through a supply line 330.

In this embodiment, the supply line 330 is located on the outside of the elongate support/pole 302. A series of straps 332 surrounds the elongate support/pole 302 and supply line 330 at spaced locations along the length of the elongate support/pole 302. With this arrangement, by grasping the treating apparatus 300 at the proximal region 316, the user 320 can controllably direct the distal region 318, at which the surface treating assembly 324 is located, to a desired location with respect to the exposed surface 306.

In this embodiment, the user 320 can manipulate the surface treating assembly 324 into a desired relationship with the exposed surface 306 so that the repositionable elements 304*a*-304*e* either a) treat the exposed surface 306 from a location in spaced relationship therewith or b) so that the repositionable elements 304*a*-304*e* repeatedly contact the exposed surface 306 to effect treating thereof.

An optional carriage 334 may be used to magnetically attract the distal region 318 of the elongate support/pole 32 to the exposed surface 306, in the event that there is ferrous material at the surface 306. The carriage 334 might otherwise interact with the exposed surface 306 to be guided therealong in a predetermined manner, as through a rail structure or other mechanism. Alternatively, the movement of the carriage 334 is dictated entirely by forces applied by the user 320 from the proximal end 316 of the elongate support/pole 302.

In this embodiment, the individual repositionable elements 304 are made from a flexible material, such as rubber or plastic. Plastic or rubber tubing, typically with an inside diameter of 1/16 to 1/8 inch, and outside diameter of 1/8 to 3/4 inch may be used. The lengths of the repositionable elements 304*a*-304*e* may be the same or different. The lengths of the repositionable elements 304*a*-304*e* may be on the order of 10 inches to 30 inches in length. Longer and shorter lengths are also contemplated. In one embodiment, lengths of 14.5 inches and 27 inches are used. The lengths of the repositionable elements 304*a*-304*e*, their materials of construction, and the inside and outside diameters thereof, are dictated by the particular application and the volume and pressure available from the pressurized fluid supply 314. Commonly available pressurized fluid supplies 14 may deliver fluid, such as air, at a pressure of 90 to 170 psi.

A desired action of the repositionable elements 304 can be further affected by causing a pulsed delivery of the pressurized fluid. Means are well known by those skilled in the art to accomplish this. This potentially produces a more violent movement of the repositionable elements 304.

Figures 48, 49:
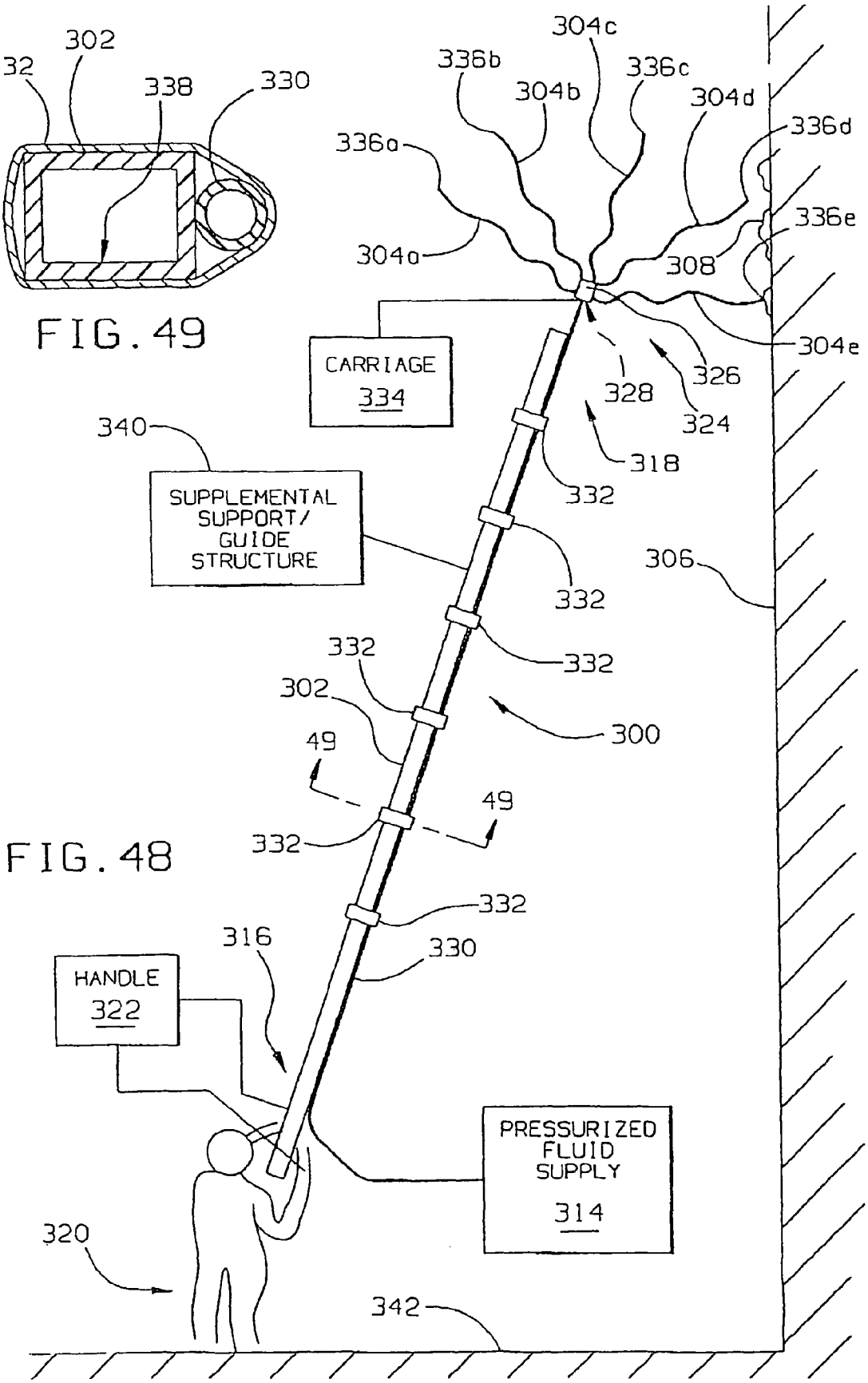
FIG. 48 is a side elevation view of one form of treating apparatus as shown in FIG. 46.
FIG. 49 is an enlarged, cross-sectional view of the elongate support on the treating apparatus taken along line 49-49 of FIG. 48.

With the arrangement as shown in FIG. 48, fluid from the pressurized supply 314 communicates through the supply line 330 and the manifold 326 to each of the repositionable elements 304*a*-304*e* from where the fluid is discharged through outlets 336*a*, 336*b*, 336*c*, 336*d*, 336*e* at the free ends thereof. As the fluid is continuously discharged through the outlets 336*a*-336*e*, the repositionable elements 304*a*-304*e* repeatedly whip in a random manner. With the surface treating assembly 324 in close enough proximity to the exposed surface 306, the repositionable elements 304*a*-304*e* repeatedly impact the exposed surface 306. This repeated impacting breaks loose the foreign matter 308 adhered to the surface 306. This may occur by either the direct impacting of the matter 308 by the repositionable elements 304*a*-304*e*, and/or by reason of the localized vibration induced at the surface 306 by the repeated contact by the impacting repositionable elements 304*a*-304*e*.

The elongate support/pole 302 can be made, for example, as described previously for the pole 48. The elongate support/pole 302 may be made as a single piece or with telescoping or otherwise extendable components so that it has a variable length. The elongate support/pole 302 may be made from metal, plastic, or a composite material. Metal, such as aluminum, is desirable for its light weight, as are certain composites, among which is a material utilizing carbon fiber or fiberglass. Fiberglass, bamboo, wood and other materials are suitable as well. As one example, the elongate support/pole 302 may be made from a semi-rigid hose material, such as PVC. The elongate support/pole 302 is thus light in weight and performs the function of communicating fluid and supporting one or more treating assemblies as hereinafter described.

In the embodiment shown, the elongate support/pole 302 has a square shape with a hollow chamber 338 extending between the ends thereof. The square shape, or another polygonal shape, is desirable since the bending of the associated elongate support/pole 302 therewith is more predictable, to facilitate placement of the surface treating assembly 324 at a desired location. However, a circular or other cross-sectional shape, such as elliptical, etc., is contemplated. As an alternative to using the supply line 330 at the exterior of the elongate support/pole 302, the supply line 330 can be directed through the chamber 338. Alternatively, the elongate support/pole can be used as a conduit, with the fluid passing through the chamber 338 between the pressurized fluid supply 314 and the manifold 326.

For extended lengths of the elongate support/pole 302, it may be desirable to use a supplemental support/guide structure, shown at 340. This supplemental support/guide structure 340 may take any form and may be operable from above the operating height of the treating apparatus 300, at a location near the floor surface 342 on which the user 320 is situated, or at another location.

While the elongate support/pole 302 is shown having a straight configuration in FIGS. 48, 49, the elongate support/pole 302 may have other configurations. For example, as noted previously, a gooseneck may be provided at the distal region 318. Virtually any shape can be incorporated into the elongate support/pole 302, as at the distal region 318, or elsewhere, to facilitate access to different surfaces.

Figure 50:
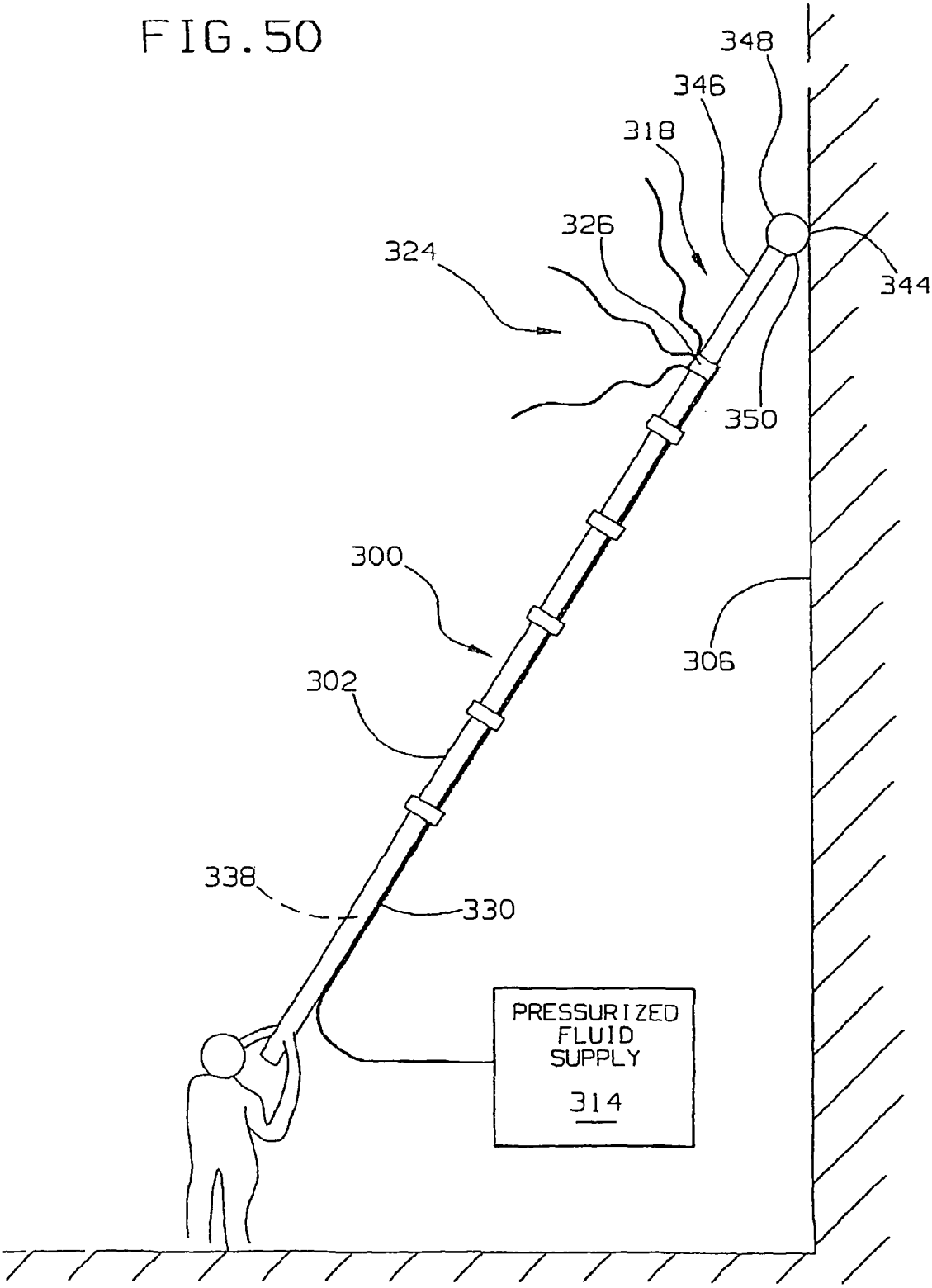
FIG. 50 is a view as in FIG. 48 wherein a knob is provided at the distal end of the elongate support to facilitate guiding thereof against an exposed surface.

To facilitate repositioning of the treating apparatus 300, a guide surface 344 may be provided on the elongate support/pole 302, as shown in FIG. 50. In FIG. 50, the elongate support/pole 302 has an extension 346 which, in this case, incorporates a rounded knob 348 with a curved surface 350 at its free end that can be borne against the exposed surface 306 to a) maintain the surface treating assembly 324 at a desired spacing relative to the exposed surface 306 and b) facilitate guided movement of the distal region 318 of the elongate support/pole 302 therealong. The knob 348 can be formed integrally with the elongate support/pole 302, as previously described, or be separately attached in the form of the extension 346 shown. Any other type of guide surface appropriate to the particular application may be used. There is no requirement that the surface 350 be curved, and in some cases a supplemental tool, such as a brush or scraper, will be attached to the end of the pole. However, this is desirable for purposes of avoiding hangup of the distal region 318 of the elongate support/pole 302 as it is moved along the surface 306 and to facilitate universal reorientation of the elongate support/pole 302 relative to the surface 306.

Figure 51:
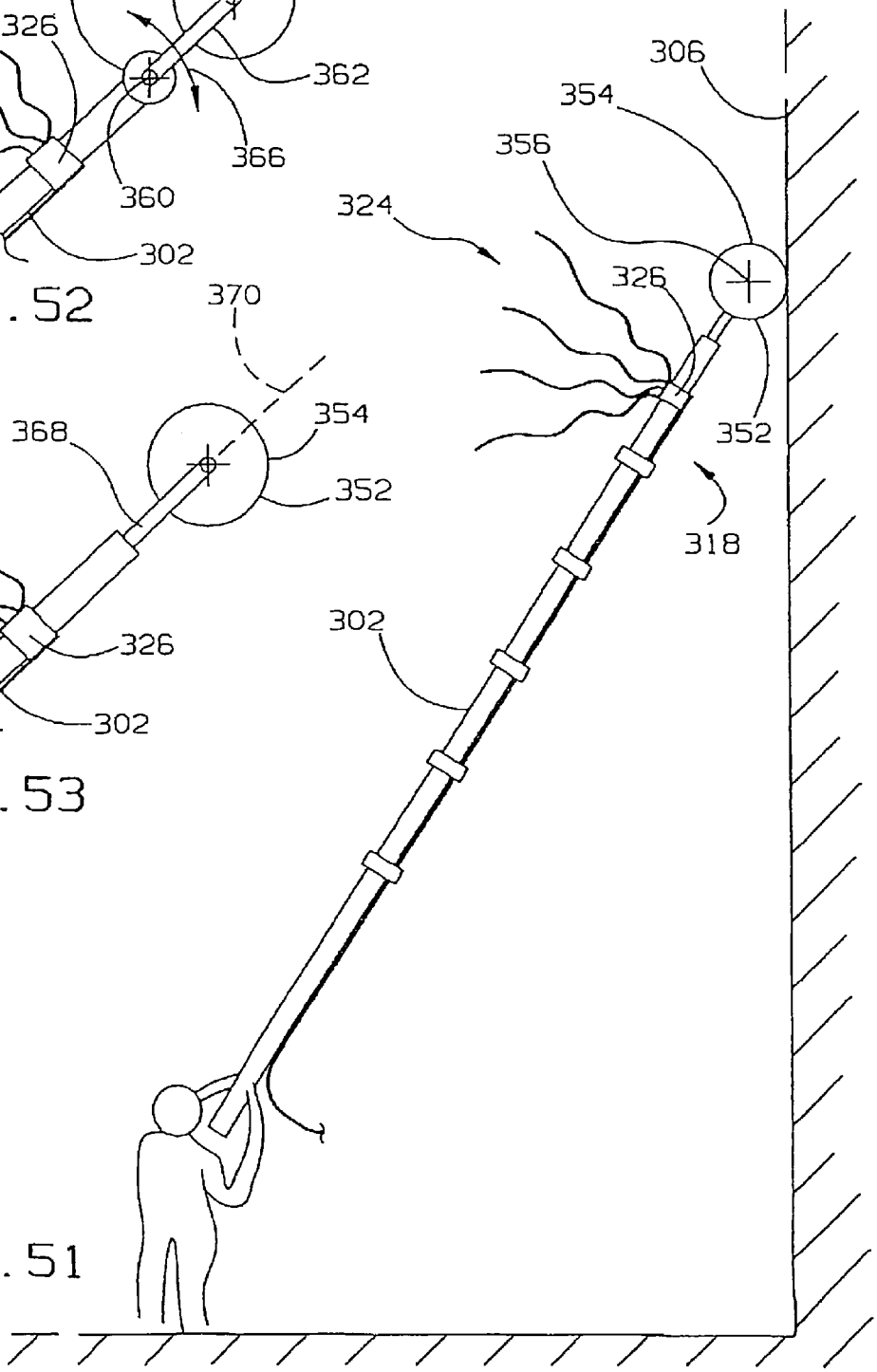
FIG. 51 is a view as in FIG. 50 wherein a wheel is used in place of a knob to guide the elongate support relative to the exposed surface.

In FIG. 51, as an alternative to the rounded knob 348, a wheel 352 is provided at the distal region 318 of the elongate support/pole 302. The wheel 352 has a peripheral guide surface 354 that can be rolled against the exposed surface 306 to guide the surface treating assembly 324 therealong to a desired location at which treating is to occur. In this embodiment, the wheel 352 is designed to rotate around a fixed axis 356 relative to the elongate support/pole 302.

Figure 52:
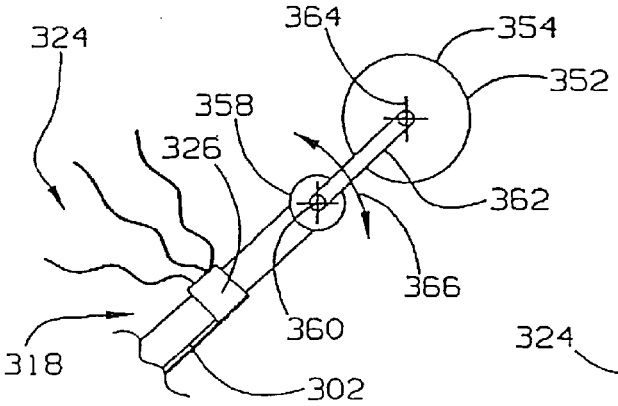
FIG. 52 is a fragmentary, elevation view, corresponding to that in FIG. 51, wherein the guide wheel is movable in a first manner relative to the elongate support.

In FIG. 52, a modification to the elongate support/pole 302 is shown wherein a base 358 is mounted to the distal region 318 of the elongate support/pole 302 for pivoting movement around an axis 360. The base 358 may be normally biased, as by a spring structure (not shown) in one pivoting direction around the axis 360 towards the surface 306 to be treated. The aforementioned wheel 352 is connected through the base 358 through at least one arm 362. The wheel 352 rotates relative to the arm 362 about an axis 364 that is parallel to the axis 360. Accordingly, the arm 362 and wheel 352 are pivotable together relative to the elongate support/pole 302 about the axis 360 back and forth in an arc, as indicated by the double-headed arrow 366. The peripheral surface 354 of the wheel 352 is movable against the exposed surface 306 in the same manner as shown in FIG. 51.

Figure 53:
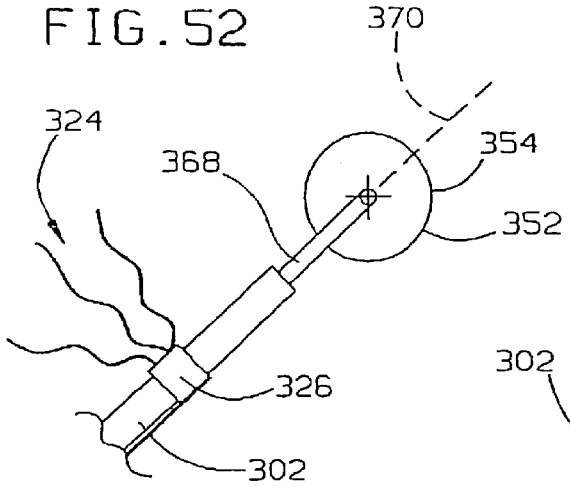
FIG. 53 is a view as in FIG. 52 wherein the guide wheel is movable in a second manner relative to the elongate support.

As a further alternative, as shown in FIG. 53, the wheel 352 can be mounted to the elongate support/pole 302 through an arm 368 that is pivotable relative to the elongate support/pole 302 about an axis 370 that extends generally parallel to the length of the arm 368 and the elongate support/pole 302. The peripheral guide surface 354 on the wheel 352 can be borne and rolled against the exposed surface 306, as described with respect to FIGS. 51 and 52. The wheels can be fitted with magnets or magnets can be suspended from the wheel assembly/axle, etc. to cause the wheels to be attracted to the surface.

The structures shown in FIGS. 52 and 53 can be combined so that there are multiple dimensions of pivoting of the wheel 352 relative to the elongate support/pole 302. As another variation of the structure shown in FIGS. 52 and 53, the surface treating assemblies 324 might be provided on a movable portion of the wheel mounting structure, rather than at a fixed location at the distal region of the elongate support/pole 302.

Figures 54, 55, 56:
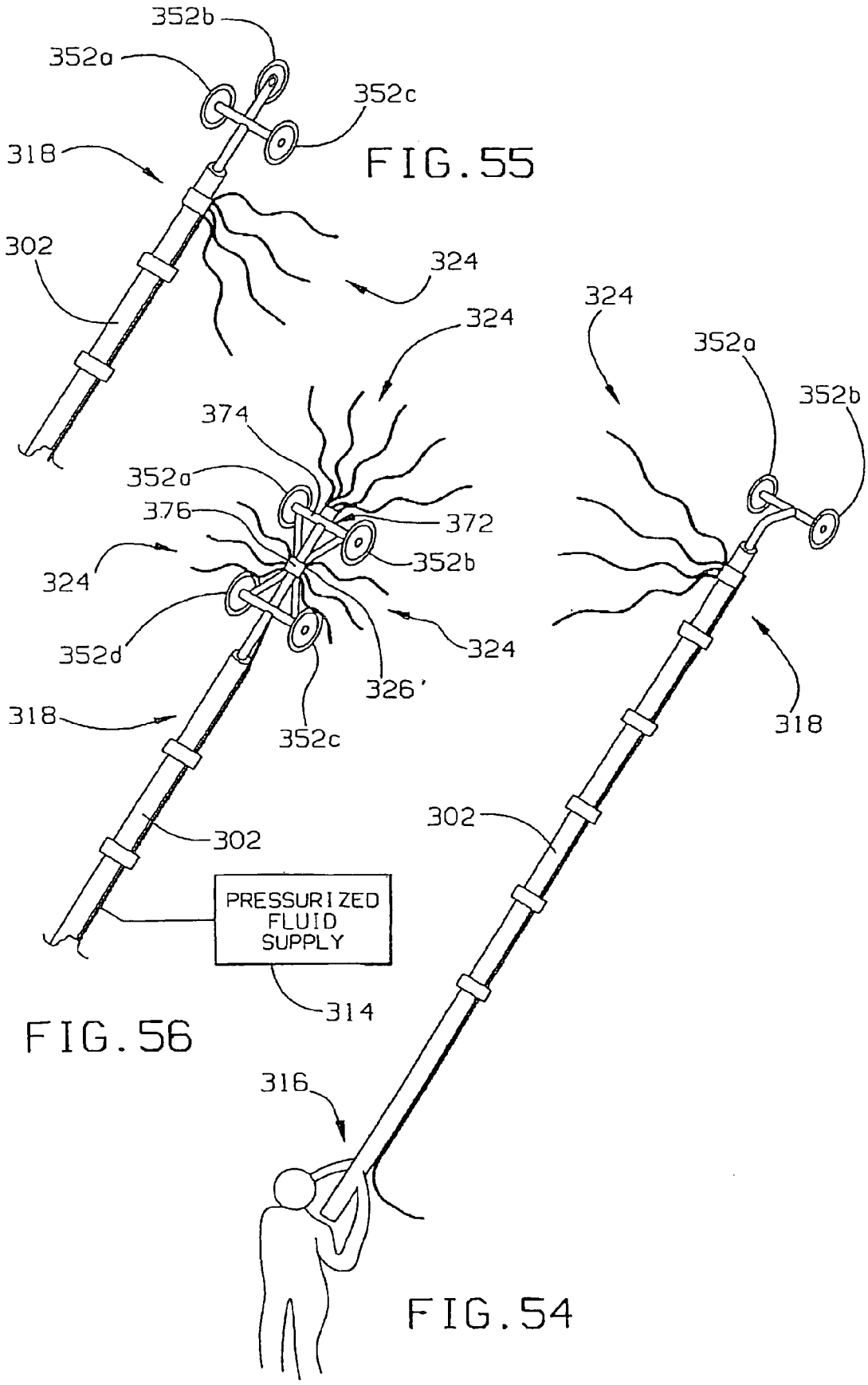
FIG. 54 is a view as in FIG. 53 wherein a pair of wheels is used in place of the single wheel in FIG. 1.
FIG. 55 is a view as in FIG. 54 wherein three guide wheels are used in place of the two wheels shown in FIG. 54.
FIG. 56 is a view as in FIG. 55 wherein a carriage with four wheels is utilized in place of the three wheels, which carriage communicates fluid from a pressurized supply thereof to surface treating assemblies on the carriage.

Multiple wheels can be used in any of the embodiments shown in FIGS. 51-53. In FIG. 54, the support/pole 302 is shown with two guide wheels 352*a*, 352*b* at its distal region 318 spaced beyond the surface treating assembly 324. The wheels 352*a*, 352*b* could be spaced closer to the proximal region of the elongate support/pole 302, to reduce the likelihood of interference with the surface treating assembly 324 in use.

In FIG. 55, three wheels are shown in the same relationship to a surface treating assembly 324 at the distal region 318 of the elongate support/pole 302.

In FIG. 56, a base 372 is shown at the distal region 318 of the elongate support/pole 302. The base 372 supports in this embodiment four guide wheels 352*a*, 352*b*, 352*c*, 352*d*. The base 372 is defined at least in part by tubing 374 through which fluid from the pressurized supply 314 is delivered to, in this embodiment, three different surface treating assemblies 324, at spaced locations along the base 372. In this embodiment, one of the surface treating assemblies 324 is at a leading end, with the other two surface treating assemblies 324 projecting oppositely from a manifold 326' at a central location 376.

With the arrangement in FIG. 56, there is a cumulative treating effect resulting from the simultaneous use of the three surface treating assemblies 324 at the spaced locations. There is no requirement that the number, spacing or locations of the surface treating assemblies 324 be precisely as shown in FIG. 56.

Figure 57:
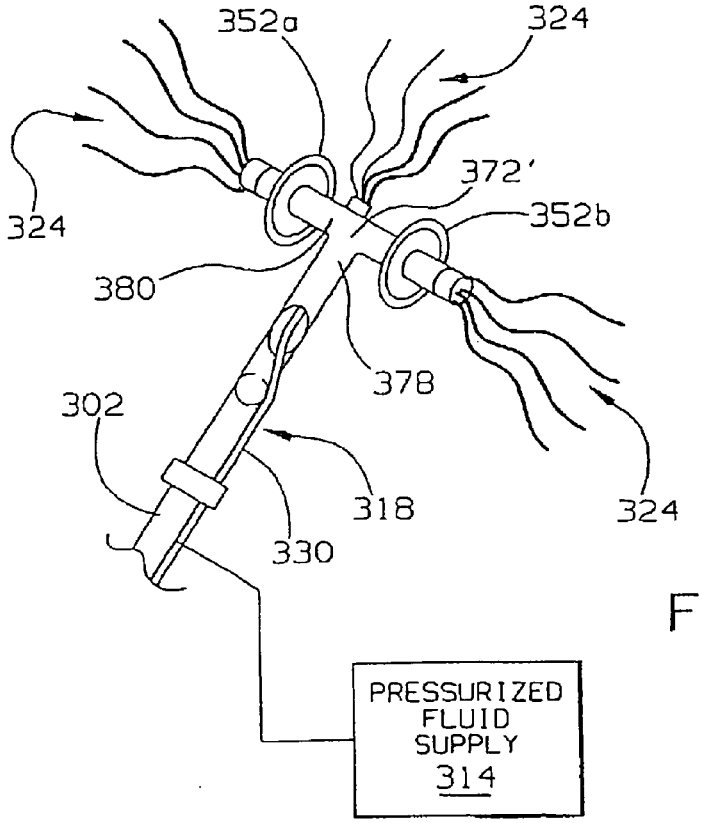
FIG. 57 is a view as in FIG. 56, wherein a base is provided at the distal region of the elongate support, which base supports guide wheels and communicates pressurized fluid to surface treating assemblies on the base.
Figure 58:
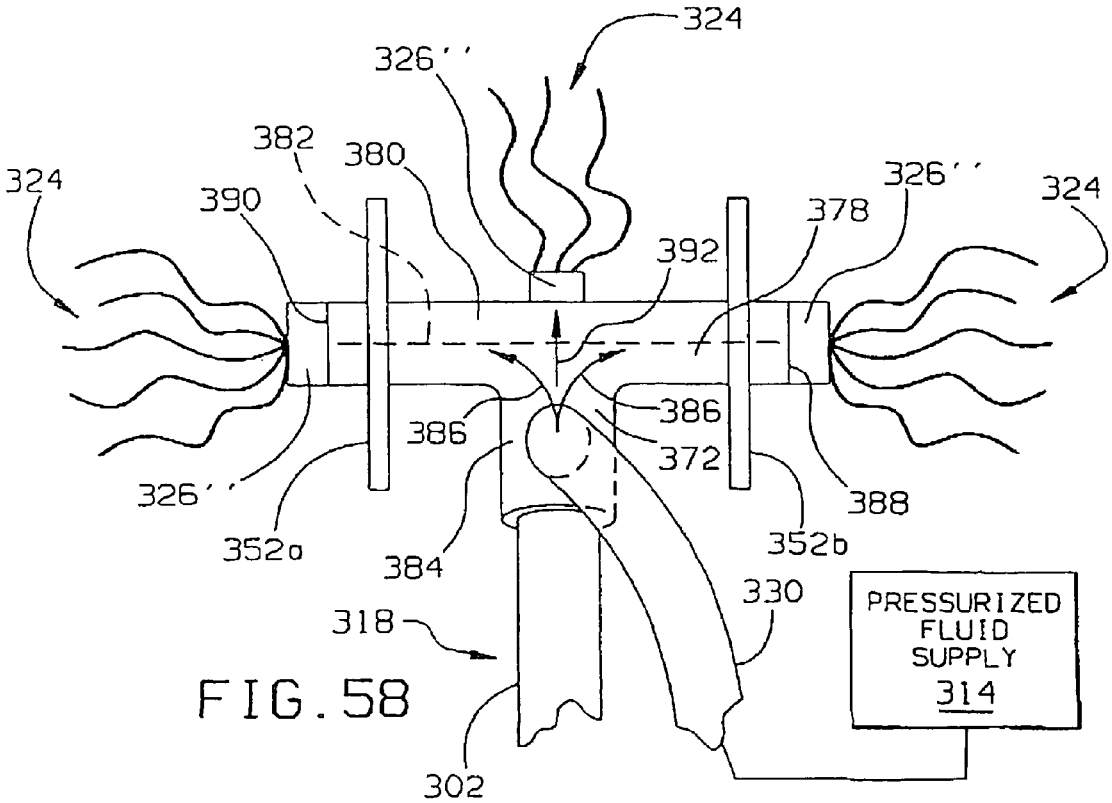
FIG. 58 is an enlarged, fragmentary, elevation view of the base and associated components in FIG. 57.

In FIGS. 57 and 58, a modified form of wheeled base is shown at 372' at the distal region 318 of the elongate support/pole 302. In this embodiment, the base 372 has a T-shaped body 378 with the cross bar 380 of the "T" defining a support/axle relative to which wheels 352*a*, 352*b* rotate around an axis 382. The base 372' is configured so that fluid from the pressurized supply 314 is introduced through the supply line 330 into the stem 384 of the "T", from where the fluid flow branches, as indicated by the arrows 386, for communication oppositely through the cross bar 380 to surface treating assemblies 324 at the ends 388, 390 of the cross bar 380. Additional fluid flows from the stem 384 in the direction of the arrow 392 to a surface treating assembly 324 approximately midway between the ends 388, 390 of the cross bar/axle 380. Accordingly, fluid from the pressurized supply 314 flows oppositely relative to the axis 382 for discharge through the surface treating assemblies 24 at the ends 388, 390 and generally orthogonally to the axis 382 through the surface treating assembly 324 midway between the ends 388, 390 of the cross bar/axle 380.

Figure 59:
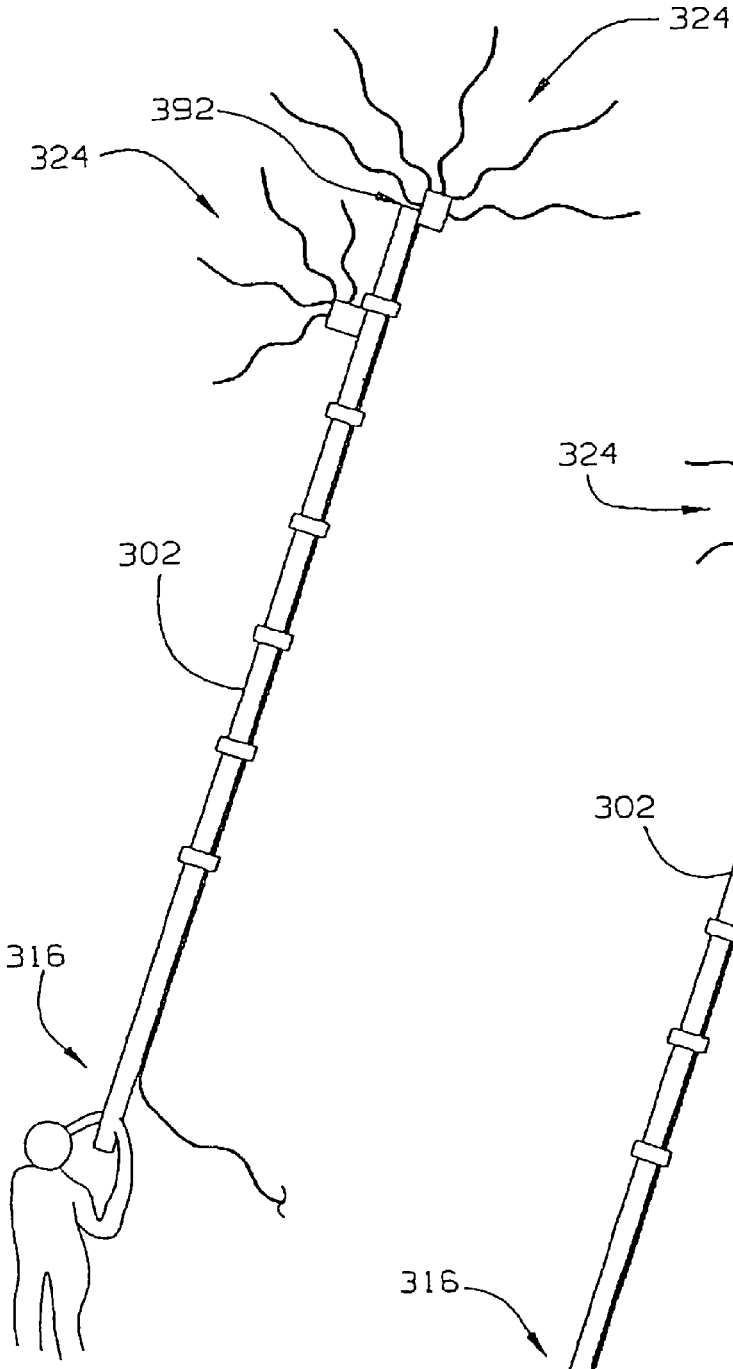
FIG. 59 is a view as in FIG. 48 wherein surface treating assemblies are provided at spaced locations on the elongate support.

The invention contemplates that surface treating assemblies 324 can be provided in other arrangements at spaced locations. As one example, as shown in FIG. 59, the elongate support/pole 302 is shown with one surface treating assembly 324 at the distal end 392 of the elongate support/pole 302, with a separate surface treating assembly 324 projecting radially from the elongate support/pole 302, spaced from the distal end of the elongate support/pole 302 toward the proximal region 316 thereof.

Figure 60:
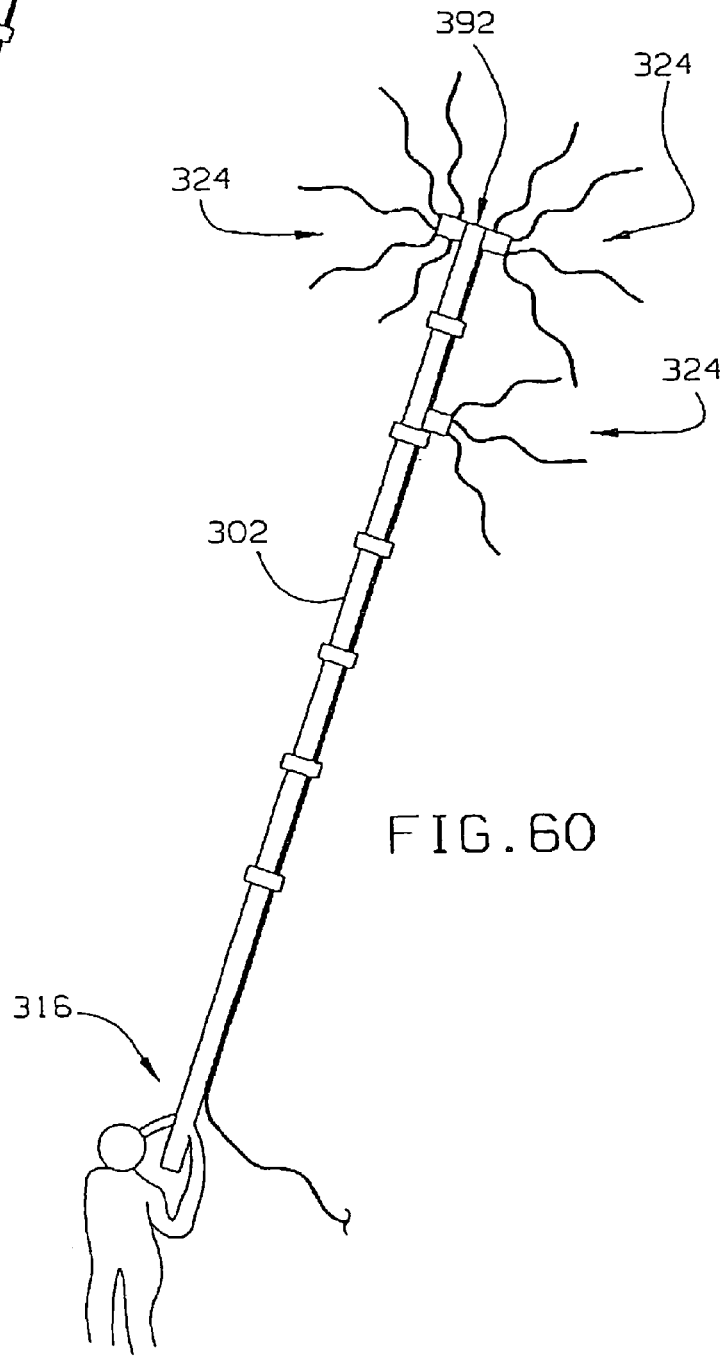
FIG. 60 is a view as in FIG. 59 wherein a different spaced arrangement of surface treating assemblies is shown.

In FIG. 60, separate surface treating assemblies 324 project radially oppositely away from the elongate support/pole 302 at the distal end 392 thereof, with a third surface treating assembly 324 projecting radially from the elongate support/pole 302 at a location spaced from the distal end 392 of the elongate support/pole 302 toward the proximal region 316 thereof.

Figures 61, 62:
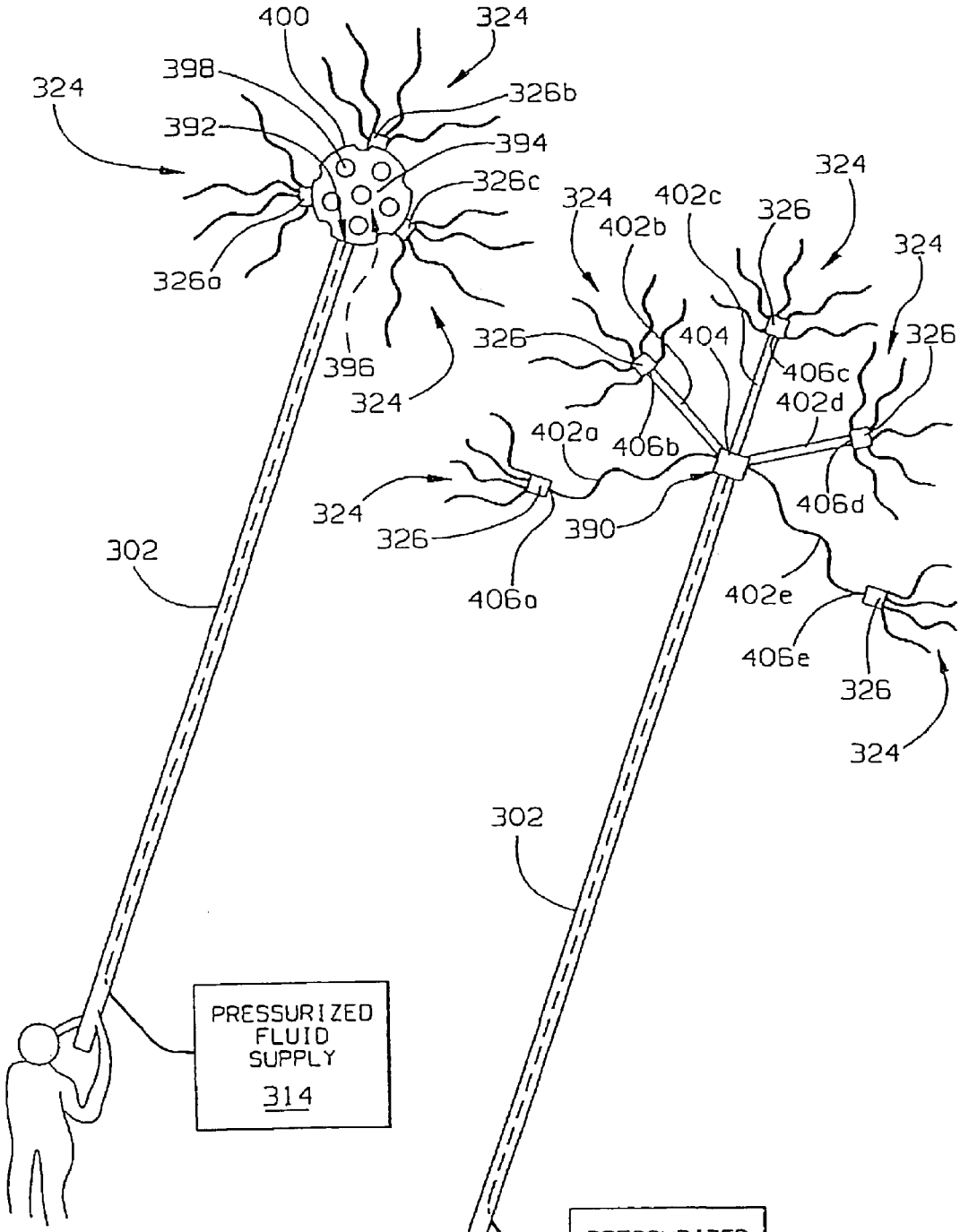
FIG. 61 is a view as in FIG. 48 wherein a manifold is provided at the distal region of the elongate support on which a plurality of surface treating assemblies is provided.
FIG. 62 is a view as in FIG. 48 wherein a plurality of shafts, each having an associated surface treating assembly, is provided at the distal region of the elongate support.

In FIG. 61, a primary manifold 394 is provided at the distal end 392 of the elongate support/pole 302 and has an internal chamber 396 bounded by a spherical wall 398. Three supports/manifolds 326*a*, 326*b*, 326*c* are in fluid communication with the internal chamber 396, which is supplied with fluid from the pressurized supply 314. In this embodiment, fluid is directed through the chamber 338 through the elongate support/pole 302. The manifolds 326*a*, 326*b*, 326*c* are mounted at the spherical wall 398 at spaced locations. In one form, the manifolds 326*a*, 326*b*, 326*c* can be repositioned strategically upon the primary manifold 394 as a particular application may dictate.

The spherical wall 398 may function to support the manifolds 326*a*, 326*b*, 326*c* as well as potentially provide a peripheral guide surface 400 that can bear against the exposed surface 306 that is being treated.

Another structure for mounting multiple surface treating assemblies 324 at spaced locations and/or at desired orientations is shown in FIG. 62. In FIG. 62, multiple, and in this case five, shafts 402*a*, 402*b*, 402*c*, 402*d*, 402*e* are mounted at the distal end 392 of the elongate support/pole 302. Each of the shafts 402*a*, 402*b*, 402*c*, 402*d*, 402*e* is in fluid communication with the manifold 404 so that fluid from the pressurized supply 314 is communicated through each of the shafts 402*a*, 402*b*, 402*c*, 402*d*, 402*e* to surface treating assemblies 324 at the free ends 406*a*, 406*b*, 406*c*, 406*d*, 406*e* at which manifolds 326 on the surface treating assemblies 340 are mounted.

The shafts 402*a*, 402*b*, 402*c*, 402*d*, 402*e* may be preset in a fixed shape i.e. straight, curved, etc. Alternatively, the shafts 402*a*, 402*b*, 402*c*, 402*d*, 402*e* are made from a material that can be formed by the end user to virtually any desired shape and maintained.

Figure 63:
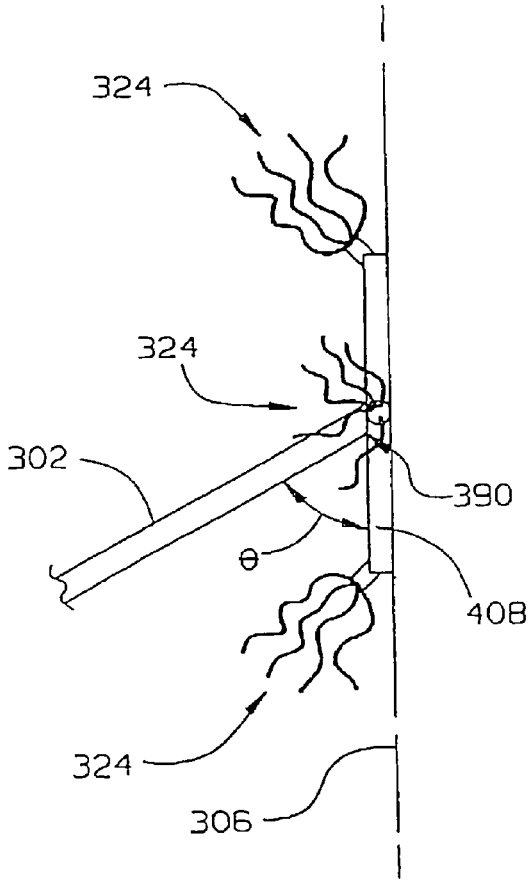
FIG. 63 is a fragmentary, elevation view of a portion of the elongate support with a movable carriage thereon and having an associated arrangement of surface treating assemblies.

In FIG. 63, a carriage 408 is shown at the distal end 390 of the elongate support/pole 302 and has a generally straight/flat configuration to conform to a flat portion of the exposed surface 306. The carriage 48 is disposed at an angle θ to the length of the elongate support/pole 302, which angle θ may be fixed or variable. Surface treating assemblies 324 are provided at spaced locations upon the carriage 408.

Figure 64:
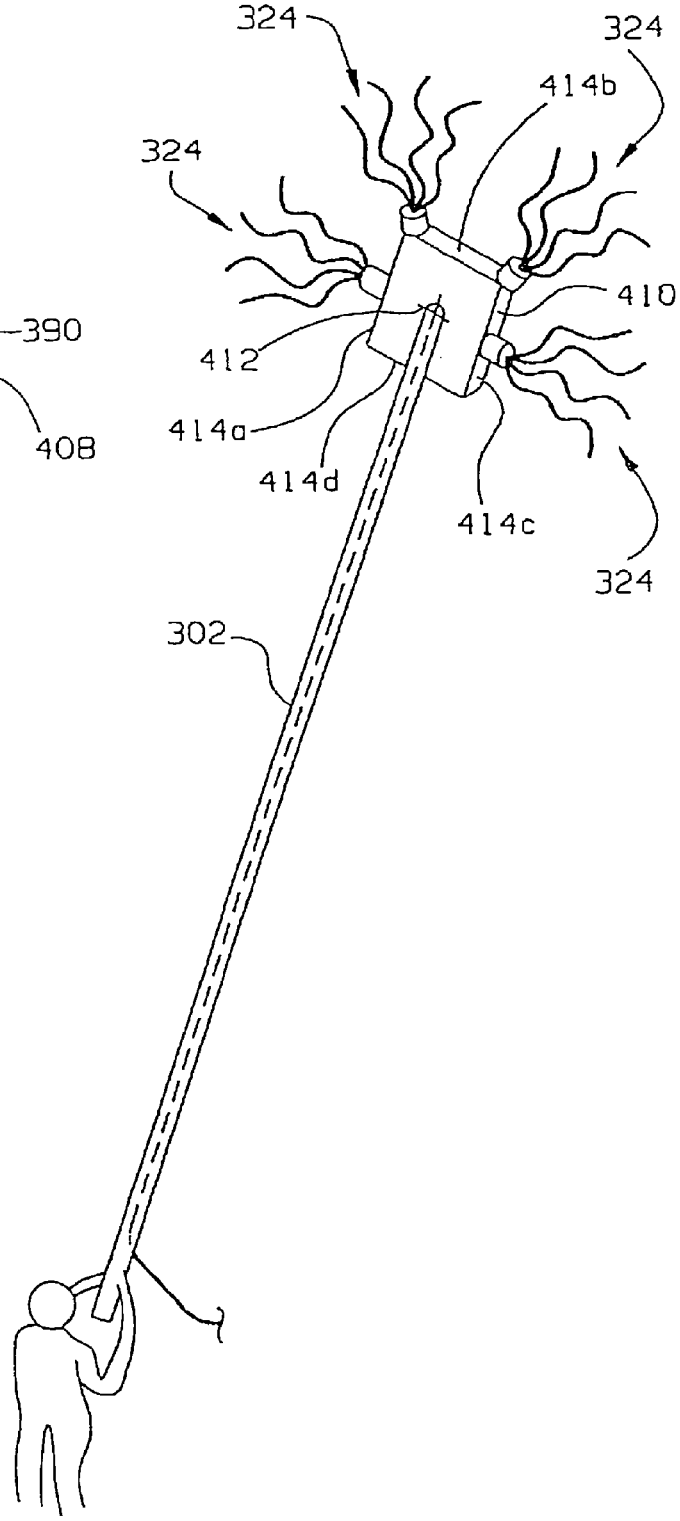
FIG. 64 is a view as in FIG. 48 wherein a carriage is provided at the distal region of the elongate support, which carriage has a polygonal external shape on which surface treating assemblies are provided and which can be reoriented relative to the elongate support.

In FIG. 64, a carriage 410 is shown that is rotatable about an axis 412 relative to the elongate support/pole 302. In this embodiment, the carriage 410 has a polygonal shape, and more specifically a squared shape, as viewed along the axis 412, with multiple sides 414, 414*a*, 414*b*, 414*c*, 414*d* at which one or more surface treating assemblies 324 are provided. The carriage 410 can be maintained in one orientation relative to the elongate support/pole 302, or may be moved, as by pivoting relative thereto around the axis 412.

Figure 65:
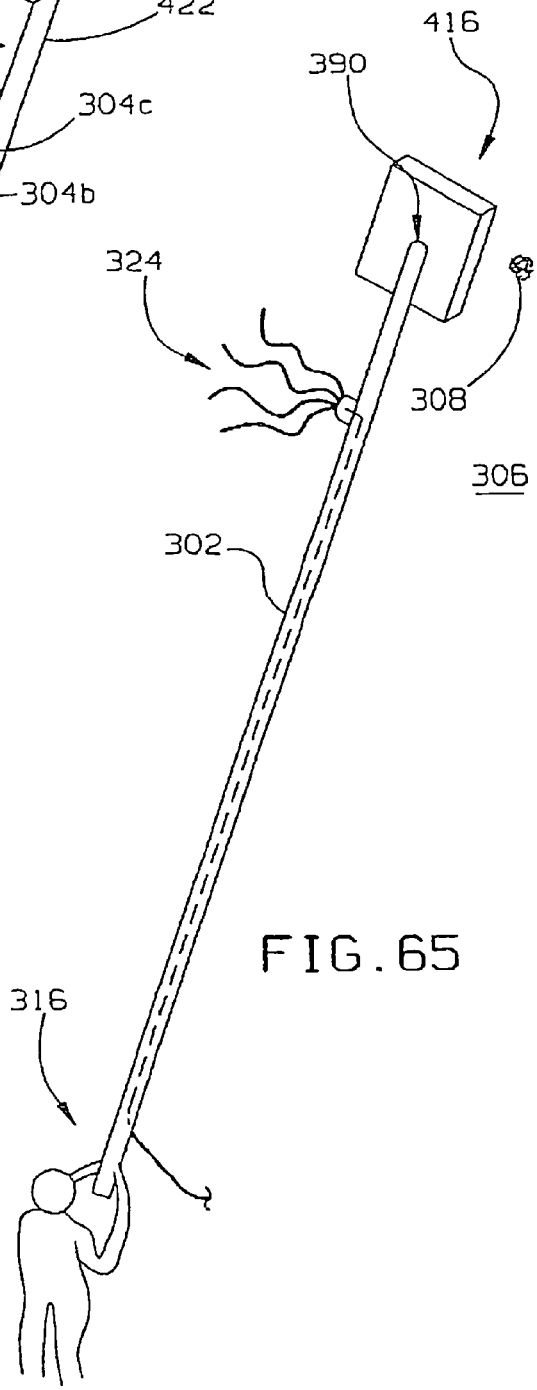
FIG. 65 is a view as in FIG. 48 wherein the elongate support has a cleaning assembly thereon in addition to a surface treating assembly.

In FIG. 65, a treating apparatus is shown including a cleaning assembly 416 at the distal end 390 of the elongate support/pole 302. The cleaning assembly 416 may take virtually a limitless number of different forms, and may be, for example, a pad, a bristled component, etc. for wiping, cleaning, scraping, etc. the exposed surface 306.

A surface treating assembly 324 is provided on the elongate support/pole 302 between the distal end 390 and the proximal region 316 of the elongate support/pole 302. The cleaning assembly 416 and surface treating assembly 324 may be designed to be complementary in terms of their functions. As one example, the cleaning assembly 416 may be used to break loose more tenaciously held matter 308 that may not be separable from the surface 306 through the surface treating assembly 324.

Figure 66:
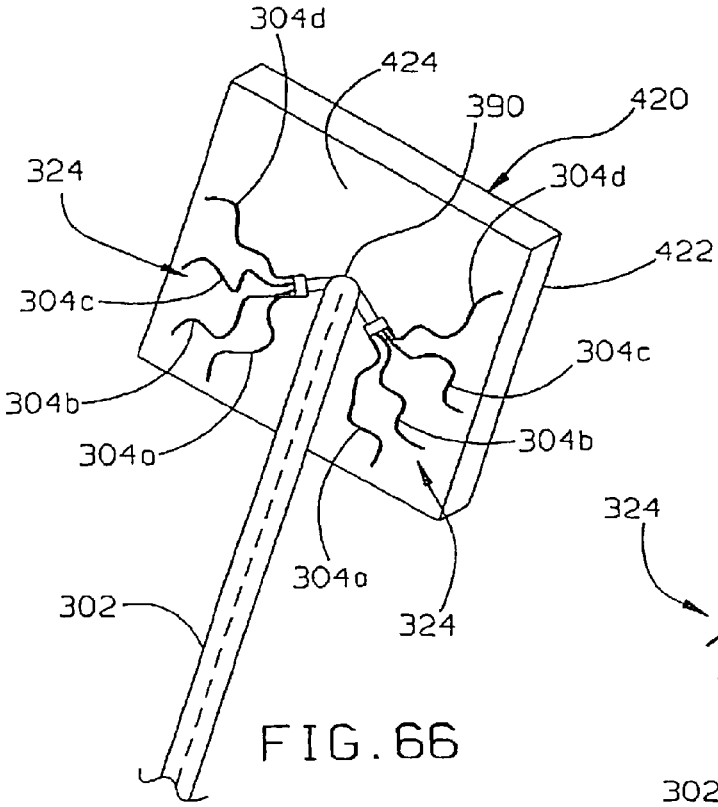
FIG. 66 is a fragmentary, perspective view of the distal region of the elongate support wherein a pad assembly is provided, which pad assembly is impacted by surface treating assemblies at one side thereof.
Figure 67:
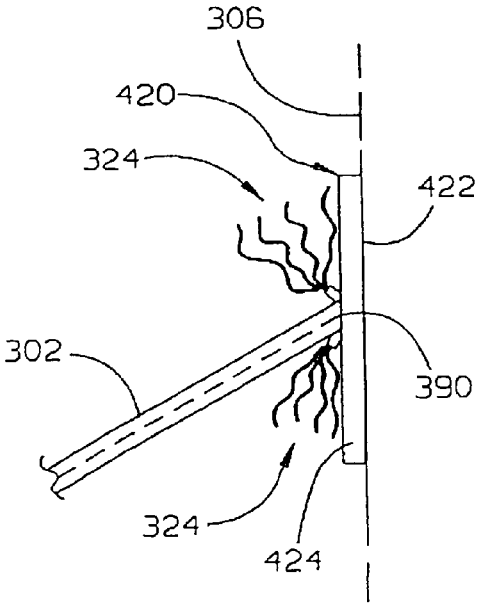
FIG. 67 is a fragmentary, elevation view of the elongate support, pad assembly, and surface treating assembly in FIG. 66.

In FIGS. 66 and 67, a surface treating apparatus is shown including a pad assembly 420 at the distal end 390 of the elongate support/pole 302. The pad assembly 420 may take any of a number of different shapes and has a surface 422 to engage the exposed surface 306. The surface 322 may be provided with bristles, hooks such as on a component of a hook and loop fastener, an abrasive, chemicals, etc. The pad assembly 420 may be made from a relatively thin polycarbonate sheet or a carbon fiber sheet.

Adjacent to the distal end 390 of the elongate support/pole 302, at least one, and in this case multiple, surface treating assemblies 324 are provided. In operation, the repositionable elements 304*a*, 304*b*, 304*c*, 304*d* on each surface treating assembly 324 are caused to repeatedly impact against the side 424 of the pad assembly 420 facing oppositely to the surface 422. With this arrangement, the impact forces are distributed through the pad assembly 420 and therethrough over a substantial area of the treated surface 306, as determined by the configuration of the surface 422.

Figure 68:
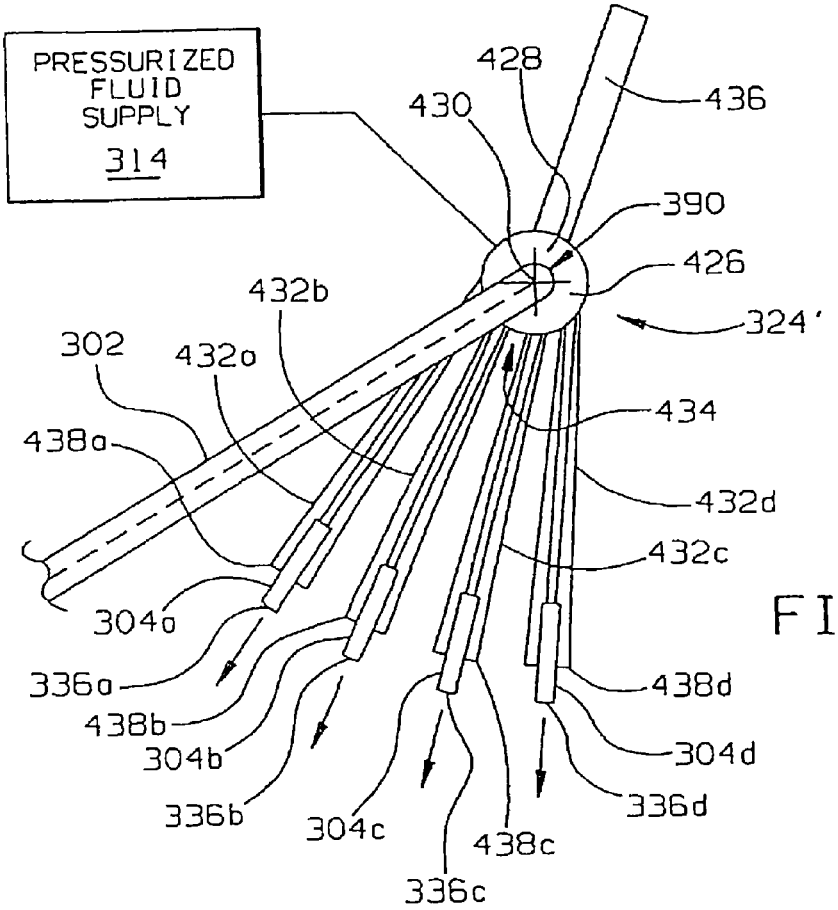
FIG. 68 is a fragmentary, elevation view of a distal region of the elongate support at which a surface treating assembly is provided including repositionable tines which repeatedly impact an exposed surface to be cleaned.
Figure 69:
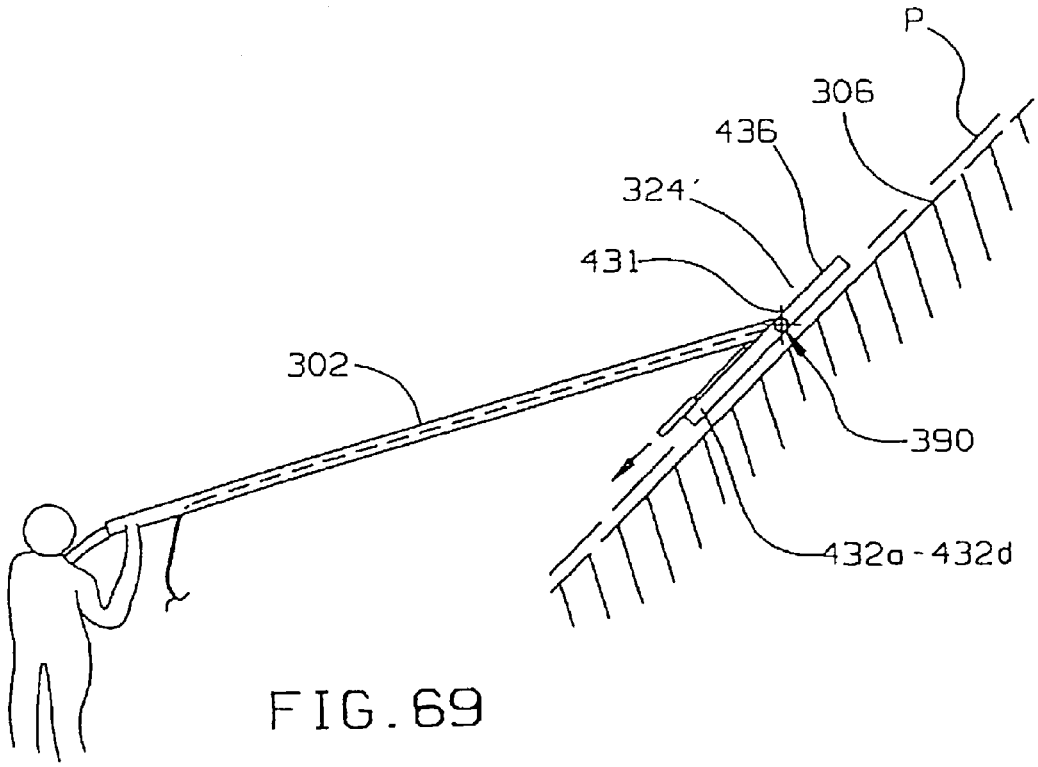
FIG. 69 is a view as in FIG. 48 in which the surface treating assembly of FIG. 68 is placed against an exposed surface being treated.

In FIGS. 68 and 69, a modified form of surface treating assembly is shown at 324' at the distal end 390 of the elongate support/pole 302. The surface treating assembly 324' consists of a manifold 426 with a housing 428 that is secured at the distal end 390 either fixedly or for movement relative thereto, as around an axis 430 and/or a transverse axis 431.

A plurality of tines 432*a*, 432*b*, 432*c*, 432*d* project in diverging fashion from one region 434 of the housing 428. A guide arm 436 projects from the housing 428 diametrically oppositely to the direction of projection of the tines 432*a*, 432*b*, 432*c*, 432*d* at the region 434. The guide arm 436 and tines 432*a*-432*d* have surfaces that reside in a reference plane P and can be simultaneously placed against the surface 306 and slid guidingly therealong. The guide arm 436 stabilizes the surface treating assembly 324' in use.

Repositionable elements 304*a*, 304*b*, 304*c*, 304*d* are associated, one each, with the tines 432*a*, 432*b*, 432*c*, 432*d*. The repositionable elements 304*a*, 304*b*, 304*c*, 304*d* project to beyond the free ends 438*a*, 438*b*, 438*c*, 438*d* of the tines 432*a*, 432*b*, 432*c*, 432*d* and are connected thereto whereby fluid from the pressurized supply 314 directed through the repositionable elements 304*a*, 304*b*, 304*c*, 304*d* tends to cause the repositionable elements 304*a*-304*d* to whip. This tendency is confined by the stiffness of the tines 432*a*-432*d*. The forces induced on the tines 432*a*-432*d* causes the tines 432*a*-432*d* to bend and thereby to repeatedly lower and raise so as to produce a repeated impacting/hammering of the exposed surface 306. This action potentially induces vibrations to the structure defining the surface 306 to further enhance treatment. The tines 432*a*-432*d* can also be oriented to move generally parallel to the exposed surface whereby they may contact the exposed surface to effect scraping thereof, or may be operable in spaced relationship therewith.

The repositionable elements 304*a*-304*d* may alternatively extend to, or near, but short of, the free ends 438*a*-438*d*.

The lengths of the tines 432*a*-432*b*, their cross-sectional configurations and their materials of construction are chosen to produce the desired flexing action in use. Preferably, the tines 432*a*-432*d* do not bend significantly as a result of which the pattern of fluid departing from the outlets 336*a*-336*d* is relatively constant and generally parallel to the place of the surface 306. As a result, a flow of a fluid results that moves the matter 308 separated from the exposed surface 306 in a controlled matter. This "blooming" action is complemented by the hammering of the exposed surface 306 through the tines 432*a*, 432*b*, 432*c*, 432*d* and scraping action produced by translating the tines 432*a*, 432*b*, 432*c*, 432*d* against and relative to the surface 306.

Figure 70:
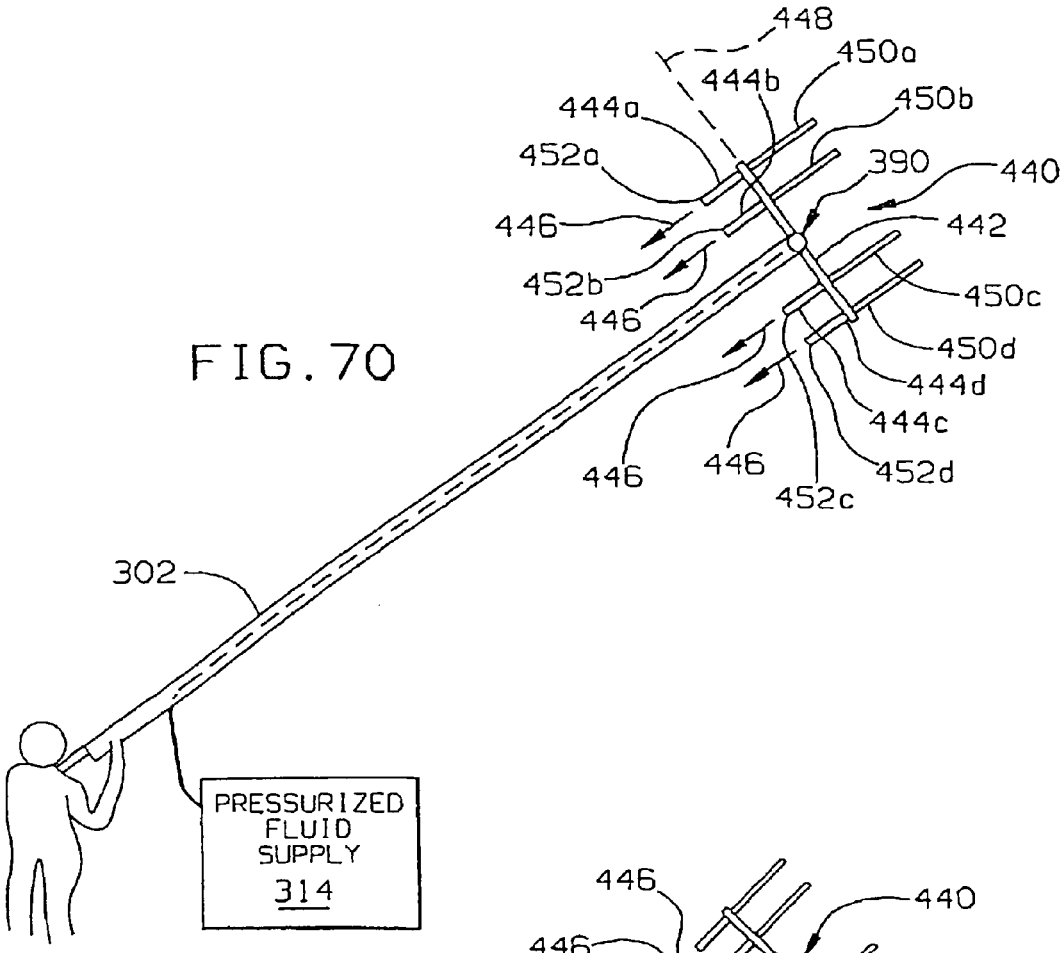
FIG. 70 is a view as in FIG. 4 with a blooming assembly at the distal end of the elongate support.

In FIG. 70, a treating apparatus 300' is shown with another form of blooming assembly at 440 at the distal end 390 of the elongate support/pole 302. The blooming assembly 440 consists of a frame 442 made of tubing that communicates pressurized fluid from the supply 314 to and through at least one, and this case a plurality of, tubes/conduits 444*a*, 444*b*, 444*c*, 444*d*. These tubes/conduits 444*a*-444*d* function as nozzles to generate a controlled pressurized fluid flow layer moving in the direction of the arrows 446, generally parallel to the length of the elongate support/pole 302 in a direction towards the proximal region 316 thereon. The frame 442 is pivotable relative to the elongate support/pole 302 around an axis 448 to facilitate alignment of the apparatus to the surface and for surface treatment from different attack angles.

The tubes/conduits 448*a*, 448*b*, 448*c*, 448*d* have extensions 450*a*, 450*b*, 450*c*, 450*d*, which, in conjunction with the fluid directing portions of the tubes/conduits 444*a*, 444*b*, 444*c*, 444*d*, define a substantial contact area to stabilize and guide the frame 442 along the exposed surface 306 so as to maintain the line of the air flow indicated by the arrows 446 generally parallel to the plane of the surface 306, from the outlets 452*a*, 452*b*, 452*c*, 452*d* at which the fluid is discharged.

Figure 71:
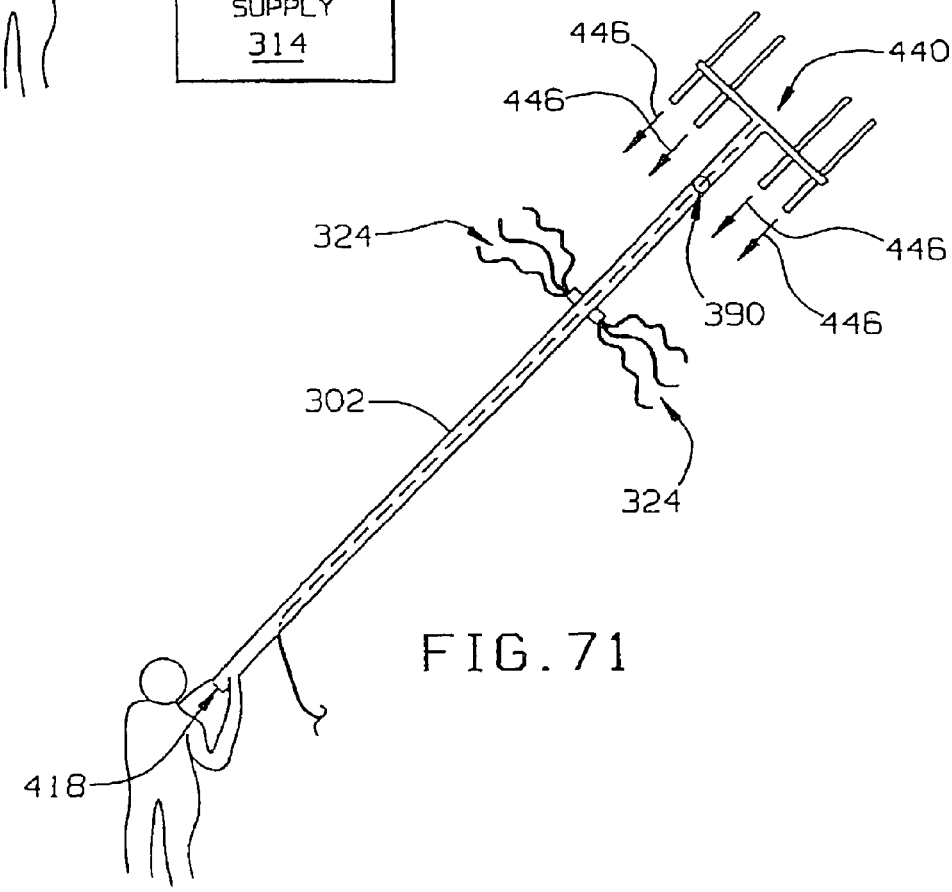
FIG. 71 is a view as in FIG. 70 with a plurality of surface treating assemblies used in conjunction with the blooming assembly.

In FIG. 71, a hybrid blooming and surface treating apparatus is shown consisting of the previously described blooming assembly 440 at the distal end 390 of the elongate support/pole 302. Additionally, at least one surface treating assembly 324, and in this case two such surface treating assemblies 324, are provided projecting diametrically oppositely from the elongate support/pole 302 at a location spaced from the distal end 390 towards the proximal end 418. With this arrangement, the surface treating assemblies 324 break loose matter 308 from the exposed surface 306, which matter 308 is then controllably directed in the line of the arrows 446 by the pressurized fluid discharging from the blooming assembly 440.

A further modified form of blooming assembly is shown at 440' at the distal end 390 of the elongate support/pole 302. The blooming assembly 440' consists of a frame 454 that may be fixed to the elongate support/pole 302 or be movable relative thereto by either rotation around the length of the elongate support/pole 302, pivoting about an axis transverse to the length of the elongate support/pole 302 and/or by lengthwise movement relative to the elongate support/pole 302, as indicated by the double-headed arrow 456. The frame 454 has a series of straight sleeve receptacles 458*a*, 458*b*, 458*c*, 458*d*, 458*e*, 458*f*, each with a length aligned generally parallel to the length of the elongate support/pole 302. Additional tools such as brushes, scrapers can also be attached.

At least one surface treating assembly 324 is provided at the distal end 390 of the elongate support/pole 302 with repositionable elements 304*a*, 304*b*, 304*c*, 304*d*, 304*e*, 304*f* through which pressurized fluid from the supply 314 passes and is discharged. In this embodiment the repositionable elements 304*a*, 304*b*, 304*c*, 304*d*, 304*e*, 304*f* can be selectively attached to the frame 454 by being directed, one each, into the sleeve receptacles 458*a*, 458*b*, 458*c*, 458*d*, 458*e*, 458*f*. The repositionable elements 304*a*, 304*b*, 304*c*, 304*d*, 304*e*, 304*f* can be selectively detached from the frame 454 by being withdrawn from the sleeve receptacles 458*a*, 458*b*, 458*c*, 458*d*, 458*e*, 458*f*, whereupon the detached repositionable elements 304*a*, 304*b*, 304*c*, 304*d*, 304*e*, 304*f* produce the aforementioned repeated whipping action. With the repositionable elements 304*a*, 304*b*, 304*c*, 304*d*, 304*e*, 304*f* attached to the frame 454 by being extended into the sleeve receptacles 458*a*, 458*b*, 458*c*, 458*d*, 458*e*, 458*f*, the pressurized fluid from the supply 314 directed through the repositionable elements 304*a*, 304*b*, 304*c*, 304*d*, 304*e*, 304*f* is caused to be discharged as indicated by the arrows 446, generally parallel to the length of the elongate support/pole 302 towards the user to thereby create an air flow pattern that performs the blooming function, described previously.

Figure 72:
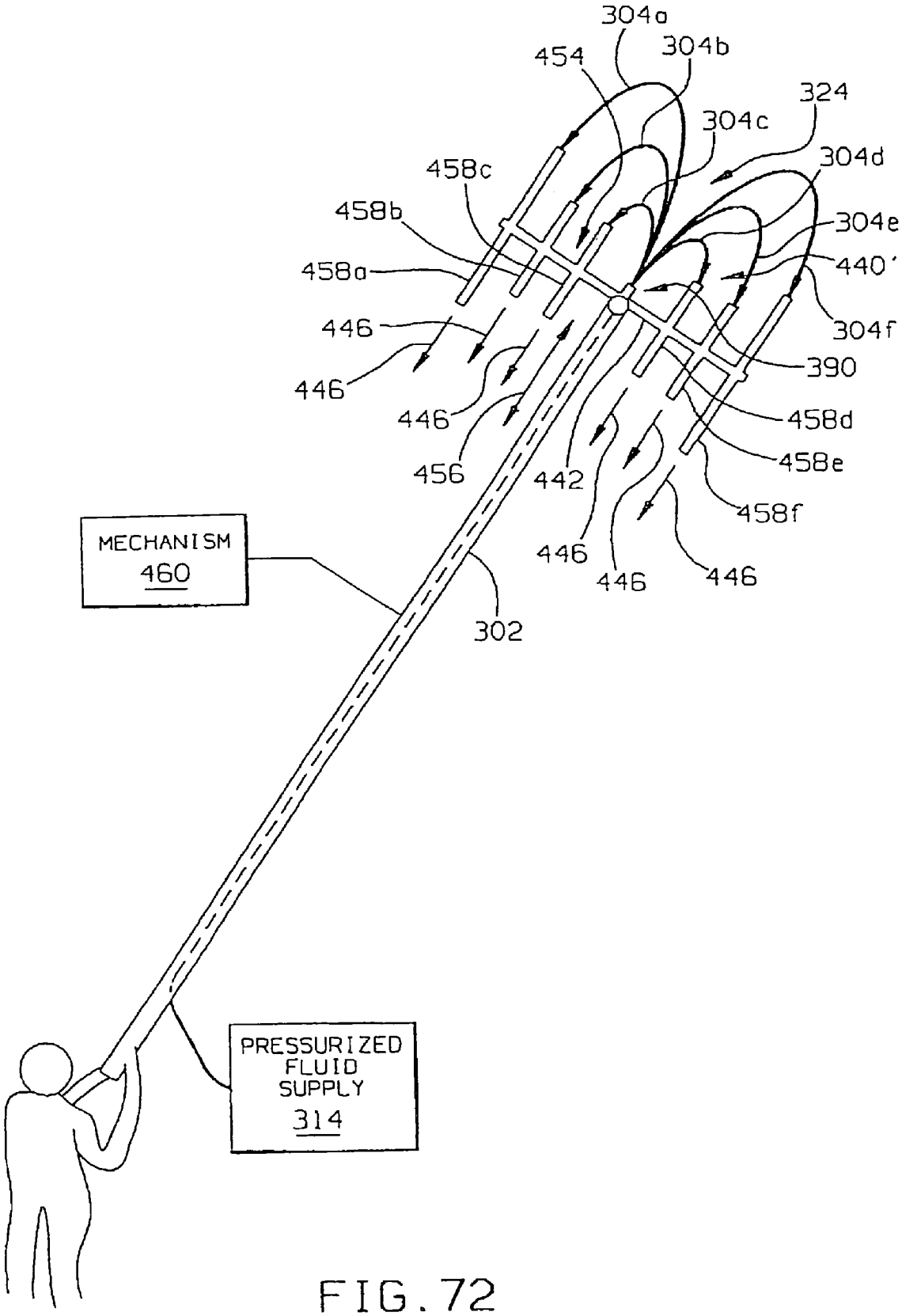
FIG. 72 is a view as in FIG. 48 of a modified form of blooming assembly with an optional mechanism for separating matter from an exposed surface in addition to the blooming assembly and having a frame upon which combined tubes/conduits can be selectively attached and detached.

In FIG. 72, the blooming assembly 440' is shown at the distal end 390 of the elongate support/pole 302. A mechanism, in addition to the repositionable elements 304*a*, 304*b*, 304*c*, 304*d*, 304*e*, 304*f*, may be utilized to separate matter 308 from the exposed surface 306. The mechanism is shown generically at 460 in FIG. 72 and in FIG. 73 as a pair of surface treating assemblies 324 projecting diametrically oppositely with respect to the elongate support/pole 302 at the distal end 390 thereof.

Figure 73:
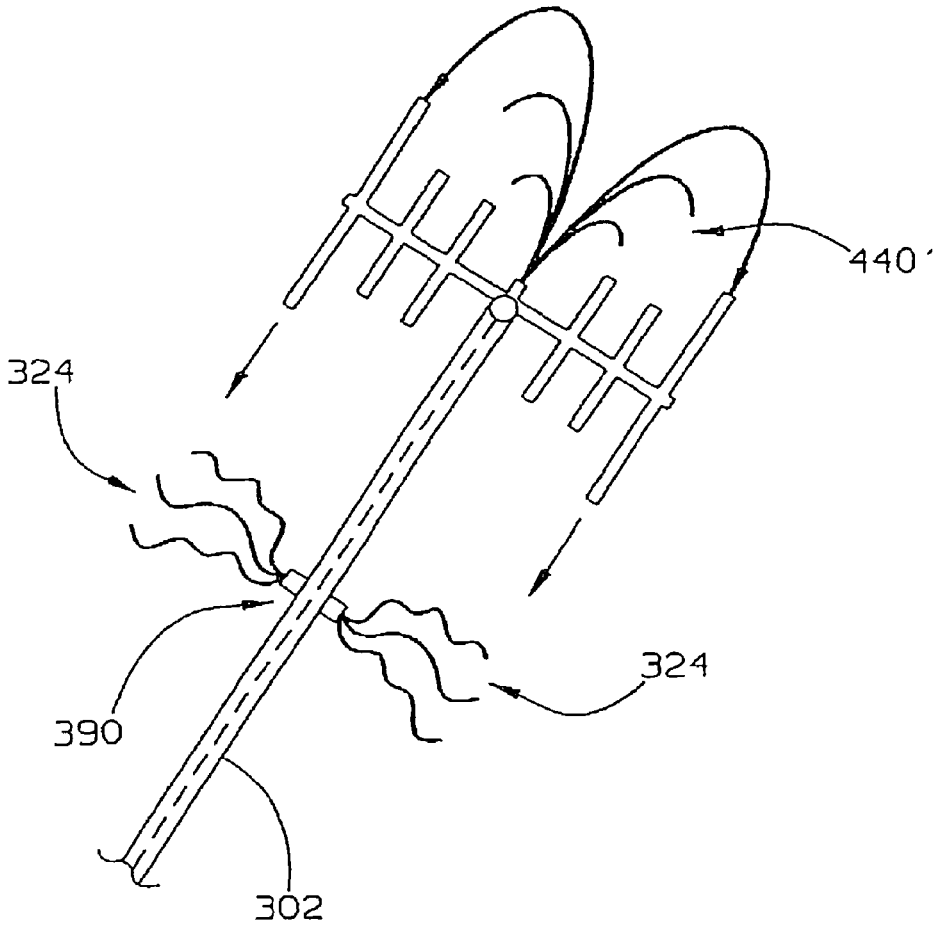
FIG. 73 is a fragmentary, elevation view of a distal region of the elongate support with the blooming assembly in FIG. 72 whereas certain tubes/conduits have been detached from the frame.

With the arrangement in FIGS. 72 and 73, the user has the option of using the apparatus as a dedicated blooming structure by attaching all of the repositionable elements 304*a*-304*f* to the frame 454. Alternatively, the blooming assembly 440' can be converted to both separate matter 308 from the exposed surface 306 and controllably direct separated matter 308 along/away from the exposed surface 306 by selectively detaching the repositionable elements 304*a*-304*f* from the frame 454 in a manner to produce the desired action. In addition, the optional mechanism 460 can be utilized to add another dimension to the matter separating process, as by utilizing surface treating assemblies 324 or other mechanism described herein, or as otherwise devised, to separate matter 308 from an exposed surface 306.

Figure 74:
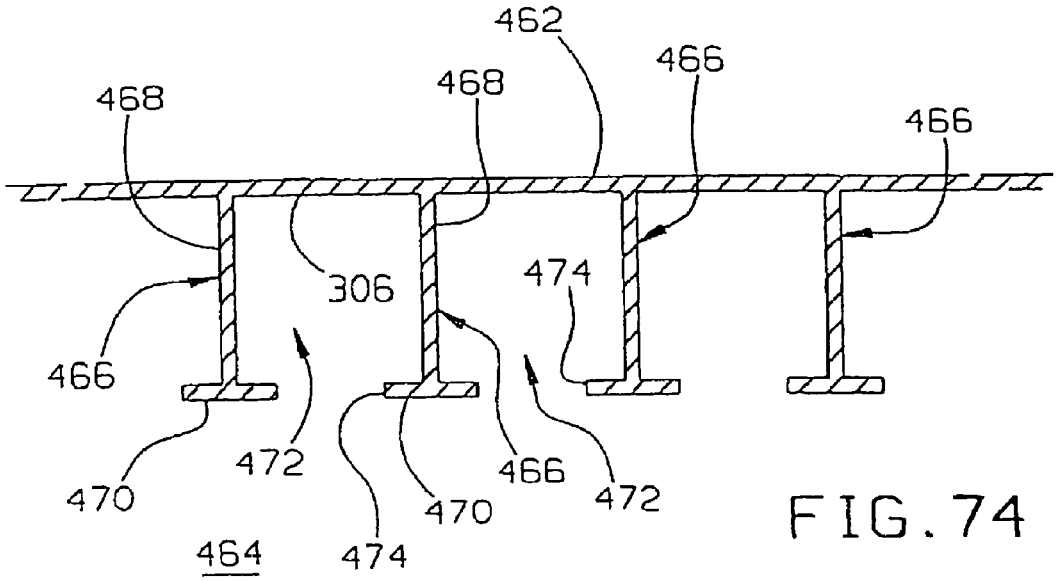
FIG. 74 is a cross-section of a shell frame on a cargo ship hold and including compartments within the shell frame.

In certain applications, it may be necessary to direct separated matter 308 controllably away from a particular exposed surface 306 other than by blooming. As one example, as shown in FIG. 74, the exposed surface 306 may be the inside surface of the external wall 462 of a cargo ship in the hold 464. Reinforcing shell frames 466 are formed on the wall 462 and typically extend vertically and then angularly downwardly near the base of the ship hull. The frames 466 each have a web 468 and flange 470 which bound discrete, generally rectangular, compartments 472 with an opening 474 defined between adjacent flanges 470 through which the compartment 472 is accessible. The compartments 472 have a tendency to trap matter 308 stored in the hold 464. According to the invention, the various treating apparatus described herein can be introduced to the compartments 472 through the openings 474. If not re-directed, matter 308 separated from the exposed surface 306 tends to accumulate at the bottom of the compartment 472 and become trapped therein.

Figure 75:
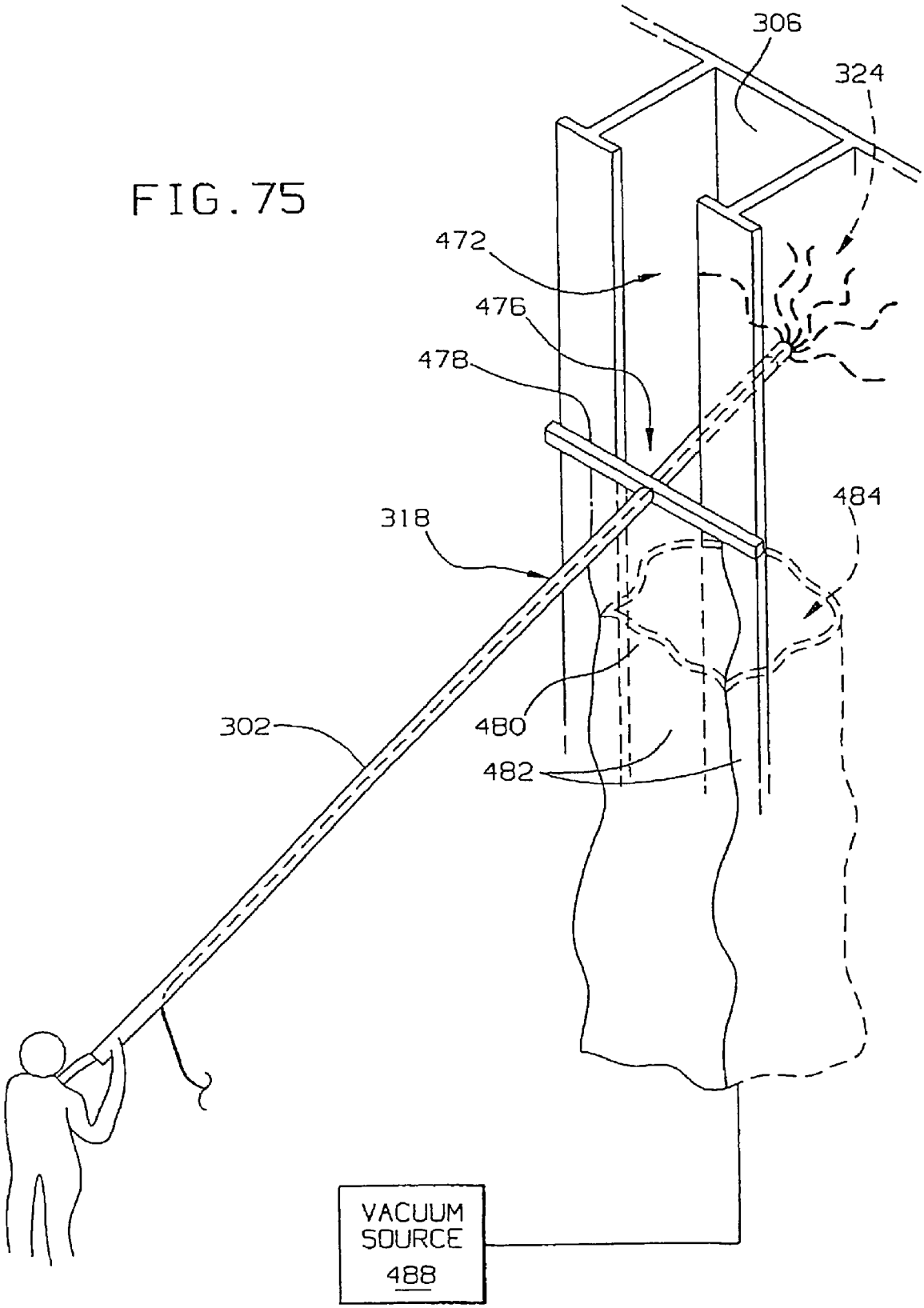
FIG. 75 is a view as in FIG. 48 wherein the elongate support has a curtain assembly at the distal end thereof to define a curtain and an accumulating tube for matter separated from an exposed surface within the shell frame compartment of FIG. 74.
Figure 76:
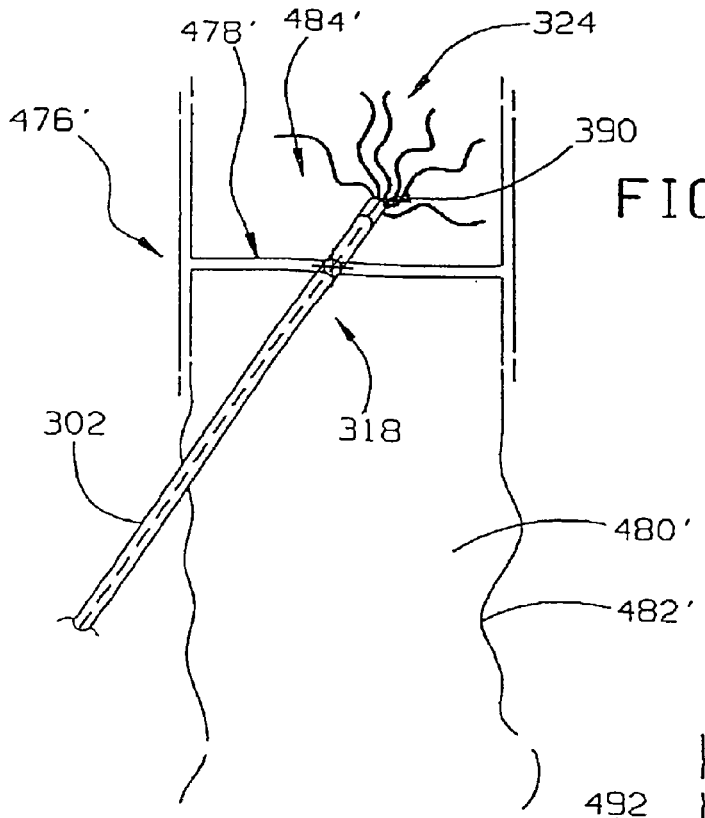
FIG. 76 is a fragmentary, cross-sectional view of a modified form of curtain assembly at the distal end of the elongate support.

According to the invention, as shown additionally in FIG. 75, a curtain assembly is provided at 476 on the elongate support/pole 302 at the distal region 318. The curtain assembly 476 consists of a frame 478 upon which a flexible sheet material 480 is mounted in depending fashion to block the opening 474. A tubular portion 482 is defined below the frame and has an upper inlet 484.

A surface treating assembly 324, spaced beyond frame 478, can be directed to within the compartment 472. Matter 308 separated by the surface treating assembly 324 is blocked from escaping from the opening 474 by the sheet material 480 and is guided thereby into the tubular portion at the inlet 484 and directed therethrough out of the compartment 472 and downwardly to an outlet 486 for appropriate accumulation or discharge.

An optional source of vacuum 488 can be used to enhance the flow of matter 308 to and through the tubular portion 482 between the inlet 484 and outlet 486.

A modified form of curtain assembly is shown at 476' in FIG. 75. The curtain assembly 476' has a frame 478' which attaches at the distal region 318 of the elongate support/pole 302. The frame 478', as the frame 478, may be fixedly attached or attached so as to be selectively reoriented relative to the elongate support/pole 302. Alternatively an "air curtain" can be formed by attaching air nozzles (not shown) to the pole or frame.

The frame 478' defines at least a partial ring/shroud near the region at which a surface treating assembly 324 at the distal end 390 of the elongate support/pole 302 is located. That is, the frame 478' defines an inlet at 484' adjacent to, or within, which at least a part of the surface treating assembly 324 resides, so as to more positively capture matter 308 that is separated from the exposed surface 306. In the inlet region 484', the gathered matter 308 is directed downwardly through a tube 482' defined by a flexible sheet material 480'.

Figure 77:
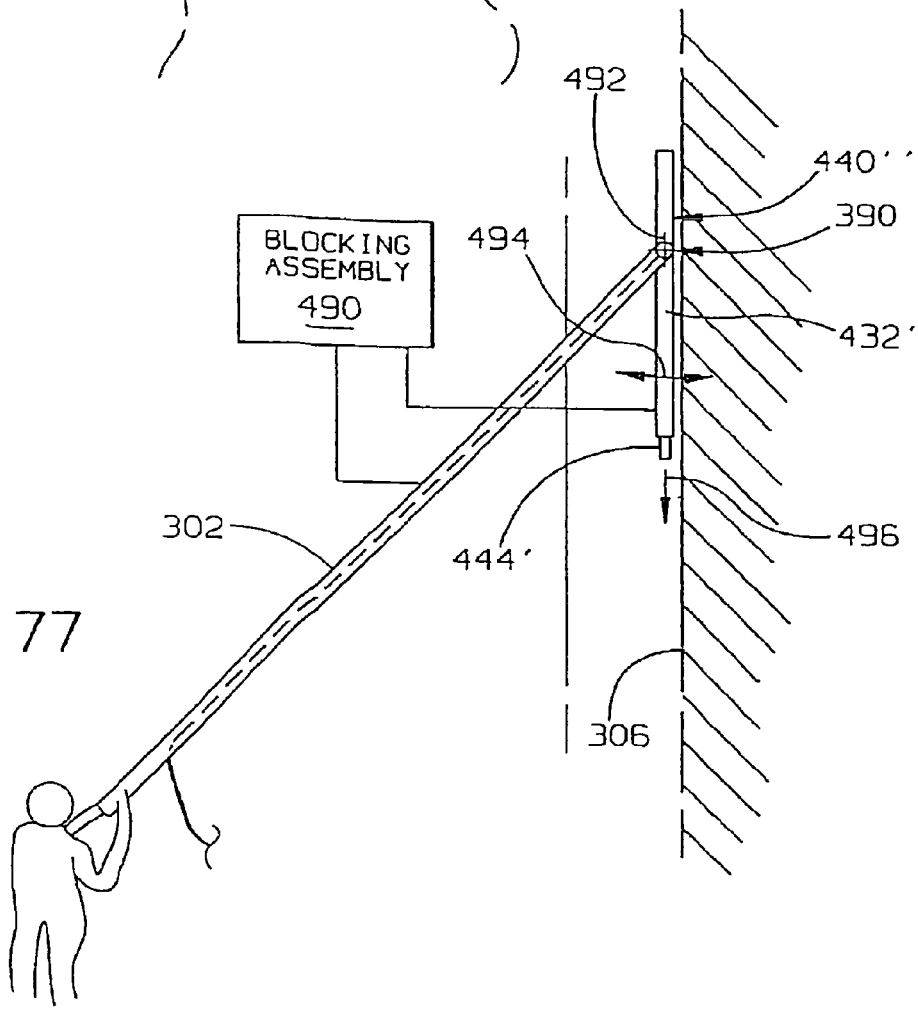
FIG. 77 is a view as in FIG. 48, showing a modified form of surface treating assembly wherein repositionable elements, that are confined by a blocking assembly, perform functions of separating matter and blooming.
Figure 80:
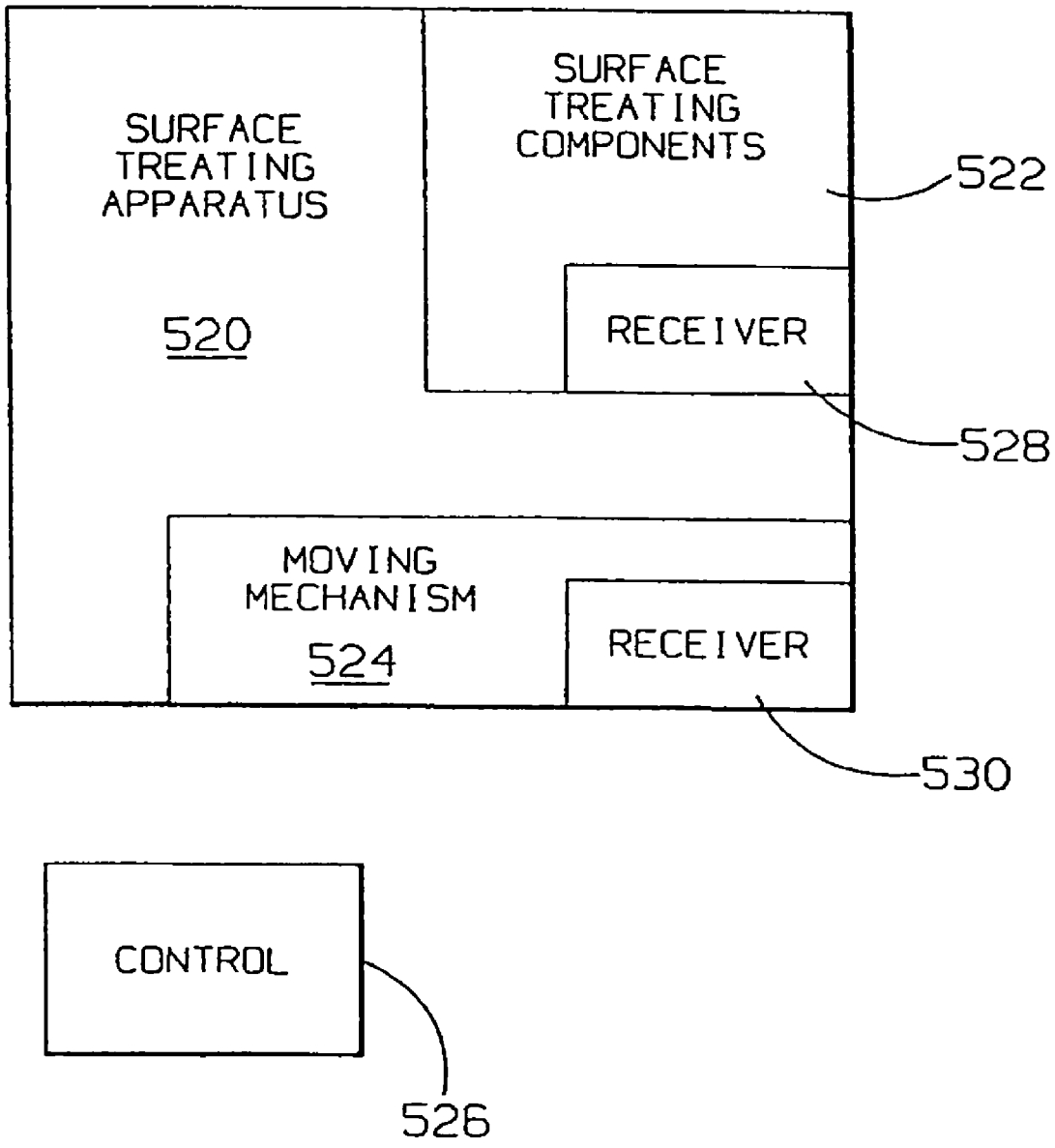
FIG. 80 is a schematic representation of a remotely controlled surface treating apparatus, according to the invention.

A further modification of the invention is shown in FIG. 77. In FIG. 77, a blocking assembly is shown at 490 acting between a blooming assembly 440" and the elongate support/pole 302. The blooming assembly 440" is attached at the distal end 390 of the elongate support/pole 302 so as to be movable about an axis 492 relative to the elongate support/pole 302 so as to pivot relative thereto in a direction as indicated by the double-headed arrow 494. The blooming assembly 440" includes one or a plurality of tubes/conduits 444 arranged to direct fluid under pressure in the direction of the arrow 496 generally parallel to the plane of the exposed surface 306 that is being treated.

This same type of blocking assembly 490 may be used to limit the movement of the aforementioned tines 432*a*-432*d* moving either transversely, or parallel, to an exposed surface being treated.

In this embodiment, the tubes/conduits 444' are flexible to produce a whipping action. According to the invention, a blocking assembly 490 confines the whipping action so that the tubes/conduits 444' do not orient substantially from the alignment shown in FIG. 76 whereby the discharge fluid is propelled in the direction of the arrow 496. This produces a controlled hammering action, as for the tines 432*a*-432*d* shown in FIG. 68. The blocking assembly 490 may act on the tubes/conduits 444', or any structure, as shown generically at 432, that may be used to generally fix the orientation of the tubes/conduits 444' in the manner that the tines 432*a*-432*d* do, as previously described. Consequently, the same tube/conduits 444' that impact the surface 306 with a hammering action are confined to an extent that they additionally perform a blooming function.

In another variation, as shown in FIGS. 78 and 79, a shield assembly at 498 is used in conjunction with the elongate support/pole 302, at its distal region 318, in combination with one or more surface treating assemblies 324.

The shield assembly 498 has particular utility in cleaning the compartments 472, as shown in FIG. 74. Fluid, such as a liquid, delivered into the compartments 472 is blocked from escaping from the openings 474 by the shield assembly 498. The rebounding fluid impacts a wall 500 on the shield assembly 498 and is accumulated in a receptacle 502, at the bottom thereof, from where the fluid can be recovered through a drain pipe 504. Through this arrangement, the shield assembly 498 controls the discharge of fluid pressure and facilitates recovery thereof.

The wall 500 may be pivotable relative to the elongate support/pole 302 about an axis 506, thereby facilitating flush placement of the wall, as against the flanges 470 so as to effectively block the opening 474 therebetween. The lower portion of the wall at 508 may be narrowed relative to the rest of the wall 500 to permit passage through an opening that is blocked by the wall 500.

The inventive structure and method can be used to potentially break loose, and control movement of, released matter 308 from exposed surfaces in myriad different environments by directly impacting such surfaces, indirectly impacting such surfaces, inducing vibrations thereto, propelling fluid thereagainst, etc. The inventive concepts can be used to perform many different procedures, including many not specifically described above.

As one example, the structures described above to propel a treating fluid at an exposed surface 306 to remove matter 308 therefrom can be used in a similar fashion to apply a surface preparation component to the exposed surface 306. Application of such a component to an exposed surface may be desirable, or required, before introducing certain matter, as into a ship cargo hold, against such a surface. The inventive structure may permit application to such surfaces that are otherwise difficult or impossible to reach using conventional means.

As a further example, stain treating components may be applied. Oily stains from coal or pet coke might be treated by applying a baking soda solution under pressure and then striking or rubbing the surface. An abrasive might also be applied by being mixed with a pressurized liquid and/or gas As just one other example, the inventive structure can be used to break up a significant vertical accumulation of particulate matter. Whereas conventionally pressurized fluid might be propelled against such an accumulation, placement of one or more of the repositionable elements 304 within the accumulation may allow dispersion thereof without causing elevation of light particles that might obscure vision and are proven to being inhaled.

More specifically, matter such as cement may accumulate between sheet frames and in transition areas at locations that are 4-14 meters above the floor in a ship's hold. Most commonly, these areas are accessed by climbing up ladders, or using lifts to situate workers in close proximity to the accumulations so that the same can be directly accessed, as by a shovel. This is inherently dangerous by reason of the height at which workers are required to maneuver.

According to the invention, the pole can be "stabbed" into such an accumulation at a base/lower region therein. This causes a controlled collapse of the accumulation and cascading to a lower collection area either guidingly against an adjacent surface or freely as from a ledge. One or more repositionable elements at the inserted pole end may facilitate this process. Dust generation is controlled by reason of the immersion of the repositionable element in the accumulated matter. The accumulations can thus be progressively broken down to controllably, safely, and conveniently eliminate this condition.

The invention can likewise be used to agitate a wet mixture, such as a slurry. As one example, a wet cement mixture might be agitated and also treated by introducing an additive, such as sugar or other hardening retardant.

With all embodiments, the force of the whipping action of the repositionable elements 304, the frequency of the repetitive hammering thereby etc., can be selected by varying the nature and interaction of components. For example, in the event the repositionable elements 304 are tubes/conduits, the "whipping" properties are dictated by the tube size, wall thickness, materials of construction, length, flow volume and pressure of the pressurized fluid, etc. Those skilled in the art, with the above inventive concepts in hand, would be able to change system components to achieve desired ends as a particular environment and application may demand or dictate. Different surface interactions may be carried out by controlling pressurized flow, be it by flow pressure variations, intermittently changing pressure, as to cause oscillations, etc.

Further, it is contemplated that the various components described in different embodiments herein might be combined. As just one example, for purposes of weight reduction, the external supply line 330 can be partially eliminated in each embodiment in favor of using the chamber 338 in the elongate support/pole 302 as a part of the means to communicate pressurized fluid. This potentially simplifies, and reduces the weight of, the overall system.

As a still further example, the repositionable elements 304 may be treated as by using a coating, to alter their performance. The coating may increase hardness and/or embed an abrasive, such as silica sand, silica carbide, etc. Alternatively, each repositionable element 304 may be made up of different types/sizes of tubing that are united. For example, short lengths of harder material may be provided at the free ends of the repositionable elements to increase flexing and impacting effect at the surface 306. As a further alternative, each repositionable element 304 could branch to one or a plurality of separate treating arms. Weights, such as beads, may be placed on the repositionable elements 304 at or near the free ends thereof.

A significant aspect of the present invention is that it may permit surface treatment, as in a ship cargo hold while the vessel is transiting in the open sea with hatches opened or closed. This potentially avoids the expenses of dry cleaning at anchor. The accumulated residue can be conventionally discharged legally 25 nautical miles offshore during the cleaning process.

Further, by reason of providing interactive tools on a relatively lightweight pole/support, surface treating can be carried out quickly without exhausting workers in a manner that is typical to using prior art brushes and the like, that must be borne under pressure against a surface to be treated, and repetitively manually moved, as to effect a scrubbing action.

The inventive system can also be used as a diagnostic device and standard to test the state of a surface against which material will be placed. Observing the type and quantity of the matter separated from a surface by the repositionable elements 304 allows an inspector to easily and quickly anticipate the debriding that is likely to occur as a result of introducing material against these surfaces. That is, objective qualitative and quantitative analysis of the state of the hold can be made, particularly to determine the suitability for the next loaded cargo.

As a still further variation, an inventive surface treating apparatus, shown generically at 520, to encompass all different components described herein and identified collectively as 522, may be repositioned through a moving mechanism 524 selectively throughout a space bounded by an exposed surface to be treated. The moving mechanism 524, and potentially the treating components 522 on the apparatus 520, may be selectively operated through a control 526 that may be wired to, or in wireless communication with, receivers 528, 530 on the surface treating components 522 and moving mechanism 524, respectively. This facilitates remote treating at hard-to-reach and potentially dangerously high locations. The moving mechanism 524 may interact with the surface or be otherwise controlled, as through an independent support.

Figure 81:
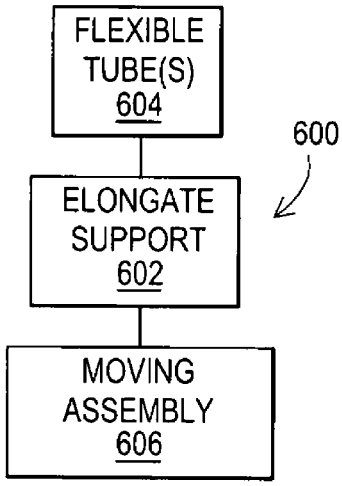
FIG. 81 is a schematic representation of an apparatus for treating a surface bounding a space within which a bulk supply of flowable material can be contained and consisting of a moving assembly having an associated elongate support with at least one flexible tube thereon.

One modified form of apparatus, according to the present invention, is shown at 600 in FIG. 81. The apparatus 600 consists of an elongate support 602 having proximal and distal regions, with at least one flexible tube 604, and more preferably multiple flexible tubes 604, corresponding generically to the repositionable elements, described above, and potentially others, that are capable of producing a whipping action at the distal region of the elongate support 602 for purposes as described hereinabove.

The apparatus 600 differs from those described in FIGS. 1-79 in that a moving assembly 606 is incorporated for the elongate support 602. Rather than have an individual user manipulate the elongate support as he/she does the elongate poles, as hereinabove described, the moving assembly 606 is operable to controllably reposition and/or reconfigure the elongate support 602, thereby to controllably place at least one flexible tube 60, at a distal region of the elongate support 602, at different selected locations with respect to a surface to be treated by the apparatus 600.

The apparatus 600 is shown in schematic form in that it is intended to incorporate virtually a limitless number of different configurations. While some specific configurations for the moving assembly 606 will be described herein, it is contemplated that virtually any mechanism might be used to effect the controlled repositioning and/or reconfiguration of the elongate support 602 to control placement of the flexible tube(s) 604 consistent with the inventive concepts herein.

Figure 82:
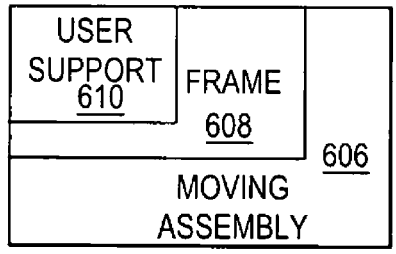
FIG. 82 is a schematic representation of one form of the moving assembly consisting of a frame with a user support thereon.

In one form, as shown in FIG. 82, the moving assembly 606 has an associated frame 608 with a user support 610 thereon. The user support 610 may be in the form of a seat, a cage, a platform, or the like, for one or more individuals.

Figure 83:
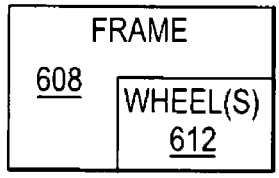
FIG. 83 is a schematic representation of one form of the frame having at least one wheel thereon to facilitate repositioning of the frame relative to a subjacent support.

In one form, as shown in FIG. 83, the frame 608 has one or more wheels 612 which facilitate movement of the frame 608 over a subjacent surface, thereby allowing repositioning of the frame 608 and associated elongate support 602 to controllably place the flexible tube or tubes 604 at different locations.

Some more specific forms of the apparatus 600 will now be described, with it being understood that these are exemplary in nature only as other variations are contemplated within the broad generic disclosure of the invention as shown in schematic form in the Figures.

Figure 84:
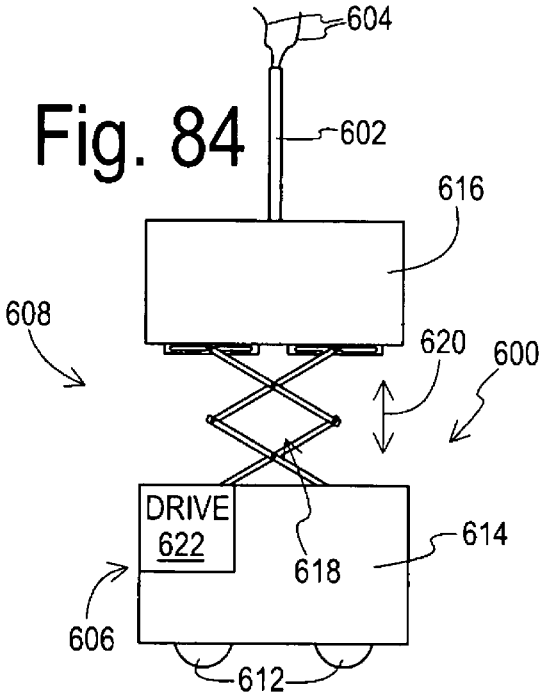
FIG. 84 is a side elevation view of one specific form of apparatus, according to the invention, having a moving assembly capable of vertically repositioning a user and/or elongate support.

As shown in FIG. 84, the apparatus 600 consists of the aforementioned moving assembly 606 with the frame 608. The frame 608 consists of a base 614 that is supported on a carriage with wheels 612 to be movable against and relative to a subjacent surface. The frame 608 further includes a carrier 616 for the elongate support 602 having the flexible tubes 604 thereon. The carrier 616 is mounted to the base 614 through a conventional scissors-type lift mechanism 618, whereby the carrier 616 is movable vertically selectively upwardly and downwardly, as indicated by the double-headed arrow 620.

The elongate support 602 may be attached directly to the carrier 616 to follow movement thereof or may be held entirely, or supported partially, by a user that is situated upon the carrier 616. The elongate support 602 may be fixedly attached to the carrier 616 to follow movement thereof or may be movable relative thereto to thereby controllably place the flexible tubes 604 at different selected locations. With this design, there are potentially multiple dimensions of movement that allow controlled placement of the flexible tube 604 at different locations. That is, the frame 608 can be moved as a unit relative to the subjacent surface. In turn, the carrier 616 can be moved relative to the base 614 on the frame 608 for another dimension of movement. As a still further potential dimension of movement, the elongate support 602 might be repositionable relative to the frame 608 and/or reconfigurable to controllably place the flexible tubes 604 at different selected locations.

As in all embodiments herein, the frame 608 may be movable manually by a user or, more preferably, through a drive 622 on the base 614 that may be powered electrically, by a combustible fuel, etc.

Figure 85:
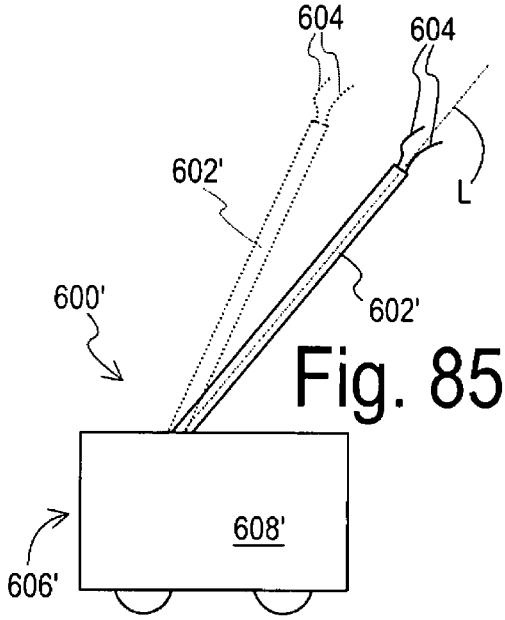
FIG. 85 is a side elevation view of a modified form of apparatus, according to the invention, having a moving assembly through which the angular orientation of the length of the elongate support can be changed relative to the frame on the moving assembly.

In FIG. 85, an apparatus 600' is shown with a moving assembly 606' having a frame 608', with the elongate support 602' having a lengthwise axis L. The elongate support 602' is mounted to the frame 608' so that the angular orientation of the lengthwise axis L thereof can be changed with respect to the frame 608'. One alternative position for the elongate support 602' is shown in dotted lines, resulting from angular reorientation of the elongate support 602' relative to the frame 608'.

Figure 86:
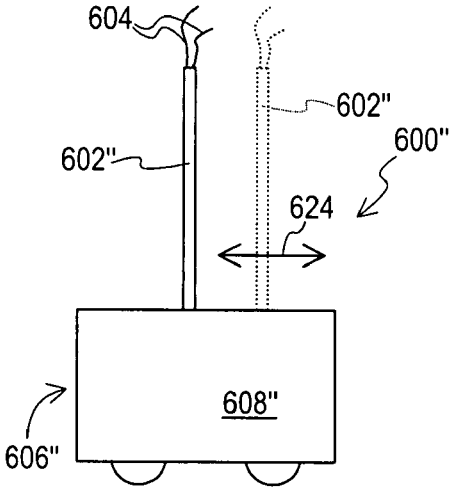
FIG. 86 is a side elevation view of a further modified form of apparatus, according to the present invention, having a moving assembly consisting of a frame relative to which the elongate support is capable of being moved by translational movement transversely to the length of the elongate support.

In FIG. 86, a further modified form of apparatus is shown at 600", consisting of a moving assembly 606" with a frame 608" and an elongate support 602" which projects therefrom. In this embodiment, the elongate support 602" is translatable relative to the frame 608" in a direction, as indicated by the double-headed arrow 624, transversely to the length of the elongate support 602". The elongate support 602" is shown in two alternative positions in solid and dotted lines in FIG. 86.

Figure 87:
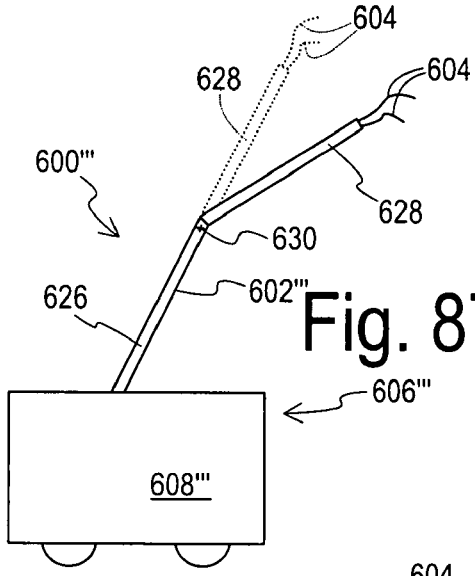
FIG. 87 is a side elevation view of a modified form of apparatus, according to the invention, having a moving assembly and elongate support that has an articulated construction.

In FIG. 87, a further modified form of apparatus is shown at 600'" with a moving assembly 606'" with a frame 608'" having an elongate support 602'" that has an articulated configuration. That is, the elongate support 602'" consists of a base part 626 and an extension part 628 that is guided for pivoting movement through an appropriate connection about an axis 630 between exemplary solid line and dotted line positions in FIG. 87. Any number of the articulated parts can be incorporated to controllably place the flexible tubes 604 at different selected locations. The repositioning of the part 628 may be effected manually or through an appropriate mechanism that may be operated through hydraulics, gearing, or any other type of mechanism known to those skilled in the art.

Figure 88:
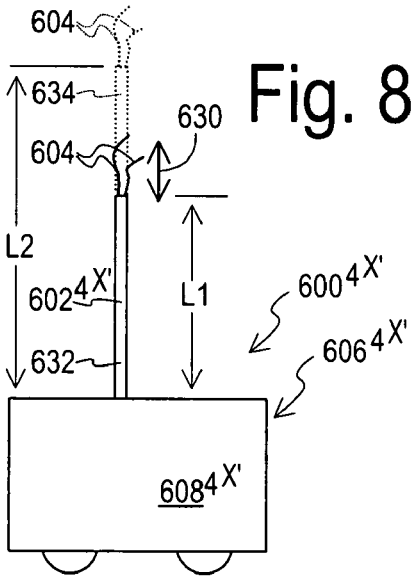
FIG. 88 is a side elevation view of a further modified form of apparatus, according to the present invention, having a moving assembly with an elongate support that has a telescoping construction.

In FIG. 88, a further modified form of apparatus is shown at $\mathbf{600}^{4x'}$. The apparatus $\mathbf{600}^{4x'}$ consists of a moving assembly $\mathbf{606}^{4x'}$ with a frame $\mathbf{608}^{4x'}$. An elongate support $\mathbf{602}^{4x'}$ is selectively extendable in a lengthwise direction, as indicated by the double-headed arrow 630. This length adjustment can be accomplished, for example, by having at least two telescoping sections 632, 634. With the section 634 retracted, the flexible tubes 604 are in the solid line position in FIG. 88 and the sections 632, 634 have a first effective combined length L1. By extending the section 634 as shown in dotted lines, the flexible tubes 604 extend a greater distance from the frame $\mathbf{608}^{4x'}$, with the sections 632, 634 thereby having a greater effective combined length L2. The effective length of the elongate support $\mathbf{602}^{4x'}$ can be varied within a range as permitted by the telescoping connection of parts thereon.

Figure 89:
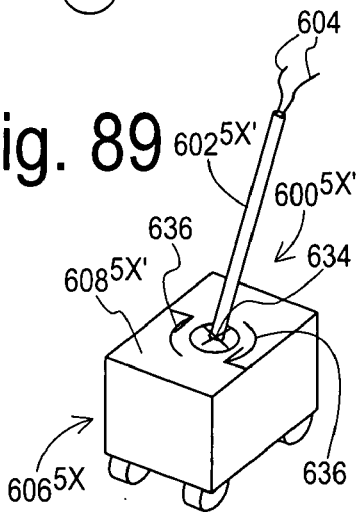
FIG. 89 is a perspective view of a further modified form of apparatus, according to the present invention, having a moving assembly and an elongate support that is pivotable relative to a frame on the moving assembly.

In FIG. 89, a further modified form of apparatus is shown at $\mathbf{600}^{5x'}$ and consists of a moving assembly $\mathbf{606}^{5x'}$ with a frame $\mathbf{608}^{5x'}$ to which an elongate support $\mathbf{602}^{5x'}$ is attached. In this embodiment, the elongate support $\mathbf{602}^{5x'}$ is pivotable relative to the frame $\mathbf{608}^{5x'}$ about an axis 634 selectively in opposite directions, as indicated by the arrows 636, to place the flexible tubes 604 at different selected locations.

The invention contemplates that any of the mechanisms shown in FIGS. 84-89 may be used alone or together to produce the desired controlled placement of the flexible tube or tubes 604 at different selected locations. Potentially multiple dimensions of movement of the elongate supports relative to each frame are contemplated, together with the movement of the frame itself relative to the subjacent surface, to allow even greater versatility.

It should also be understood that the subjacent surface supporting the various frames might be horizontal or vertically oriented, with appropriate provision made to maintain the apparatus on the surfaces and guide movement thereof, particularly with the latter surface orientation.

Figure 90:
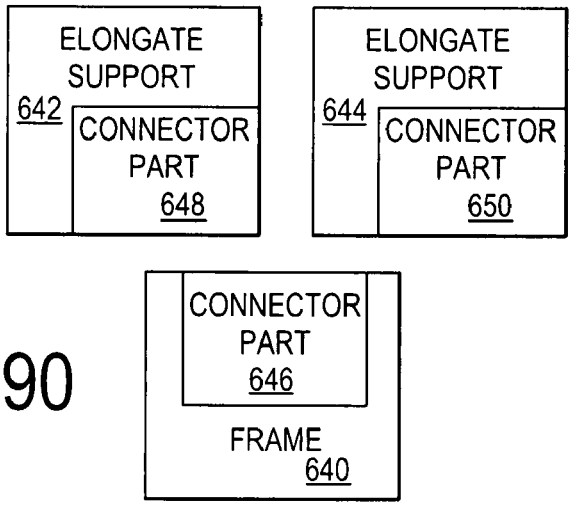
FIG. 90 is a schematic representation of a system, according to the present invention, wherein elongate supports, potentially of different construction, are selectively operably connectable to a frame on a moving assembly.

Still other variations are contemplated. For example, as shown in FIG. 90, a frame, as shown generically at 640, may be used to carry different elongate supports 642, 644. A connector part 646 on the frame 640 can be selectively joined with one or the other of the connector parts 648, 650 on the elongate supports 642, 644. The elongate supports 642, 644 may have different configurations or different arrangements of flexible tubes, or other constructions that permit the desired action that separates matter adhered to a surface at or adjacent to which each flexible tube 604 is located or applies a fluid thereto.

Figure 91:
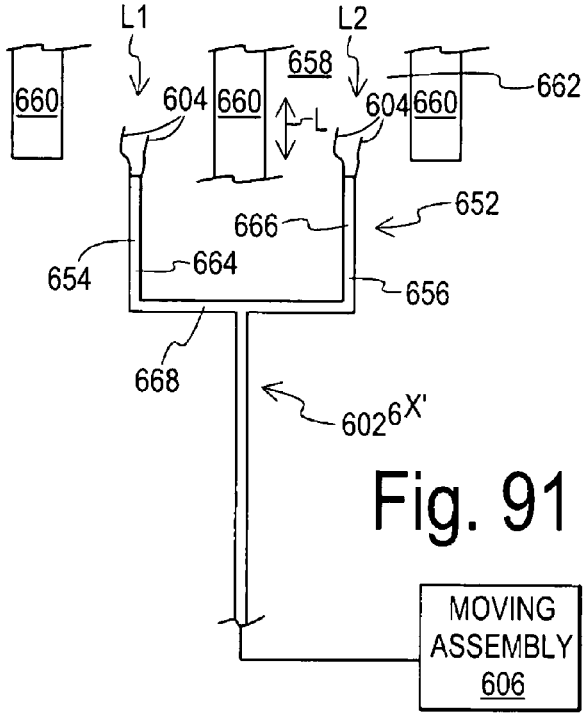
FIG. 91 is a fragmentary, partially schematic, representation of a further modified form of apparatus having an elongate support with a working portion having spaced working sections and in relationship to one form of surface being treated.

Still further, the use of the moving assembly 606 makes more practical the use of a branched construction at a working portion 652 of an elongate support, as shown in one exemplary form at $\mathbf{602}^{6x'}$ in FIG. 91. The working portion 652 may be at the distal region/end 654 of the elongate support $\mathbf{602}^{6x'}$, as shown, or at an intermediate lengthwise location. The working portion 652 has separate, spaced, working sections 654,656, each of which has at least one flexible tube 604 associated therewith. The working sections 654, 656 allow convenient simultaneous treatment at two different locations L1, L2 on a surface 658. The two different locations L1, L2 may be on spaced sides of beams 660, commonly used to reinforce a wall 662 defining the surface 658.

In this configuration, the working portion 652 is generally U-shaped with legs 664,666 projecting generally parallel to each other, in spaced relationship, from a base 668. This allows the beams 660 to locate between the legs 664, 666 whereby the flexible tubes 604 can be placed to simultaneously treat the surface 658 at the locations L1, L2. This relationship can be maintained as the elongate support $\mathbf{602}^{6x'}$ is moved lengthwise of the beams 660, as indicated by the double-headed arrow L.

The branched construction for the working portion 652 is but exemplary of virtually a limitless number of different variations contemplated by the invention. As one example, there may be more, and potentially many more, working sections incorporated beyond the two working sections 654, 656 shown.

The working portion 652 need not have straight legs 664, 666 as shown, or for that matter, any separate legs whatsoever. What is significant with this version of the invention is the ability to place one or more flexible tubes 604 simultaneously at spaced working locations relative to a surface to be treated. The particular structure that supports the flexible tubes 604 may be virtually unlimited in terms of its potential forms, as specifically adapted to a particular geometry.

Figure 92:
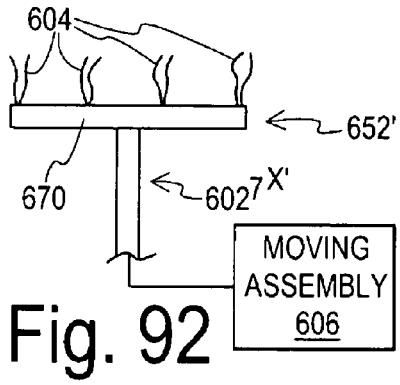
FIG. 92 is a view of an apparatus as in FIG. 91 with a modified form of elongate support.

For example, while the discrete, parallel legs 664, 666 facilitate treatment around projections such as the beams 660 in FIG. 91, the flexible tubes 604 may be provided on a working portion 652' as shown in FIG. 92, wherein the flexible tubes 604 are at working sections spaced locations along a straight base 670 on an elongate support $\mathbf{602}^{7x'}$ having an associated moving assembly 606. This arrangement essentially increases a surface width that is simultaneously treated by the flexible tubes 604 along the length of the base 670.

It should be noted that the elongate supports $\mathbf{602}^{6x'}$, $602^{7x'}$, as shown in FIGS. 91 and 92, and those described hereinbelow, might be hand held and operated, as those described previously herein. While the invention contemplates this hand operation, the incorporation of a moving assembly 606 facilitates controlled movement of devices with a substantial size and weight that might not otherwise be manageable, or practically manageable, without mechanical assistance. For example, the number of legs in FIG. 91 could be increased from the two legs 664, 666 shown to potentially a large number that will allow simultaneous treatment of a very substantial extent of a surface. Such a configuration could potentially be difficult to maneuver. Even if maneuverability was not a problem, user fatigue becomes an issue. The use of the moving assembly 606, which is contemplated for all variations of elongate poles disclosed herein, potentially alleviates the problems inherent to manual operation.

As noted above, the invention contemplates virtually any configuration of device wherein one or more flexible tubes 604 can be placed at spaced locations for simultaneous surface treatment. Potentially, the surface treatment apparatus, as shown schematically at 672 in FIG. 93, consists of a support 674 upon which one or more flexible tubes 604 are supported at different, spaced locations to simultaneously treat a surface at those locations. The support 674 need not have elongate components to effect this operation. Such a device 672 may be manually operable or operated through the moving assembly 606.

Figure 94:
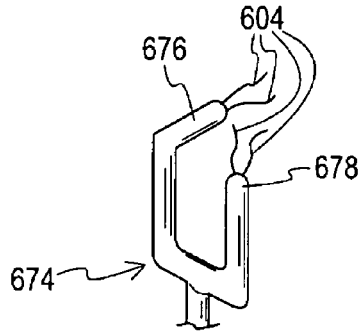
FIG. 94 is a fragmentary, perspective view of one form of the support in FIG. 93.

One exemplary form of the support 674 is shown in FIG. 94 and has legs 676, 678 that project in different directions, with each having at least one, and as shown multiple, flexible tubes 604. The leg 676 is bent, whereas the leg 678 is straight. The legs 676, 678 might have any other configuration that facilitates strategic and optimal placement of the flexible tubes 604.

While the elongate supports 602, 602', $\mathbf{602}^{2x'}$, $602^{3x'}$, $602^{4x'}$, $602^{5x'}$ are shown on apparatus normally placed within a space for treatment of a surface bounding that space, these same, or like functioning structures, may have portions thereof located outside of the space, as upon a deck of a floating vessel/ship within which the hold is defined, on an adjacent deck, or on a floating surface as upon a barge in adjacent relationship to the ship.

Figure 93:
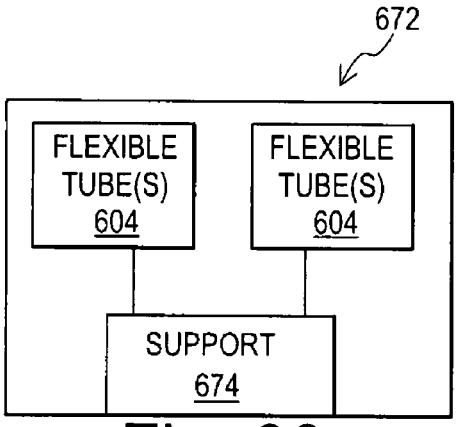
FIG. 93 is a schematic representation of a support with spaced working sections.
Figure 95:
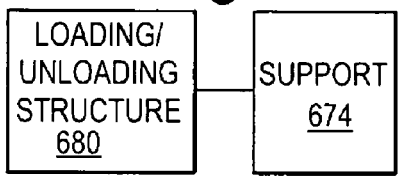
FIG. 95 is a schematic representation of the support in FIGS. 93 and 94 used in association with a loading/unloading structure.

As a further alternative, the support 674, shown generically in FIG. 93, might be defined in part by structure used in conjunction with the ship, or other structure, in performing another function. For example, the support 674 may be defined by, or used in conjunction with, cargo loading/unloading structure, as shown generically at 680 in FIG. 95. This structure 680 is intended to represent any structure commonly used in and around ships to load cargo, reposition equipment, discharge cargo, assist cargo loading, control dust, or perform any function around the ships during the carrying out of routine shipping operations. As just one example, the support may be a crane or boom, that may be repositionable and/or reconfigurable. This structure 680 may be separate from, or an integrated part of, a ship.

Figure 96:
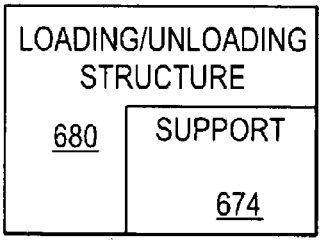
FIG. 96 is a schematic representation as in FIG. 95 wherein the support is a part of the loading/unloading structure.

As shown in FIG. 96, the support 674 may be integrally formed with such loading/unloading structure 680.

Figure 97:
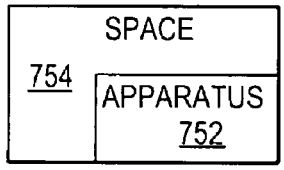
FIG. 97 is a schematic representation of an environment wherein an apparatus, according to the present invention, is placed within a space bounded by a surface, and in which the apparatus can operate.

As shown in FIG. 97, the invention contemplates that all forms of the apparatus, shown generically at 752, might be utilized in any large space 754 bounded by a surface and within which a bulk supply of flowable material can be contained. For example, the space might be within a holding tank such as a silo. Alternatively, the space may be within a cargo hold in a floating vessel in which a bulk supply of flowable material can be stored and transported on a navigable body of water, as hereinabove described.

As noted previously, the various mechanisms at the distal region of each elongate support may be made up of one or any combination of those components described above.

Figure 98:
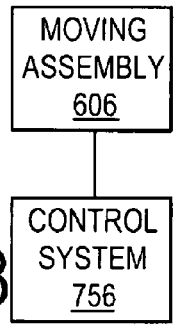
FIG. 98 is a schematic representation of a control system for a moving assembly, according to the present invention.

As shown in FIG. 98, all functions of the moving assembly 606 can be effected through a control system 756 that may be upon the moving assembly 606 or remote therefrom, and operable either through a direct connection or through another type of connection, such as one that is wireless.

Figure 99:
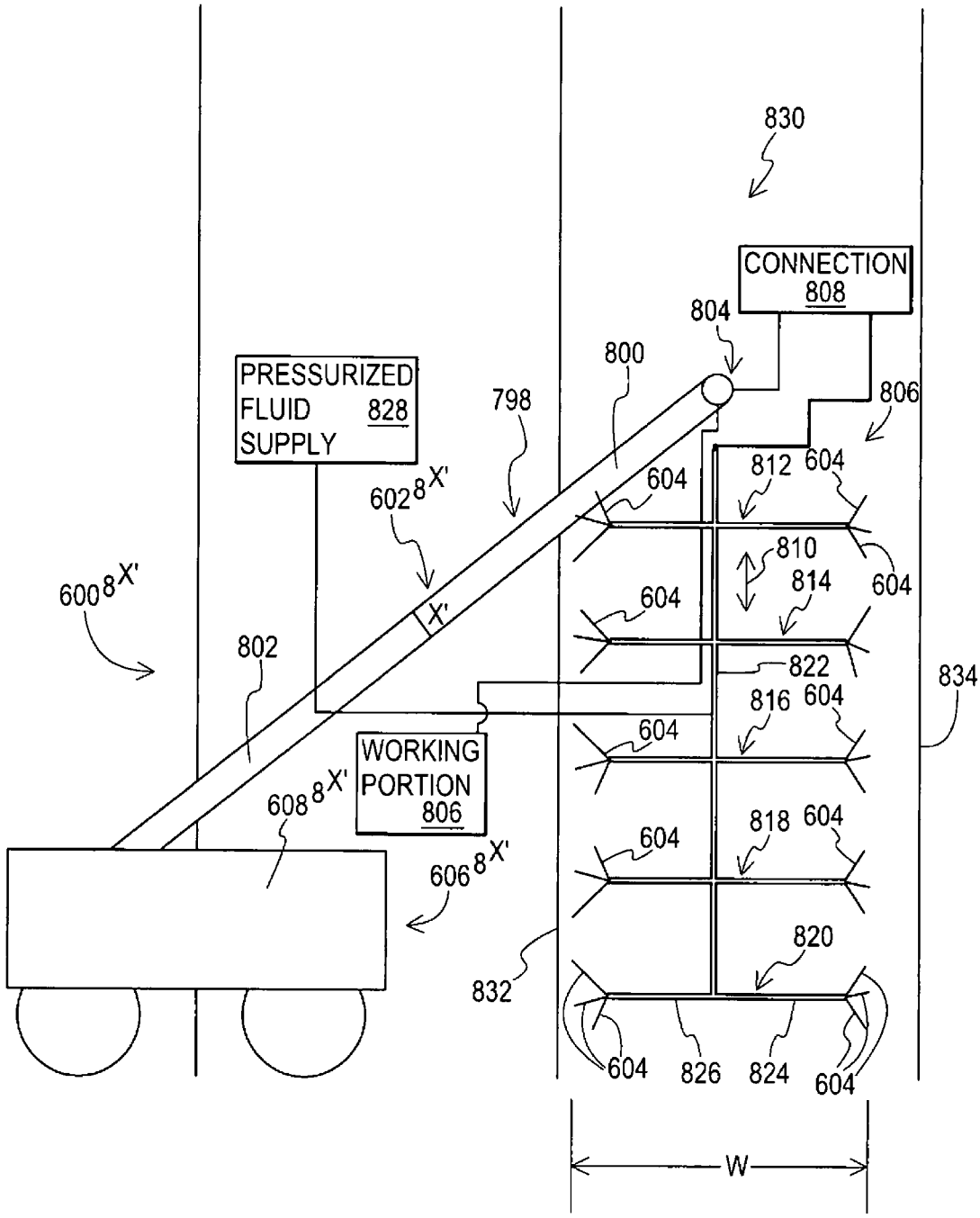
FIG. 99 is a side elevation view of a further modified form of apparatus having a moving assembly and an elongate support with a working portion, having spaced working sections in a depending arrangement, and in relationship to another form of surface being treated.

A further modified form of apparatus, according to the invention, is shown at $\mathbf{600}^{8x'}$ in FIG. 99. The apparatus $\mathbf{600}^{8x'}$ consists of a moving assembly $\mathbf{606}^{8x'}$ with a frame $\mathbf{608}^{8x'}$ to which an elongate support $\mathbf{602}^{8x'}$ is attached. The elongate support $\mathbf{602}^{8x'}$ has a pole assembly 798 that may be constructed to function in the same manner as any of the elongate supports, shown in FIGS. 84-89, and may be rigid in length or articulated to allow one extension part 800 to be guided in movement relative to another part 802 of the pole assembly 798. At a distal region 804 of the extension part 800, a working portion 806 of the elongate support $\mathbf{602}^{8x'}$ is provided. The working portion 806 is maintained in an operative depending relationship at the distal region 804 of the pole assembly 798, through an appropriate connection, shown schematically at 808 in FIG. 99.

The connection 808 may include hinge, multiple axis, or universal pivot components that allow the working portion 806 to be maintained in the same operating orientation shown in FIG. 99 as the pole assembly 798 is repositioned or reconfigured as shown for the elongate supports in any of FIGS. 84-89. Provision might be made to change the angular orientation for the working portion 806 relative to the pole assembly 798, and to selectively maintain different orientations thereof in use.

The connection 808 may also incorporate a selectively extendible and retractable cord or cable that allows the working portion 806 to be raised and lowered along the line indicated by the double-headed arrow 810.

The working portion 806 consists of multiple, and in this case five, working sections 812, 814, 816, 818, 820, spaced at equal vertical intervals. The number of working sections could be as few as one and greater than the five shown. The working sections 812, 814, 816, 818, 820 are attached to a vertically extending base 822.

The working sections 812, 814, 816, 818, 820 may have the same or different constructions. In the depicted embodiment, the working sections 812, 814, 816, 818, 820 are each the same. Exemplary working section 820 consists of legs 824, 826 projecting oppositely in substantially a straight line, away from the base 822. This straight line arrangement is not required, however. One or more, and in this case three, flexible tubes 604 are provided at the free ends of each of the legs 824, 826 to function as previously described.

Separate feed lines (not shown) may communicate pressurized fluid between a supply 828 and the flexible tubes 604 in this and all other embodiments described herein. More preferably, the base 822 defines a manifold that is a communication with the pressurized fluid supply 828. The pressurized fluid is distributed through the base 822 to the flexible tubes 604 via the legs 824, 826 on the working section 820, and a like arrangement on the other working sections 812, 814, 816, 818.

The effective width dimension W for the working portion is chosen to match that of a surface region at 830, as between beams 832, 834 that are spaced equidistantly along their vertical extent. The width dimension W, as well as the other dimensions and configuration of the working portion 806, can be selected as dictated by the surface to be treated and the various component contours bounding, and in the vicinity thereof.

The depending configuration shown in FIG. 99 is desirable from the standpoint that it can be supported in the operative orientation without requiring heavy structural components, as in the event that the working portion 806 were supported by structure through which an upward vertical force is required to be applied.

It is also possible to gang mount multiple working portions 806. An additional working portion 806 is shown schematically in FIG. 99 attached in an operative position from the pole assembly 798.

Figure 100:
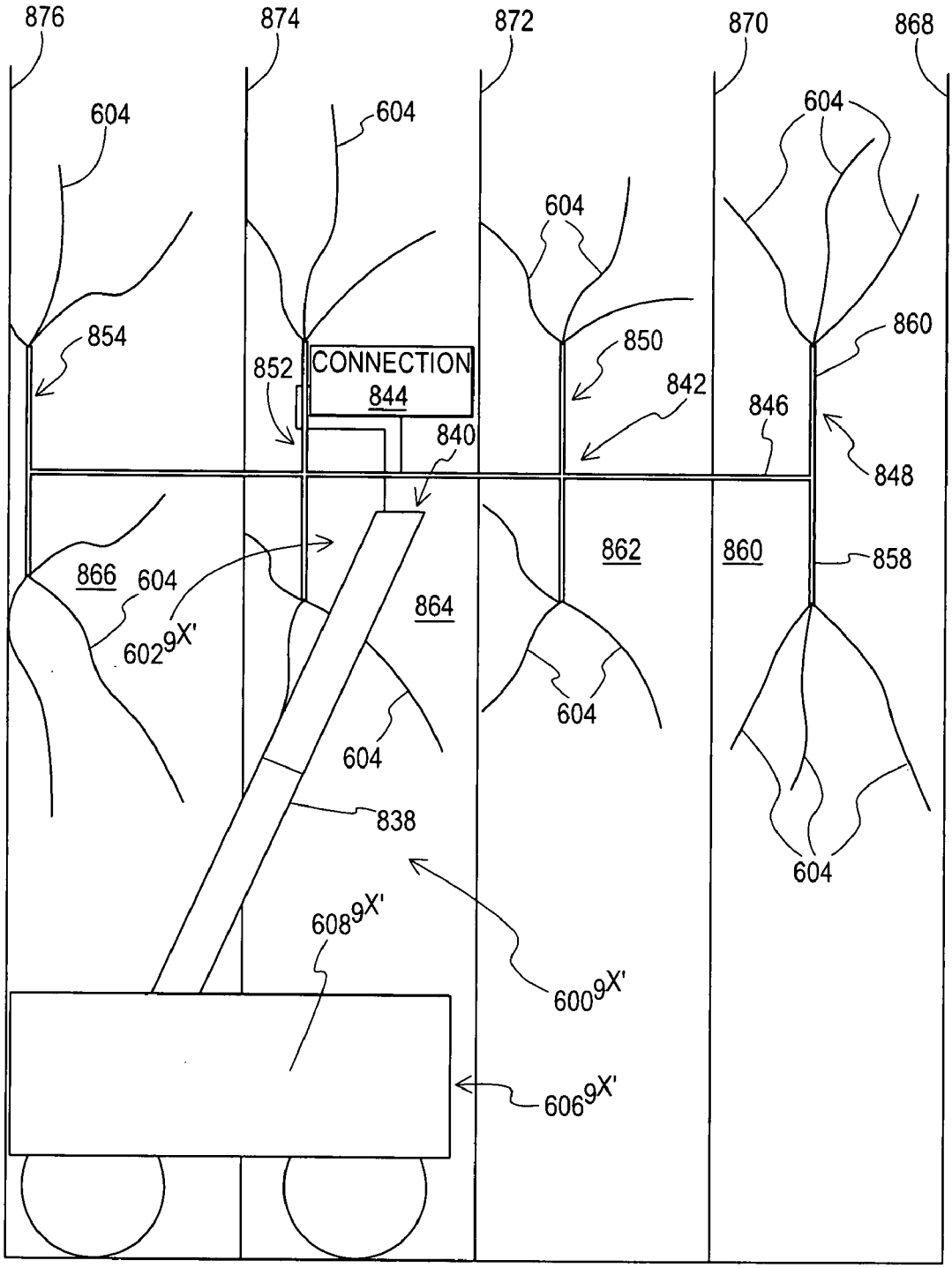
FIG. 100 is a side elevation view of a further modified form of apparatus having a moving assembly and an elongate support with another form of working portion, having spaced working sections, in relationship to still another form of surface being treated.

In FIG. 100, another modified form of apparatus, according to the invention, is shown at $\mathbf{600}^{9x'}$. The apparatus $\mathbf{600}^{9x'}$ consists of a moving assembly $\mathbf{606}^{9x'}$ with a frame $\mathbf{608}^{9x'}$ to which an elongate support $\mathbf{602}^{9x'}$ is attached. The elongate support $\mathbf{602}^{9x'}$ has a pole assembly 838 corresponding in construction and function to the pole assembly 798.

The pole assembly 838 has a distal region 840 to which a working portion 842 of the elongate support $\mathbf{602}^{9x'}$ is operatively attached through a connection 844. The working portion 842 has a general configuration similar to the working portion 806, to include an elongate base 846 with multiple working sections 848, 850, 852, 854 spaced at regular intervals therealong. As with the working portion 806, this interval dimension may be fixed or variable to accommodate different encountered field conditions.

The working sections 848, 850, 852, 854 may have the same construction as the previously described working sections 812, 814, 816, 818, 820. Exemplary working section 848 has legs 856, 858, projecting oppositely from the base 846 substantially in a line to one or more, and in this case three, flexible tubes 604.

The connection 844 may rigidly connect the pole assembly 838 to the working portion 842. More preferably, angular reorientation of the working portion 842 about one or more axes relative to the pole assembly 838 is made possible through the connection 844. Suitable constructions for this connection 844 are well known to those skilled in this art.

Through this arrangement, the working sections 848, 850, 852, 854 may be placed, one each against discrete surface portions 860, 862, 864, 866 that may be bounded by horizontally spaced, vertically extending beams 868, 870, 872, 874, 876. By reconfiguring, reorienting, and/or moving the pole assembly 838 relative to, and through, the frame $\mathbf{608}^{9x'}$, the flexible tubes 604 can be strategically placed and moved to cause the flexible tubes 604 and pressurized fluid to simultaneously treat the surface portions 860, 862, 864, 866 along the vertical extent thereof within the range of the apparatus $\mathbf{600}^{9x'}$. The apparatus $\mathbf{600}^{9x'}$ can be moved to likewise treat other surface portions.

Figure 101:
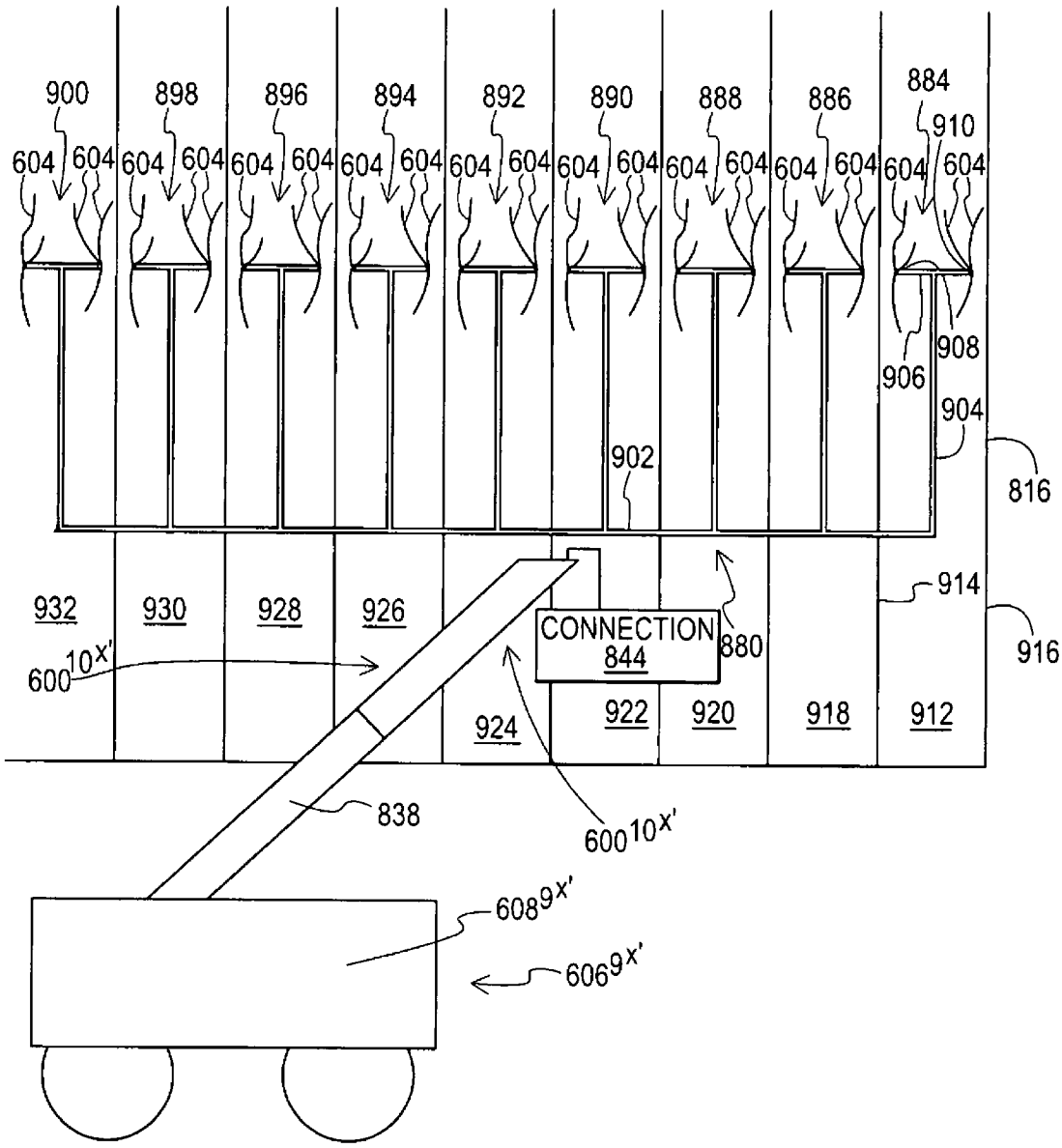
FIG. 101 is a side elevation view of a further modified form of apparatus having a moving assembly and an elongate support with another form of working portion, having spaced working sections, in relationship to yet another form of surface being treated.

In FIG. 101, a modified form of apparatus is shown at $\mathbf{600}^{10x'}$ with the moving assembly $\mathbf{606}^{9x'}$, frame $\mathbf{608}^{9x'}$, and pole assembly 838 of FIG. 100. Through a like connection 844, a working portion 880 of an elongate support $\mathbf{602}^{10x'}$ is maintained in an operative position on the pole assembly 838 in the same manner that the working portion 842 is maintained in its operative position upon the pole assembly 838.

The working portion 880 differs from the working portion 842 by reason of the configuration of multiple working sections 884, 886, 888, 890, 892, 894, 896, 898, 900, that project from a common base/manifold 902. Exemplary working section 884 has a leg 904 that joins to a further branching sub-base 906 with opposite ends 908, 910 at which at least one, and in this case three, flexible tubes 604 are provided. The leg 904 projects orthogonally to the length of the base/manifold 902. The sub-base 906 is in turn orthogonal to the length of the leg 904 to define a "T" shape in conjunction therewith.

With this arrangement, the groups of flexible tubes 604 at the ends 908, 910 simultaneously treat a surface portion 912, as between adjacent, bounding beams 914, 916. This arrangement facilitates accessing the entire beam contour, as well as the surface portion 912 therebetween. The remaining working sections 886, 888, 890, 892, 894, 896, 898, 900 act respectively and simultaneously in a like manner on surface portions 918, 920, 922, 924, 926, 928, 930, 932.

The flexible tubes 604 in this arrangement access beam surfaces not viewable along a user's site line. As with all embodiments herein, the random movement and extended reach of the flexible tubes 604, that can be substantial depending upon a chosen length thereof, makes access to hidden spaces, recesses, indentations, etc. possible, whereas such access is precluded with conventional tools directed linearly towards and against surfaces to be treated.

The foregoing disclosure of specific embodiments is intended to be illustrative of the broad concepts comprehended by the invention.

The invention claimed is:

1. In combination:

a) an apparatus for treating a surface bounding a space within which a bulk supply of flowable material can be contained, the apparatus comprising:

an elongate support having a proximal region and a distal region;

at least one flexible tube at the distal region of the elongate support through which a fluid from a pressurized supply can be directed, the at least one flexible tube movable continuously in a whipping action to thereby cause a force to be applied to a surface at or adjacent to which the flexible tube is located to thereby at least one of: a) apply a fluid; and b) separate matter adhered to a surface at or adjacent to which the flexible tube is located; and a moving assembly for the elongate support, the moving assembly operable to controllably reposition and/or reconfigure the elongate support thereby to controllably place the at least one flexible tube at different selected locations with respect to a surface to be treated by the apparatus; and b) a floating vessel in which a bulk supply of flowable material can be stored and transported on a navigable body of water, the floating vessel having a cargo hold with the surface bounding the space within which a bulk supply of flowable material can be contained and within which the apparatus at least partially resides with the at least one flexible tube moving continuously in a whipping action to thereby cause a force to be applied to the surface.

2. The combination according to claim 1 wherein the moving assembly comprises a frame upon which the elongate support is mounted.

3. The combination according to claim 2 wherein the frame has at least one wheel upon which the frame can be supported upon a subjacent surface and which can be rolled against a subjacent surface to facilitate repositioning of the frame and thereby the elongate support.

4. The combination according to claim 3 wherein the frame has a plurality of wheels upon which the frame can be supported.

5. The combination according to claim 2 wherein the moving assembly comprises a powered drive for selectively repositioning the frame and thereby the elongate support within a space within which the apparatus is located.

6. The combination according to claim 2 wherein the elongate support has a length that can be changed thereby to change a position of the at least one flexible tube relative to the frame.

7. The combination according to claim 2 wherein the elongate support has a lengthwise axis with an angular relationship with the frame and the angular relationship of the lengthwise axis with the frame can be changed.

8. The combination according to claim 2 wherein at least a part of the elongate support can be turned about an axis relative to the frame.

9. The combination according to claim 2 wherein the elongate support has a lengthwise axis and at least a part of the elongate support can be translated relative to the frame in a direction transversely to the lengthwise axis.

10. The combination according to claim 2 wherein the frame comprises a support for at least one user.

11. The combination according to claim 10 wherein the apparatus has a control system through which a user, supported on the frame, can cause the elongate support to be repositioned and/or reconfigured.

12. The combination according to claim 10 wherein the apparatus has a powered drive for selectively moving the frame from within the space in the cargo hold within which the apparatus resides, the apparatus further comprising a control system through which a user, supported on the frame, can operate the powered drive.

13. The combination according to claim 1 wherein the at least one flexible tube is movable continuously in a random whipping action as an incident of the fluid being directed through the at least one flexible tube.

14. The combination according to claim 1 in combination with a pressurized supply of fluid directed through the at least one flexible tube, the fluid comprising at least one of: a) a liquid; and b) a gas.

15. The combination according to claim 1 wherein the at least one flexible tube comprises a plurality of flexible tubes at the distal region of the elongate support.

16. The combination according to claim 1 wherein at least one part of the support is movable relative to another part of the support to controllably place the at least one flexible tube at different selected locations.

17. The combination according to claim 16 wherein the at least one part of the support is pivotable relative to the another part of the support.

18. The combination according to claim 2 wherein the frame is repositionable and/or reconfigurable to controllably place the at least one flexible tube at different selected locations.

19. The combination according to claim 1 wherein the elongate support comprises a first elongate support and at least a part of the first elongate support is releasably joined to the frame through releasable connector parts on the first elongate support and frame and further in combination with a second elongate support that can be releasably joined to the frame in place of the first elongate support through the releasable connector part on the frame and a releasable connector part on the second elongate support.

20. The combination according to claim 19 wherein the first and second elongate supports have different configurations.

21. The combination according to claim 1 wherein the elongate support has a working portion with separate, spaced working sections each of which has at least one flexible tube associated therewith, the at least one flexible tube at the separate, spaced working sections simultaneously engageable at different locations on a surface to be treated.

22. The combination according to claim 1 wherein the apparatus resides partially outside of the space.

23. In combination:

a) an apparatus for treating a surface bounding a space within which a bulk supply of flowable material can be contained, the apparatus comprising:

a support having a working portion with spaced working sections;

at least one flexible tube at each of the working sections through which a fluid from a pressurized supply can be directed, the at least one flexible tube on each of the working sections movable continuously in a whipping action to thereby cause a force to be applied to a surface at or adjacent to which the flexible tube is located to thereby at least one of: a) apply a fluid; and b) separate matter adhered to a surface at or adjacent to which the flexible tube is located, the at least one flexible tube in each of the working sections simultaneously engageable at different locations on a surface to be treated; and a moving assembly for the elongate support, the moving assembly operable to controllably reposition and/or reconfigure the elongate support thereby to controllably place the at least one flexible tube on each of the working sections at different selected locations with respect to a surface to be treated by the apparatus; and b) a floating vessel in which a bulk supply of flowable material can be stored and transported on a navigable body of water, the floating vessel having a cargo hold with the surface bounding the space within which a bulk supply of flowable material can be contained and within which the apparatus at least partially resides with the at least one flexible tube moving continuously in a whipping action to thereby cause a force to be applied to the surface.

* * * * *